US005485179A

United States Patent [19]

Otsuka et al.

[11] Patent Number: 5,485,179

[45] Date of Patent: Jan. 16, 1996

[54] INK-JET RECORDING APPARATUS AND TEMPERATURE CONTROL METHOD THEREFOR

[75] Inventors: Naoji Otsuka, Kawasaki; Kentaro Yano; Hitoshi Sugimoto, both of Yokohama, all of Japan

[73] Assignee: Canon Kabushiki Kaisha, Tokyo, Japan

[21] Appl. No.: 585,924

[22] Filed: Sep. 18, 1990

[30] Foreign Application Priority Data

| | | | |
|---|---|---|---|
| Sep. 18, 1989 | [JP] | Japan | 1-241058 |
| Apr. 11, 1990 | [JP] | Japan | 2-94091 |
| Apr. 11, 1990 | [JP] | Japan | 2-95974 |
| Aug. 6, 1990 | [JP] | Japan | 2-208908 |

[51] Int. Cl.[6] ..... B41J 2/01

[52] U.S. Cl. ..... 347/14

[58] Field of Search ..... 346/140 R, 75; 34/7, 14, 17

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,544,931 | 10/1985 | Watanabe et al. | 346/140 R |
| 4,558,333 | 12/1985 | Sugitani et al. | 346/140 R |
| 4,712,172 | 12/1987 | Kiyohara et al. | 346/101 |
| 4,723,129 | 2/1988 | Endo et al. | 346/1.1 |
| 4,740,796 | 4/1988 | Endo et al. | 346/1.1 |
| 4,860,034 | 8/1989 | Watanabe et al. | 346/140 R |
| 4,910,528 | 3/1990 | Firl et al. | 346/1.1 |

FOREIGN PATENT DOCUMENTS

| | | |
|---|---|---|
| 0300634 | 1/1989 | European Pat. Off. . |
| 318328 | 5/1989 | European Pat. Off. . |
| 0333507 | 9/1989 | European Pat. Off. . |
| 3545689 | 7/1986 | Germany . |
| 3612469 | 10/1986 | Germany . |
| 54-56847 | 5/1979 | Japan . |
| 116657 | 7/1982 | Japan . |
| 59-123670 | 7/1984 | Japan . |
| 59-138461 | 8/1984 | Japan . |
| 60-71260 | 4/1985 | Japan . |
| 60-107368 | 6/1985 | Japan . |
| 173669 | 7/1988 | Japan . |

*Primary Examiner*—Mark J. Reinhart
*Assistant Examiner*—N. Le
*Attorney, Agent, or Firm*—Fitzpatrick, Cella, Harper & Scinto

[57] ABSTRACT

An ink-jet recording apparatus for discharging an ink droplet from a recording head to perform recording includes a heating element array for heating the recording head, a temperature sensor for measuring an ambient temperature, a timer for measuring a time associated with a temperature variation of the recording head during a recording operation, and a control unit for controlling an energy supplied to the heating element array on the basis of the ambient temperature measured by the temperature sensor and the time measured by the timer.

9 Claims, 33 Drawing Sheets

| |
|---|
| FIG. 24A |
| FIG. 24B |

| |
|---|
| FIG. 33A |
| FIG. 33B |

INK-JET RECORDING APPARATUS AND TEMPERATURE CONTROL METHOD THEREFOR

BACKGROUND OF THE INVENTION

1. Field of the Invention

The present invention relates to an ink-jet recording apparatus for causing a recording head to discharge an ink to a recording medium to perform recording, and a temperature control method therefor.

2. Related Background Art

A recording apparatus such as a printer, a copying machine, a facsimile apparatus, or the like records an image consisting of a dot pattern on a recording medium such as a paper sheet or a plastic thin plate.

The recording apparatus can be classified as an ink-jet type, wire dot type, thermal type, laser-beam type, and the like according to a recording method. Of these apparatuses, in the ink-jet type apparatus (ink-jet recording apparatus), an ink droplet (recording liquid) is discharged from a discharge port of a recording head, and is attached to a recording medium, thereby performing recording.

In recent years, a large number of recording apparatuses have been used, and are required to have a high recording speed, a high resolution, high image quality, and low noise.

As a recording apparatus which satisfies these requirements, the ink-jet recording apparatus is known.

In the ink-jet recording apparatus, since recording is performed by discharging an ink from a recording head, the apparatus is considerably influenced by the temperature of the recording head.

For this reason, a conventional ink-jet recording apparatus employs a so-called closed-loop control method wherein a temperature sensor and a temperature control heater which increase cost are arranged in a recording head unit, so that the temperature of the recording head is controlled to fall within a desired range on the basis of the detected temperature of the recording head. As the temperature control heater, a heating member joined to a recording head unit or a discharge heater in a bubble-jet recording apparatus, proposed by CANON INC., for discharging an ink droplet by growing bubbles by film boiling of an ink is used. When the discharge heater is used, it must be energized so as not to generate bubbles.

In particular, in a bubble-jet recording apparatus (which is proposed by CANON INC., and forms bubbles in a solid or liquid ink using a heat energy to obtain an ink droplet to be discharged), since its discharge characteristics are largely varied depending on the temperature of the recording head, as is conventionally known, closed-loop temperature control tends to be performed. Alternatively, only an inexpensive printer which is used for a compact electronic calculator which disregards printing quality, density nonuniformity, and the like is available.

However, in recent years, since portable OA equipments such as laptop personal computers have become popular, portable printers are required to have high quality. A disposable cartridge type printer in which a head and an ink tank are integrated will lead the portable printers since it has a compact structure. In addition, the disposable cartridge type printer will become more popular in terms of maintenance due to an increase in popularity of home- or personal-use wordprocessors, personal computers, and facsimile apparatuses.

In this case, since the temperature sensor and the heater for temperature control are incorporated in the disposable cartridge, the following drawbacks are posed.

(1) Variation in temperature measurement values due to variation in temperature sensor Since a disposable head is an expendable supply, a sensor having a variation in characteristics is connected to the printer main body every time the head is exchanged.

In a bubble-jet recording head, since a discharge heater is manufactured in a semiconductor process, a diode sensor for detecting a temperature of a recording head must be integrally formed in a single process to decrease cost. Since the diode sensor suffers from a variation in the manufacture, it does not have high precision like in a temperature sensor as a selected product, and may often cause a difference of 15° C. or more among manufacturing lots as measurement values of an ambient temperature.

For this reason, closed-loop control using the temperature sensor of the recording head requires a complicated adjustment operation for adjusting a variation in temperature sensor of the recording head in an adjustment process, or mounting a temperature sensor which is measured and ranked in a main body, and correcting it using an adjustment selection switch.

These operations considerably increase manufacturing cost, and impair operability. An increase in signal processing volume caused by these operations, and a considerable increase in processing volume of an MPU caused by closed-loop control itself exert a heavy load on design of a compact or portable printer main body apparatus.

(2) Countermeasure against electrostatic noise

Since a disposable head is an expendable supply, a user frequently attaches or detaches it to or from a main body. For this reason, contacts of the main body are always exposed.

Since the output from the temperature sensor is directly supplied to a circuit on a printed circuit board of the main body through a carriage and a flexible wiring, a temperature measurement circuit is very susceptible to electrostatic noise. Since a compact or portable printer cannot have a sufficient shield effect in its housing, it is further weak against electrostatic noise.

Therefore, in a conventional temperature detection method, an electrostatic shield, and parts as a countermeasure against electrostatic noise must be added at respective portions for only a single temperature sensor, thus considerably disturbing a compact structure, a decrease in cost, and high image quality.

SUMMARY OF THE INVENTION

It is a principal object of the present invention to provide an ink-jet recording apparatus which can control a temperature of a recording head to fall within a desired range without arranging a temperature sensor in the recording head, and a temperature control method therefor.

It is another object of the present invention to provide an ink-jet recording apparatus which can control a temperature of a recording head to fall within a-desired range even when a print rate is changed, and a temperature control method therefor.

It is still another object of the present invention to provide an ink-jet recording apparatus which can control a temperature of a recording head to fall within a desired range even when a difference between a temperature in the recording apparatus and a temperature of the recording head occurs, and a temperature control method therefor.

It is still another object of the present invention to provide an ink-jet recording apparatus which can prevent a temperature of a recording head from being increased to an abnormal high temperature, and a temperature control method therefor.

In order to achieve the principal object, according to a preferred aspect of the present invention, there is provided an ink-jet recording apparatus for causing a recording head to discharge an ink droplet to perform recording, comprising:

heat means for heating the recording head;

temperature measurement means for measuring an ambient temperature;

timer means for measuring a time associated with a temperature variation of the recording head in association with a recording operation; and control means for controlling an energy to be supplied to the heat means on the basis of the ambient temperature measured by the temperature measurement means and the time measured by the timer means.

In order to achieve another object, according to another preferred aspect of the present invention, there is provided an ink-jet recording apparatus for causing a recording head to discharge an ink droplet to perform recording, comprising:

heat means for heating the recording head;

temperature measurement means for measuring an ambient temperature;

print rate measurement means for measuring a print rate in a predetermined time of the recording head; and control means for controlling an energy to be supplied to the heat means on the basis of the ambient temperature measured by the temperature measurement means and the print rate measured by the print rate measurement means.

In order to achieve still another object, according to still another preferred aspect of the present invention, there is provided an ink-jet recording apparatus for causing a recording head to discharge an ink droplet to perform recording, comprising:

temperature measurement means for measuring an ambient temperature;

print rate measurement means for measuring a print rate in a predetermined time of the recording head; and temperature increase anticipating means for anticipating a temperature increase caused by a recording operation of the recording head itself on the basis of the print rate measured by the print rate measurement means; and temperature increase protection means for limiting supply of a recording energy to the recording head on the basis of the temperature increase anticipated by the temperature increase anticipating means.

In order to achieve still another object, according to still another preferred aspect of the present invention, there is provided an ink-jet recording apparatus for causing a recording head to discharge an ink droplet to perform recording, comprising:

heat means for heating the recording head;

an electronic element for supplying an energy to the recording head;

temperature measurement means for measuring a temperature of the electronic element; and control means for estimating a temperature of the recording head on the basis of the temperature of the electronic element measured by the temperature measurement means.

BRIEF DESCRIPTION OF THE DRAWINGS

FIGS. 15, 15A and 15B are flow charts showing temperature control according to the first embodiment of the present invention;

DETAILED DESCRIPTION OF THE PREFERRED EMBODIMENTS

FIGS. 2 to 6 are views for explaining an ink-jet unit IJU, an ink-jet head IJH, an ink tank IT, an ink-jet cartridge IJC, an ink-jet recording apparatus main body IJRA, and a carriage HC, and the relationship among these components. The arrangement of these portions will be described below with reference to FIGS. 2 to 6.

Figure 2:
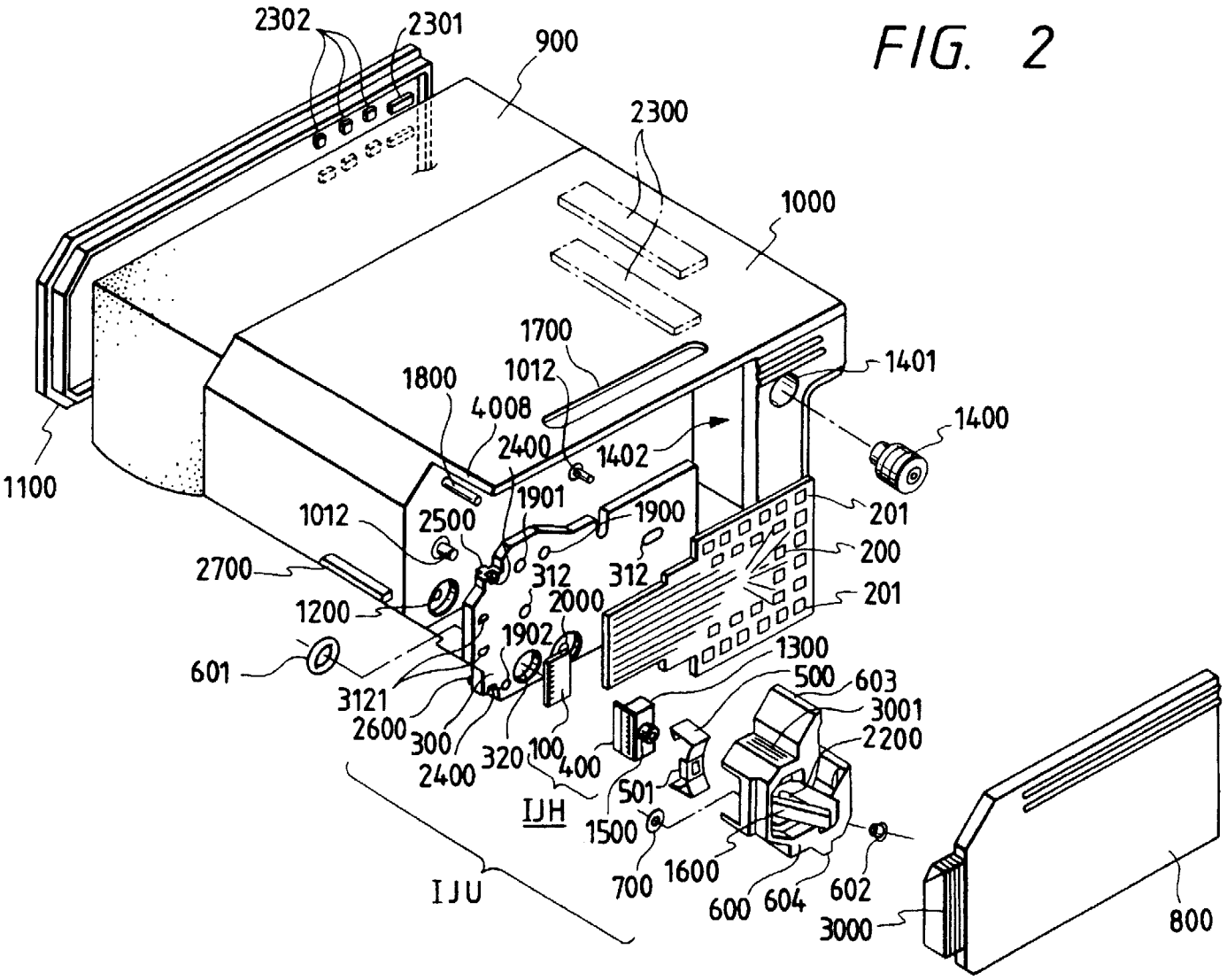
FIG. 2 is an exploded perspective view of a cartridge suitable for the present invention.
Figure 3:
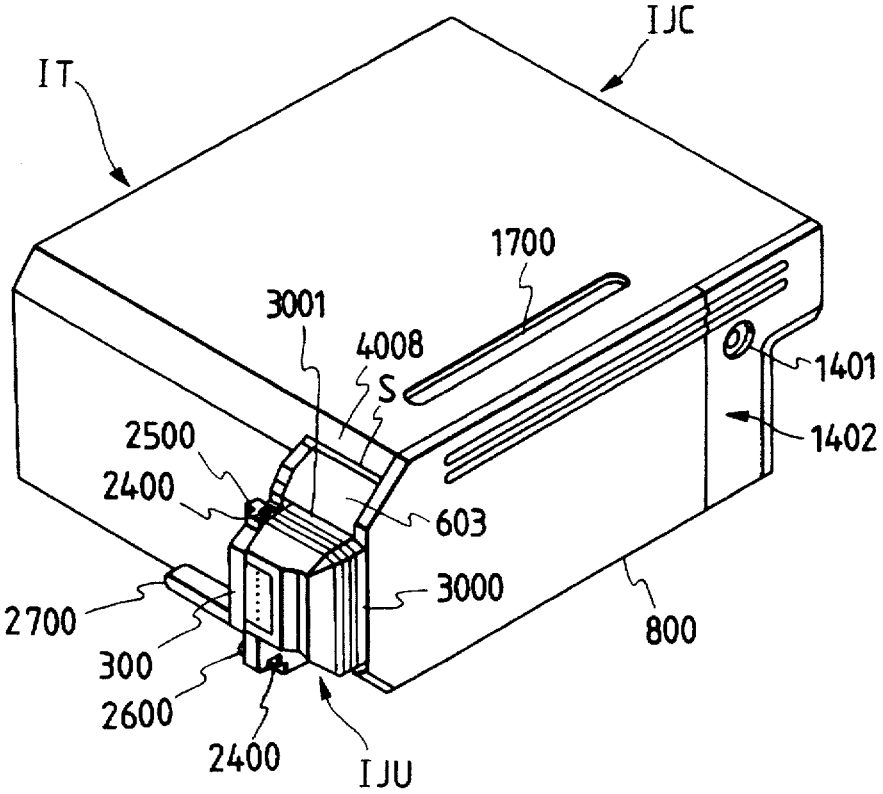
FIG. 3 is a perspective view showing an assembly of the cartridge shown in FIG. 2.

The ink-jet cartridge IJC in this embodiment has an increased ink storage ratio, as can be seen from the perspective view of FIG. 3, and has a shape in which the distal end portion of the ink-jet unit IJU slightly projects from the front surface of the ink tank IT. The ink-jet cartridge IJC is fixed and supported by a positioning means and electrical contacts (to be described later) of the carriage HC (FIG. 5) placed on the ink-jet recording apparatus main body IJRA, and is of a disposable type which can be detachable from the carriage HC. Since FIGS. 2 to 6 of this embodiment show arrangements to which various inventions which have been made in establishment of the present invention are applied, the overall arrangement will be described below while briefly explaining these arrangements.

(i) Arrangement of Ink-jet Unit IJU

The ink-jet unit IJU is a bubble-jet type unit for performing recording using an electrothermal conversion element for generating a heat energy for causing film boiling of an ink according to an electrical signal.

In FIG. 2, a heater board 100 is prepared by forming a plurality of electrothermal conversion element arrays (discharge heater), a temperature control heater, and Al electrical wirings for supplying an electric power to these heaters on an Si substrate by a film formation technique. A wiring circuit board 200 is arranged for the heater board 100, and has wirings corresponding to those of the heater board 100 (e.g., these wirings are connected by wire bonding), and pads 201, located at the end portions of these wirings, for receiving electrical signals from the apparatus main body.

A grooved top plate 1300, on which partition walls for dividing a plurality of ink paths, a common ink chamber, and the like are arranged, is formed by integrally molding an ink reception port 1500 for receiving an ink supplied from the ink tank and guiding it to the common ink chamber, and an orifice plate 400 having a plurality of discharge ports. As a material for integrally molding these components, polysulfone is preferable, but other molding resin materials may be used.

A metal support member 300 supports the rear surface of the wiring circuit board 200 on a plane, and serves as a bottom plate of the ink-jet unit. A pressing spring 500 has an M shape, and presses the common ink chamber at the central portion of its "M" shape at a low pressure. In addition, an apron portion 501 of the spring 500 presses a portion of an ink path at a line pressure. The leg portions of the pressing spring are engaged with the rear surface side of the support member 300 via holes 3121 of the support member 300 to sandwich the heater board 100 and the top plate 1300 therebetween, thereby engaging these components. Thus, the heater board 100 and the top plate 1300 are pressed and fixed by the biasing force of the pressing spring 500 and its apron portion 501. The support member 300 has positioning holes 312, 1900, and 2000 which are respectively engaged with the two positioning projections 1012 of the ink tank IT, and positioning and thermal fusion bonding projections 1800 and 1801. The support member 300 also has positioning projections 2500 and 2600 for the carriage HC of the apparatus main body IJRA on its rear surface. In addition, the support member 300 has a hole 320 for allowing an ink supply pipe 2200 (to be described later) extending therethrough to supply ink from the ink tank. The wiring circuit board 200 is mounted on the support member 300 by adhesion using an adhesive. Note that recess portions 2400 of the support member 300 are formed near the positioning projections 2500 and 2600. These recess portions are present on a plurality of extending lines of parallel grooves 3000 and 3001 formed on the three side surfaces around the distal end region of the head portion of the assembled ink-jet cartridge IJC (FIG. 3). For this reason, unnecessary matters such as dust or an unnecessary ink moved along the parallel grooves 3000 and 3001 are prevented from reaching the projections 2500 and 2600. A lid member 800 on which the parallel groove 3000 is formed defines an outer wall of the ink-jet cartridge IJC, as can be seen from FIG. 5, and also defines a space portion for storing the ink-jet unit IJU together with the ink tank IT. An ink supply member 600 on which the parallel groove 3001 is formed forms an ink guide pipe 1600 continuous with the ink supply pipe 2200 as a cantilever which is fixed at the supply pipe 2200 side, and a sealing pin 602 for assuring a capillarity between the fixed portion of the ink guide pipe and the ink supply pipe 2200 is inserted in the member 600. Note that a packing 601 provides a coupling seal between the ink tank IT and the supply pipe 2200, and a filter 700 is arranged at the end portion on the side of the tank of the supply pipe.

Since the ink supply member 600 is formed by molding, it is inexpensive, has high positioning precision, and can eliminate a decrease in precision in the manufacture. In addition, since the ink guide pipe 1600 has a cantilever structure, a pressing contact state of the guide pipe 1600 against the ink reception port 1500 can be stabilized. Thus, the ink supply member 600 is also suitable for mass-production. In this embodiment, a sealing adhesive is fed from the ink supply member side in this pressing contact state, thus reliably attaining a complete communication state. The ink supply member 600 can be easily fixed to the support member 300 in such a manner that pins (not shown) on the rear surface of the ink supply member project through holes 1901 and 1902 of the support member 300, and the projecting portions on the rear surface of the support member 300 are thermally fused. The small thermally fused projection regions on the rear surface portion can be housed in a recess (not shown) of the wall surface of the ink tank IT on which the ink jet unit IJU is mounted. Therefore, a positioning surface of the unit IJU can be precisely obtained.

(ii) Arrangement of Ink Tank IT

The ink tank is constituted by a cartridge main body 1000, an ink absorber 900, and a lid member 1100 for sealing the ink absorber 900 after the ink absorber is inserted from a side surface opposite to the unit IJU mounting surface of the cartridge main body 1000.

The ink absorber 900 is impregnated with an ink, and is arranged in the cartridge main body 1000. A supply port 1200 supplies ink to the unit IJU consisting of the components 100 to 600, and also serves as an injection port. That is, when an ink is injected from the supply port 1200 before the unit is arranged on a portion 1010 of the cartridge main body 1000, an ink is impregnated in the absorber 900.

In this embodiment, portions capable of supplying an ink are an air communication port 1401 and this supply port 1200. In order to satisfactorily supply an ink from the ink absorber, an intra-tank air region defined by ribs 2300 in the main body 1000 and partial ribs 2301 and 2302 of the lid portion 1100 is formed to be continuous with the air communication port 1401 side over a corner area farthest from the ink supply port 1200. Therefore, it is important to relatively satisfactorily and uniformly supply an ink to the absorber from the side of the supply port 1200. This method is very effective in a practical application. The ribs 2300 include four ribs parallel to the moving direction of the carriage, which are formed on the surface of the rear portion of the ink tank main body 1000 so as to prevent the absorber from being in direct contact with the surface of the rear portion. The partial ribs 2301 and 2302 are similarly formed on the inner surface of the lid member 1100 on the corresponding extending lines of the ribs 2300, but are divided unlike the ribs 2300 to increase an air space as compared to the ribs 2300. Note that the partial ribs 2301 and 2302 are dispersed on a surface portion ½ or less the entire surface of the lid member 1100. With these ribs, an ink in a corner area farthest from the ink supply port 1200 of the ink absorber can reliably guided toward the supply port 1200 by a capillarity force while being stabilized. The air communication port 1401 is formed in the lid member to cause the interior of the cartridge to communicate with outer air. A waterproof member 1400 is arranged inside the air communication port 1401 to prevent an ink from leaking from the air communication port 1401.

An ink storage space of the ink tank IT has a rectangular shape, and its long side corresponds to a side surface. Therefore, the above-mentioned arrangement of the ribs are particularly effective. When the storage space has a long side parallel to the moving direction of the carriage, or has a cubic shape, the ribs are formed on the entire lid member 1100 to stabilize ink supply from the ink absorber 900. In order to store an ink in a limited space as much as possible, a cubic shape is suitable. However, in order to efficiently use the stored ink for recording, as described above, it is important to form ribs capable of performing the above-mentioned operation on two surface regions adjacent to the corner portion. Furthermore, the ribs 2301 and 2302 on the inner surface of the ink tank IT in this embodiment are arranged at an almost uniform distribution with respect to the direction of thickness of the cubic ink absorber 900. This structure is important since it can uniform an atmospheric pressure distribution with respect to ink consumption of the overall absorber, and can make an ink residue almost zero.

Furthermore, the technical idea of the arrangement of the ribs will be described below in more detail. When an arc having a long side as a radius is drawn to have a position obtained by projecting the ink supply port 1200 of the ink tank onto the square upper surface of the cube as the center, it is important to arrange the above-mentioned ribs on a surface portion outside the arc so that an atmospheric pressure is given earlier to the absorber portion located outside the arc. In this case, the position of the air communication port 1401 of the tank is not limited to that of this embodiment as long as air can be introduced to the rib arrangement region.

In this embodiment, the ink-jet cartridge IJC has a flat rear surface portion with respect to the head to minimize a necessary space when it is assembled in the apparatus, and to maximize an ink storage amount. Therefore, the cartridge of this embodiment has an excellent structure since the apparatus can be rendered compact, and an exchange frequency of cartridges can be decreased. A projecting portion for the air communication port 1401 is formed by utilizing a rear portion of a space for integrating the ink-jet unit IJU, and the interior of the projecting portion is hollowed to forman atmospheric pressure supply space 1402 for the total thickness of the absorber 900, as described above. With this arrangement, an excellent cartridge which cannot be realized by the conventional technique can be provided.

Note that the atmospheric pressure supply space 1402 is considerably larger than a conventional one, and the air communication port 1401 is located above this space. Therefore, even if an ink is released from the absorber due to any abnormality, the atmospheric pressure supply space 1402 can temporarily store the released ink, and can reliably recover it to the absorber. Thus, an efficient cartridge can be provided.

Figure 4:
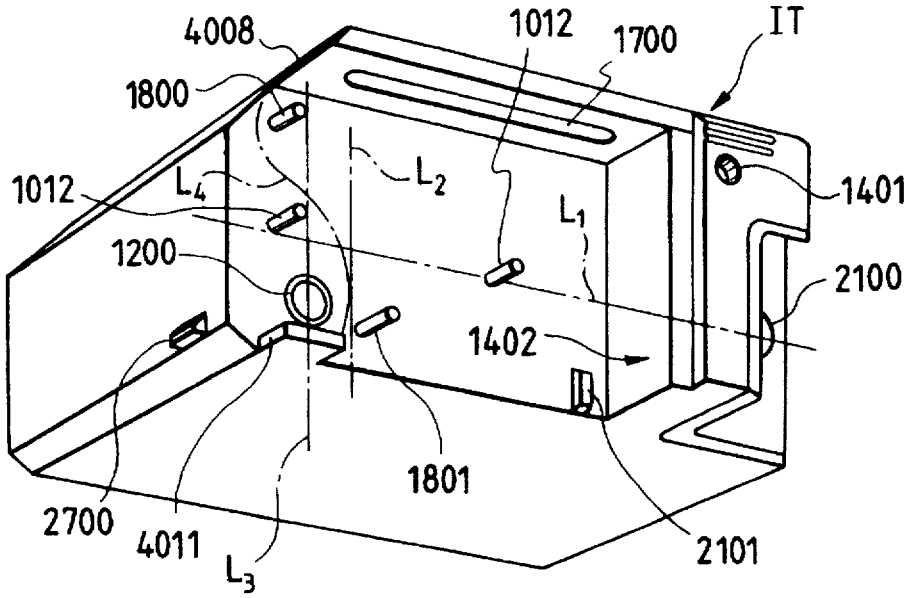
FIG. 4 is a perspective view of a mounting portion of an ink-jet unit IJU.

FIG. 4 shows an arrangement of the unit IJU mounting surface of the ink tank IT. If a straight line which passes almost the center of a projecting port of the orifice plate 400 and is parallel to the bottom surface of the tank IT or the mounting reference surface for the surface of the carriage is represented by $L_1$, the two positioning projections 1012 to be engaged with the holes 312 of the support member 300 are located on the straight line $L_1$. The height of each projection 1012 is slightly smaller than the thickness of the support member 300, and this projection positions the support member 300. A pawl 2100 to be engaged with a 90° engaging surface 4002 of a positioning hook 4001 of the carriage is located on the extending line of the straight line $L_1$ on this drawing, so that a positioning force for the carriage acts on a surface region parallel to the reference surface including the straight line $L_1$. As will be described later with reference to FIG. 5, these relationships are effective since the positioning precision of only the ink tank is equivalent to that of a discharge port of the head.

Projections 1800 and 1801 of the ink tank corresponding to the fixing holes 1900 and 2000 of the support member 300 to the side surface of the ink tank are longer than the above-mentioned projections 1012, and extend through the support member 300. The projecting portions of these projections are thermally fused to fix the support member 300 on the side surface of the ink tank. When a straight line perpendicular to the above-mentioned line $L_1$ and passing the projection 1800 is represented by $L_3$ and a straight line passing through the projection 1801 is represented by $L_2$, since almost the center of the supply port 1200 is located on the straight line $L_3$, the above-mentioned projections stabilize a coupling state between the supply port 1200 and the supply pipe 2200, and can reduce a load caused by dropping or a shock to the coupling state, resulting in a preferable arrangement.

The straight lines $L_2$ and $L_3$ do not coincide with each other, and the projections 1800 and 1801 are present around the projections 1012 on the discharge port side of the head IJH, thus reinforcing a positioning effect of the head IJH with respect to the tank. Note that a curve indicated by $L_4$ represents an outer wall position when the ink supply member 600 is mounted. Since the projections 1800 and 1801 are present along the curve $L_4$, they can provide a sufficient mechanical strength and position precision against to the weight of the arrangement on the distal end side of the head IJH. Note that a distal end collar 2700 of the ink tank IT is inserted in a hole of a front plate 4000 of the carriage HC to cope with an abnormal state wherein the ink tank is extraordinarily displaced. A removal stopper 2101 for the carriage HC is arranged near a bar (not shown) of the carriage HC, and serves as a projection member which is inserted below this bar at a position where the cartridge IJC is turned and mounted, as will be described later, and maintains a mounting state even when an upward force for releasing the carriage from the aligned position accidentally acts.

The ink tank IT is covered with the lid member 800 after the unit IJU is mounted thereon, thus defining a shape for surrounding the unit IJU excluding a lower opening. As for the ink-jet cartridge IJC, since a lower opening to be mounted on the carriage HC is adjacent to the carriage HC, a substantially four-way surrounded space is formed. Therefore, heat generated by the head IJH located in the surrounded space is effective for keeping a temperature in this space but corresponds to a small temperature increase when the apparatus is continuously used for a long period of time. For this reason, in order to assist natural heat dissipation of the support member, a slit 1700 having a smaller width than this space is formed, so that a uniform temperature distribution of the entire unit IJU does not depend on an environment while preventing a temperature increase.

When the ink-jet cartridge IJC is assembled, an ink is supplied from the interior of the cartridge into the supply member 600 via the supply port 1200, the hole 320 formed on the support member 300, and an inlet port formed on the central rear surface of the supply member 600. After the ink passes through the interior of the supply member 600, it flows into the common ink chamber via an appropriate supply pipe and the ink reception port 1500 of the top plate 1300. Packings of, e.g., silicone rubber or butyl rubber are arranged in connected portions for ink communication in the above arrangement, thus providing a seal to assure an ink supply path.

In this embodiment, the top plate is formed of a resin such as polysulfone, polyethersulfone, polyphenylene oxide, polypropylene, or the like, and is simultaneously molded by molds together with the orifice plate portion 400.

As described above, since the integrally molded parts are the ink supply member 600, an integrated member of the top plate 1300 and the orifice plate 400, and the ink tank main body 1000, high assembly precision can be attained, and quality in mass-production can be improved. Since the number of parts can be decreased, excellent predetermined characteristics can be reliably exhibited.

In this embodiment, in an assembled shape, as shown in FIGS. 2 to 4, a slit S is formed between an upper surface portion 603 of the ink supplymember 600 and an end portion 4008 of a roof portion having the slit 1700 of the ink tank IT, as shown in FIG. 3, and a slit similar to the slit S is formed between a lower surface portion 604 and a head end portion 4011 of a thin plate member to which the lower lid member 800 of the ink tank IT is adhered. These slits between the ink tank IT and the ink supply member 600 essentially perform an operation for promoting heat radiation of the slit 1700, and can prevent an unnecessary pressure applied to the tank IT from directly applying to the supply member, and the ink-jet unit IJU.

In any case, the above arrangements of this embodiment are unique ones, can independently provide advantages, and can also provide a systematic arrangement as a whole.

(iii) Mounting of Ink-jet Cartridge IJC to Carriage HC

Figure 5:
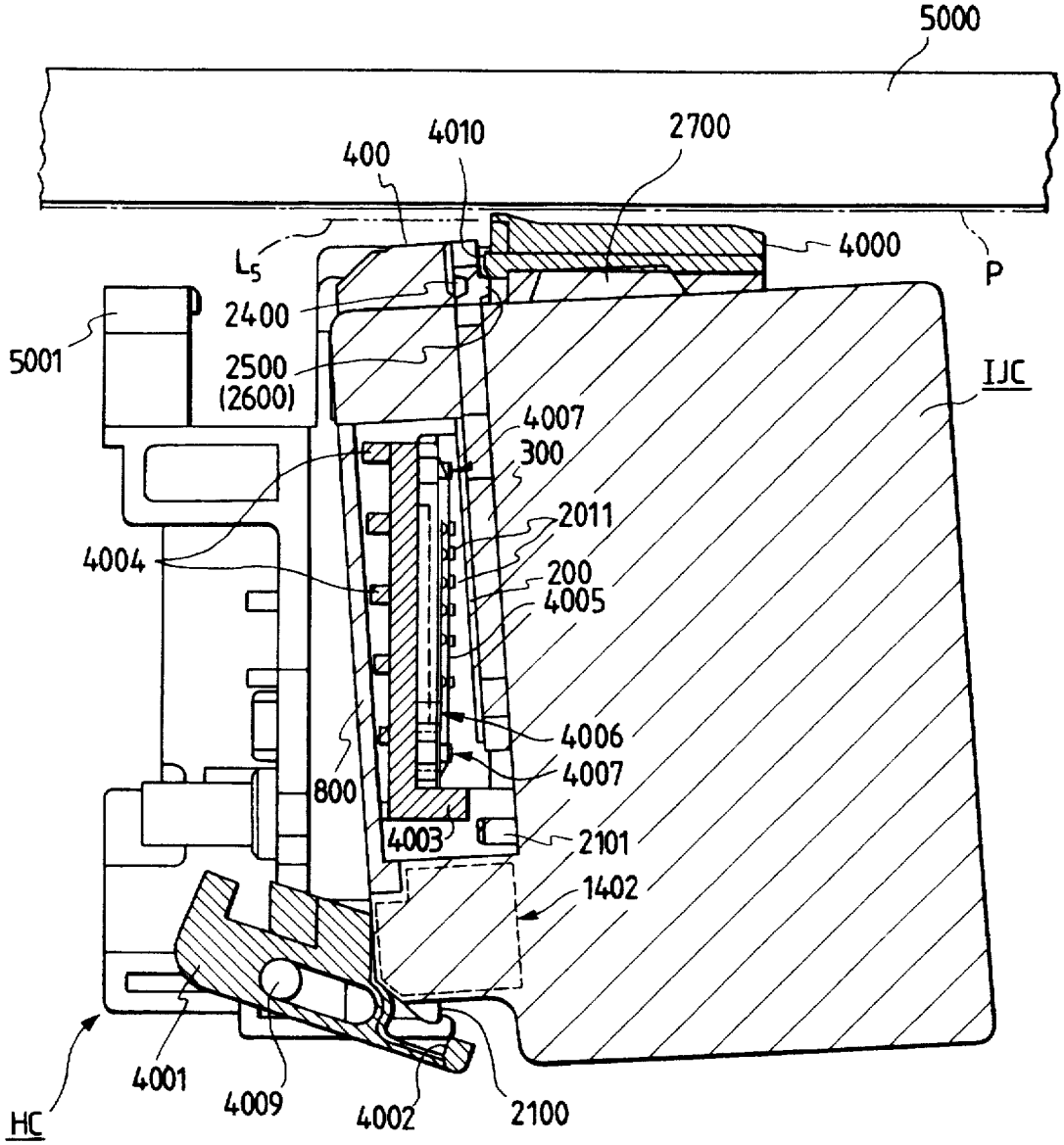
FIG. 5 is a view for explaining a mounting operation of the cartridge IJU to an apparatus.

In FIG. 5, a platen roller 5000 guides a recording medium P from a lower side of the drawing toward an upper side. The carriage HC is moved along the platen roller 5000, and is provided with the front plate 4000 (thickness=2 mm) located on the front surface side of the ink-jet cartridge IJC on the side of the front platen of the carriage, an electrical connecting portion support plate 4003 for holding a flexible sheet 4005 comprising pads 2011 corresponding to the pads 201 of the wiring circuit board 200 of the cartridge IJC and a rubber pad sheet 4007 for generating an elastic force for pressing the sheet 4005 against the pads 2011 from the rear surface side, and the positioning hook 4001 for fixing the ink-jet cartridge IJC to the recording position. The front plate 4000 has two positioning projection surfaces 4010 corresponding to the above-mentioned positioning projections 2500 and 2600 of the support member 300 of the cartridge. After the cartridge is mounted, the front plate receives a force perpendicular to the projection surfaces 4010. For this reason, a plurality of reinforcement ribs (not shown) along the direction of the force are arranged on the front plate 4000 on the side of the platen roller. These ribs also form head protection projections slightly projecting (about 0.1 mm) from a front surface position $L_5$ of the cartridge IJC when the cartridge IJC is mounted.

The electrical connecting portion support plate 4003 has a plurality of reinforcement ribs 4004 not in a direction of the above-mentioned ribs but in a direction perpendicular thereto. A sideward projecting amount is decreased from the platen side toward the hook 4001. This also serves to provide a function of inclining the cartridge mounting position, as shown in FIG. 5.

The support plate 4003 has two hook-side projection surfaces 4006 for applying a force to the cartridge in a direction opposite to a direction of a force applied from the two positioning projection surfaces 4010 to the cartridge to form a pad contact region between these two positioning surfaces, and to uniquely define deformation amounts of projections of the rubber pad sheet 4007, which projections correspond to the pads 2011. These positioning surfaces are in contact with the surface of the wiring circuit board 200 when the cartridge IJC is fixed at a recording position. In this embodiment, since the pads 201 of the wiring circuit board 200 are distributed to be symmetrical about the above-mentioned line $L_1$, the deformation amounts of the projections of the rubber pad sheet 4007 can be uniformed to much stabilize contact pressures of the pads 2011. In this embodiment, the pads 201 are distributed in a 2×2 matrix.

The hook 4001 has an elongated hole to be engaged with a stationary shaft 4009. The hook 4001 is pivoted counterclockwise from the illustrated position by utilizing a moving space of this elongated hole, and thereafter, is moved to the left along the platen roller 5000, thereby positioning the ink-jet cartridge IJC with respect to the carriage HC. The hook 4001 may be moved by any other method, but may be preferably moved by, e.g., a lever. When the hook 4001 is pivoted, the cartridge IJC is moved toward the platen roller, and the positioning projections 2500 and 2600 are moved to positions where they can be brought into contact with the positioning surfaces 4010 of the front plate. When the hook 4001 is moved to the left, the 90° engaging surface 4002 is brought into tight contact with the 90° surface of the pawl 2100 of the cartridge IJC, and the cartridge IJC is turned about the contact regions between the positioning surfaces 2500 and 4010 in the horizontal plane as the center. Finally, the pads 201 and 2011 begin to be brought into contact with each other. When the hook 4001 is held at a predetermined position, i.e., a fixing position, a complete contact state between the pads 201 and 2011, a complete surface contact state between the positioning surfaces 2500 and 4010, a two-surface contact state between the 90° engaging surface 4002 and the 90° surface of the pawl, and a surface contact state between the wiring circuit board 200 and the positioning surfaces 4007 and 4008 are simultaneously formed, thus completing holding of the cartridge IJC with respect to the carriage HC.

(iv) Apparatus Main Body

Figure 6:
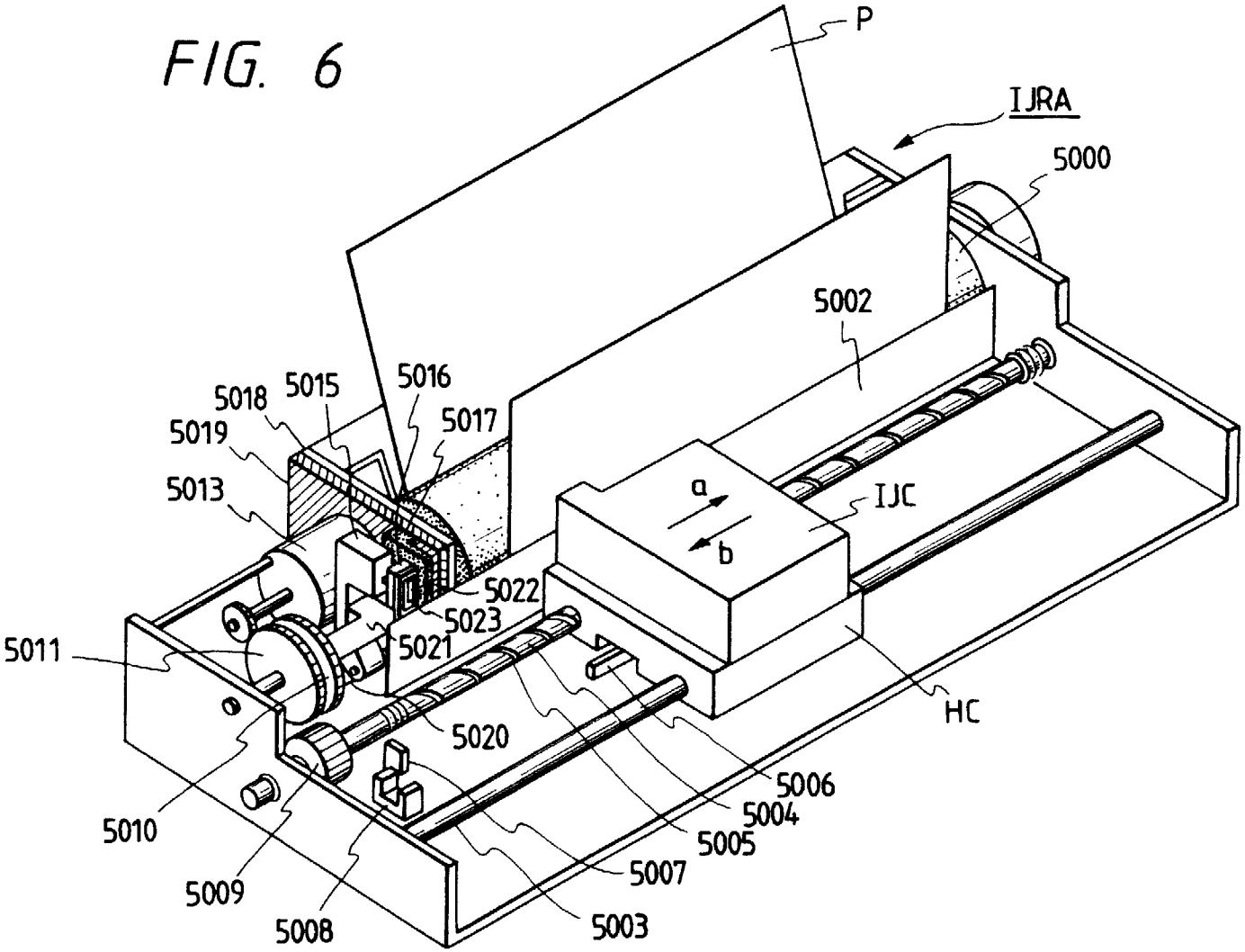
FIG. 6 is a perspective view showing an outer appearance of an apparatus suitable for the present invention.

FIG. 6 is a schematic perspective view of the ink-jet recording apparatus main body IJRA on which the above-mentioned cartridge is mounted. The carriage HC which is engaged with a spiral groove 5004 of a lead screw 5005 rotated through driving force transmission gears 5011 and 5009 in cooperation with a forward/reverse rotation of a driving motor 5013 has pins (not shown), and is reciprocally moved in directions of arrows a and b. A sheet pressing plate 5002 presses a sheet against the platen roller 5000 along the carriage moving direction. Photocouplers 5007 and 5008 serve as home position detection means for detecting the presence of a lever 5006 of the carriage HC in a corresponding region to switch, e.g., a rotational direction of the motor 5013. A member 5016 supports a cap member 5022 for capping the front surface of the recording head. A suction means 5015 draws the interior of this cap member by vacuum suction, i.e., performs a suction/recovery operation of the recording head through an opening 5023 in the cap member. A cleaning blade 5017 and a member 5019 for allowing the blade 5017 to be movable in the back-and-forth direction are supported on a main body support plate 5018. The blade is not limited to that of this embodiment, but a known cleaning blade may be applied to this embodiment, as a matter of course. A lever 5021 is used to start the suction/recovery operation, and is moved upon movement of a cam 5020 which is engaged with the carriage HC. The lever 5021 is subjected to movement control by a known transmission means such as a clutch for switching a driving force from the driving motor.

These capping, cleaning, and suction/recovery operations can be performed at their corresponding positions upon operation of the lead screw 5005 when the carriage HC reaches the home position region. However, any other means may be applied to this embodiment as long as desired operations are performed at known timings. The respective arrangements described above are excellent inventions not only solely but also systematically, and are preferable ones to apply the present invention.

The present invention which can be applied to the arrangements shown in FIGS. 2 to 6 will be described below with reference to FIG. 1, FIG. 7, and subsequent drawings.

Figure 1:
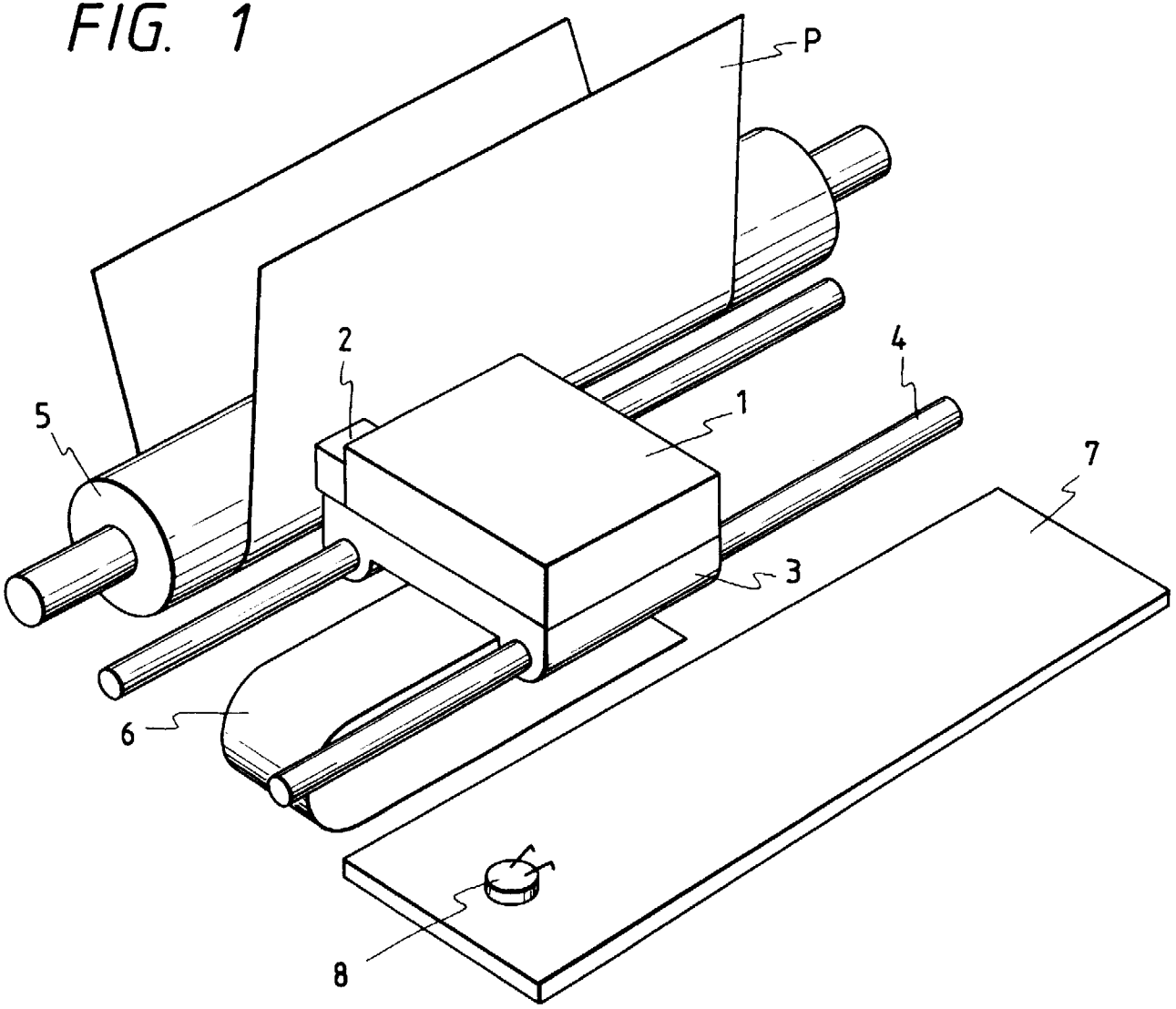
FIG. 1 is a schematic perspective view of an arrangement suitable for the present invention.
Figure 7:
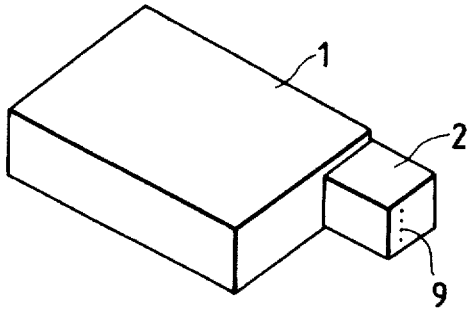
FIG. 7 is a perspective view of a recording head.
Figure 15:
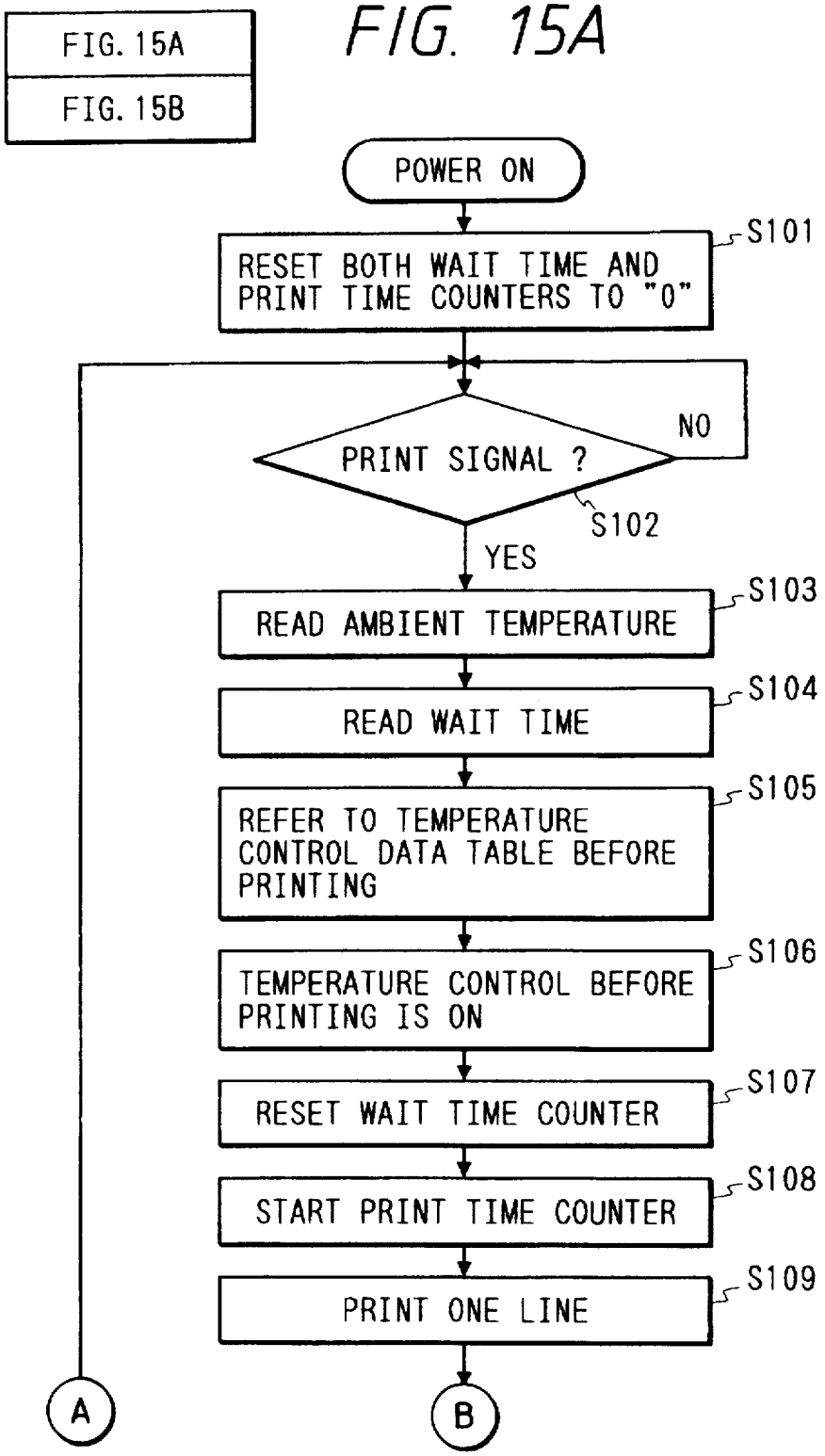
Figure 15B:
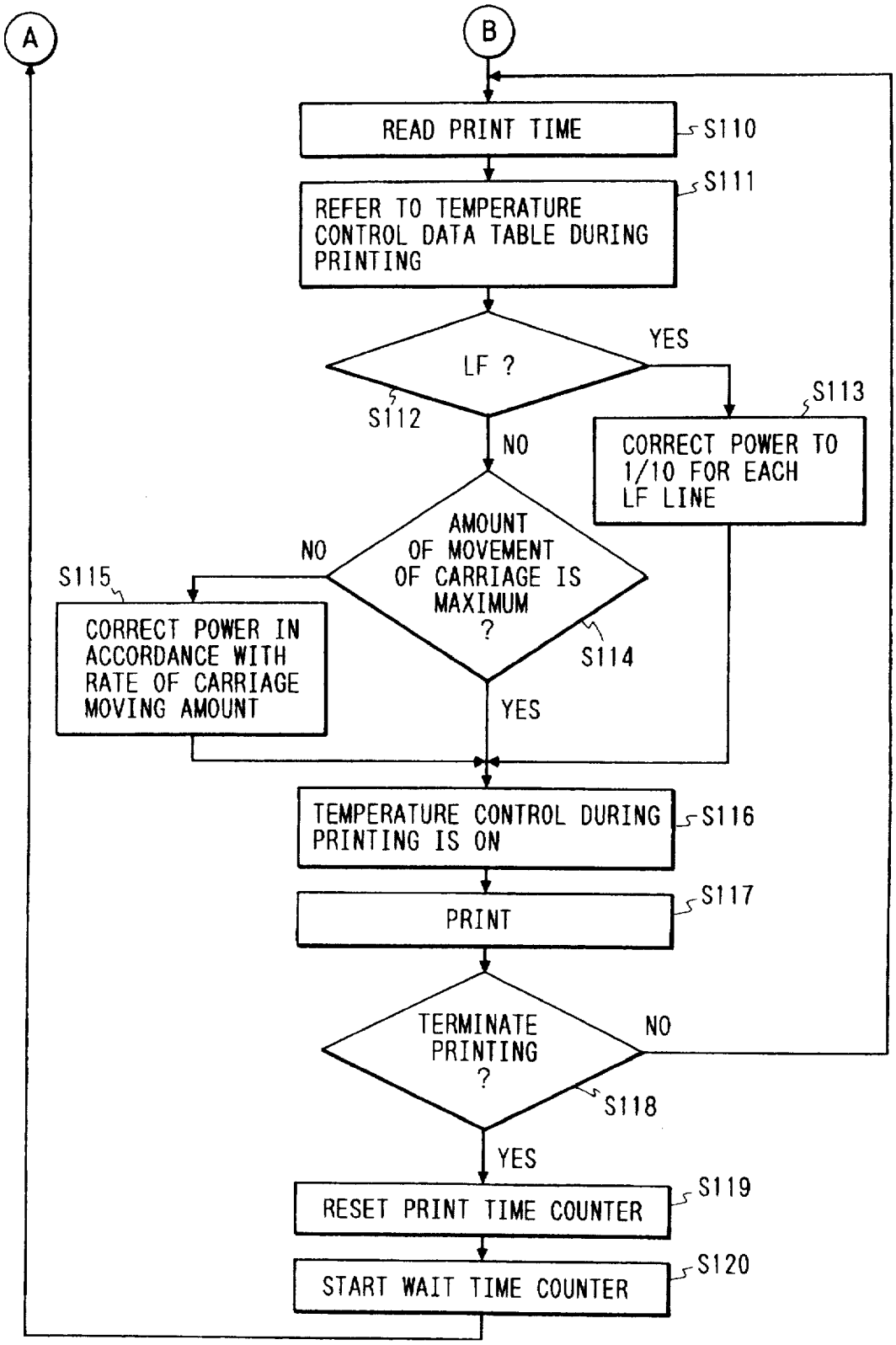

FIGS. 1, 7, and 15, and Tables 1 and 2 show the first embodiment of the present invention. In FIG. 1, a recording head 2 (IJH) is coupled to an ink tank 1 (IT). As shown in FIG. 7, the ink tank 1 and the recording head 2 form an integrated disposable cartridge. A carriage 3 (HC) is used to mount the cartridge on the printer main body. A guide 4 scans the carriage in a sub-scanning direction. A flexible cable 6 supplies a driving signal pulse current and a head temperature control current to the recording head 2. A printed circuit board 7 comprises an electrical circuit for controlling the printer. A sensor 8 measures an ambient temperature in the printer. FIG. 7 shows the disposable cartridge. In FIG. 7, a nozzle portion 9 discharges ink droplets.

Figure 8:
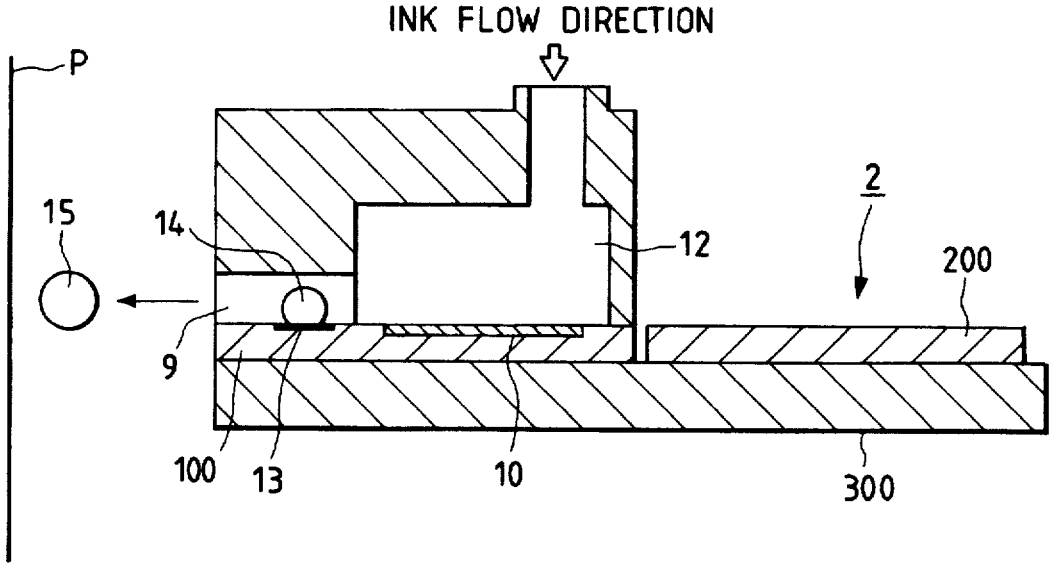
FIG. 8 is a sectional view showing in detail FIG. 7.
Figure 9:
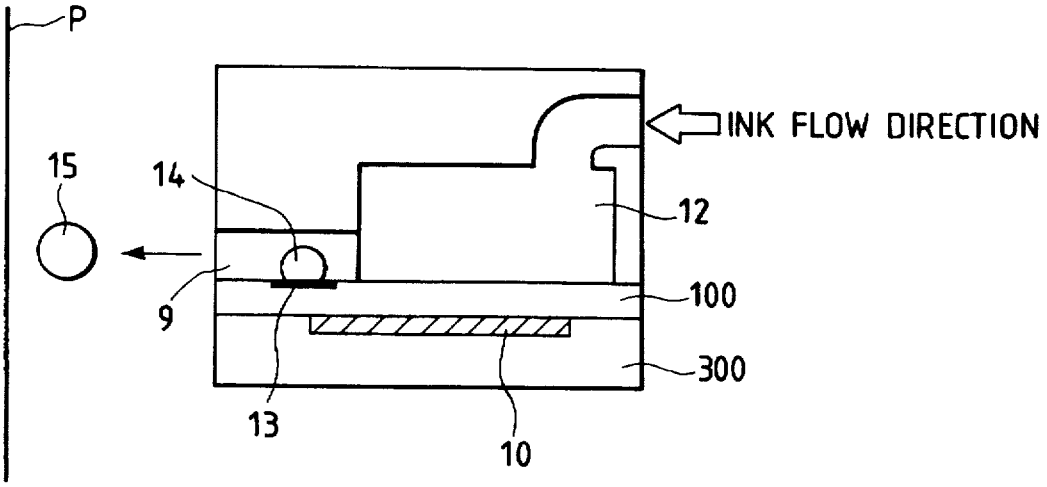
FIG. 9 is a sectional view showing another arrangement of the recording head.

FIG. 8 shows the recording head 2 in detail. The heater board 100 formed by a semiconductor manufacturing process is arranged on the upper surface of the support member 300. The heater board 100 comprises a temperature control heater (temperature increase heater) 10 for keeping and controlling the temperature of the recording head 2. The wiring circuit board 200 is arranged on the support member 300. The wiring circuit board 200, the temperature control heater 10, and a discharge heater 13 are electrically connected by, e.g., wire-bonding (wirings are not shown). The temperature control heater 10 may be formed by adhering a heater member, which is formed in a process different from that for the heater board 100, to, e.g., the support member 300, as shown in FIG. 9.

A bubble 14 is formed upon heating of the discharge heater 13. The bubble 14 is then discharged as an ink droplet 15. A common ink chamber 12 supplies ink to be discharged from the recording head.

Open-loop temperature control according to the first embodiment will be briefly described below.

In this embodiment, in order to control the temperature of the recording head to a target temperature determined by concerning discharge characteristics, e.g., a print density, temperature control before printing and temperature control during printing are performed. In the temperature control before printing, a heating amount of the temperature control heater is determined on the basis of a lapse of time from the previous printing operation (wait time and non-print time) and the present ambient temperature, and heating is performed immediately before printing. In the temperature control during printing, the heating amount is determined on the basis of the lapse of time from the previous printing operation and the present ambient temperature, and heating is performed during printing. "During printing" means not only an instance when printing is actually performed (a heating period of a print heater), but also a series of operation periods for performing printing, e.g., an acceleration or deceleration period of the carriage, and a reverse period in a bidirectional print mode.

TABLE 1

| Temperature Control Data Table Before Printing | | | | |
|---|---|---|---|---|
| | Ambient Temperature | | | |
| 25° C. | 25 | 21 | 17 | 13° C. |

| Wait Time | or higher | to 21° C. | to 17° C. | to 13° C. | or higher |
|---|---|---|---|---|---|
| 0 or 120 sec or more | 0% | 40% | 60% | 80% | 100% |
| 60 to 120 sec | 0% | 10% | 40% | 60% | 80% |
| 30 to 60 sec | 0% | 0% | 20% | 40% | 60% |
| 15 to 30 sec | 0% | 0% | 0% | 20% | 40% |
| 15 sec or less | 0% | 0% | 0% | 0% | 20% |

TABLE 2

Temperature Control Data Table During Printing

| | Ambient Temperature | | | | |
|---|---|---|---|---|---|
| Print Time | 25° C. or higher | 25 to 21° C. | 21 to 17° C. | 17 to 13° C. | 13° C. or higher |
| 0 to 60 sec | 0% | 60% | 80% | 90% | 100% |
| 60 to 360 sec | 0% | 30% | 40% | 45% | 50% |
| 360 sec or more | 0% | 20% | 30% | 3% | 40% |

Tables 1 and 2 show control parameter data tables used used the temperature control operations before and during printing are performed, and these tables are stored in a ROM. In each table, "100%" represents supply of a maximum energy, and "0%" represents supply of no energy. In this embodiment, an energy supply amount is controlled according to an energization time (heating pulse width) to the temperature control heater. In the temperature control before printing, a maximum energization time is set to be about 6 sec, and in the temperature control during printing, it is set to be about 120 msec. Note that the energy supply amount may be controlled by an energization voltage in place of the energization time, or may be controlled by both the energization time and voltage.

In either of the temperature control operations before and during printing, as an ambient temperature is lower, the energy supply amount is increased to increase a temperature increase amount, so that the head temperature is closer to the target temperature. In the temperature control before printing, since it can be considered that the recording head radiates more heat as a wait time is longer, the energy supply amount is set to be large to cause the head temperature to approach the target temperature, On the other hand, in the temperature control during printing, since it can be considered that the temperature of the head is increased due to heat accumulation as a print time is longer, the energy supply amount is set to be small.

When the temperature control is performed as described above, the temperature of the recording head can be controlled to the target temperature without using conventional closed-loop control. This temperature control will be described in detail below.

Figure 10:
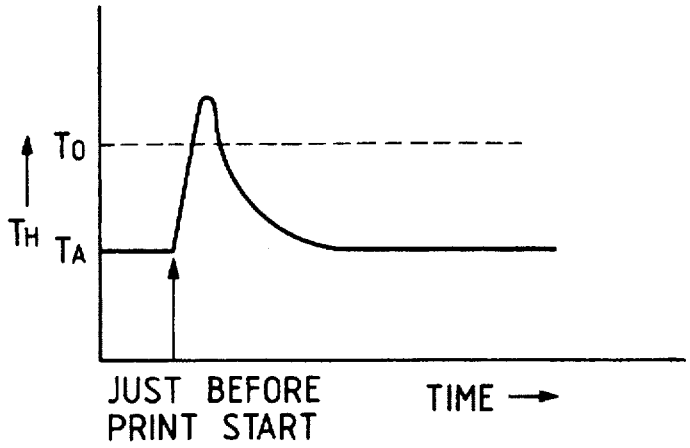
FIG. 10 is a graph showing a change in temperature of the recording head obtained when temperature control before printing is performed.
Figure 11:
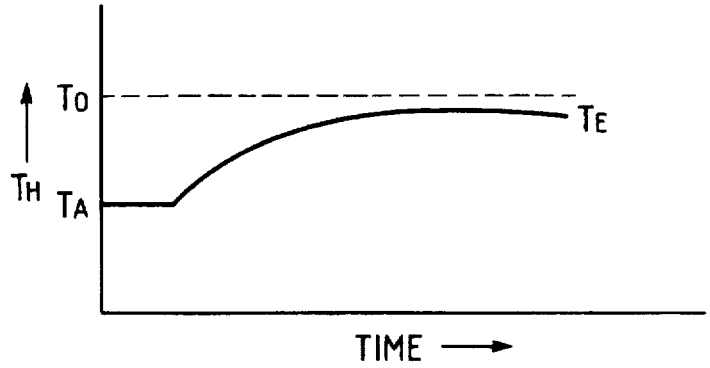
FIGS. 11 and 17 are graphs showing a change in temperature of the recording head obtained when only temperature control during printing is performed.
Figure 12:
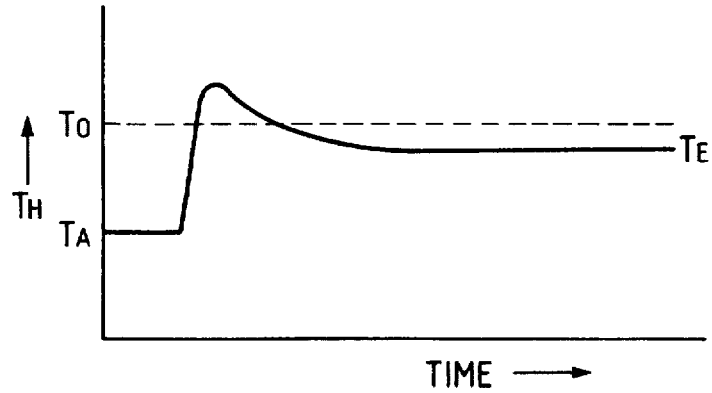
FIGS. 12 and 18 are graphs showing a change in temperature control of the recording head obtained when only temperature control before printing and temperature control during printing are performed.

FIG. 10 shows a change in actual temperature ($T_H$) of the recording head with respect to an ambient temperature ($T_A$) and a target temperature ($T_O$) when only the temperature control before printing is performed. FIG. 11 similarly shows a change in temperature of the recording head when only the temperature control during printing is performed, and FIG. 12 shows a change in temperature of the recording head when both the temperature control operations before and during printing are performed.

Figure 13:
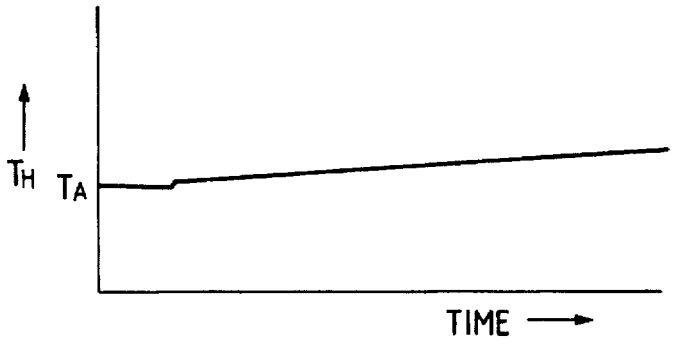
FIG. 13 is a graph showing a change in temperature of the recording head obtained when no temperature control is performed.

FIG. 13 shows a change in temperature of the recording head caused solely by printing (self temperature increase) without the temperature control.

Figure 14:
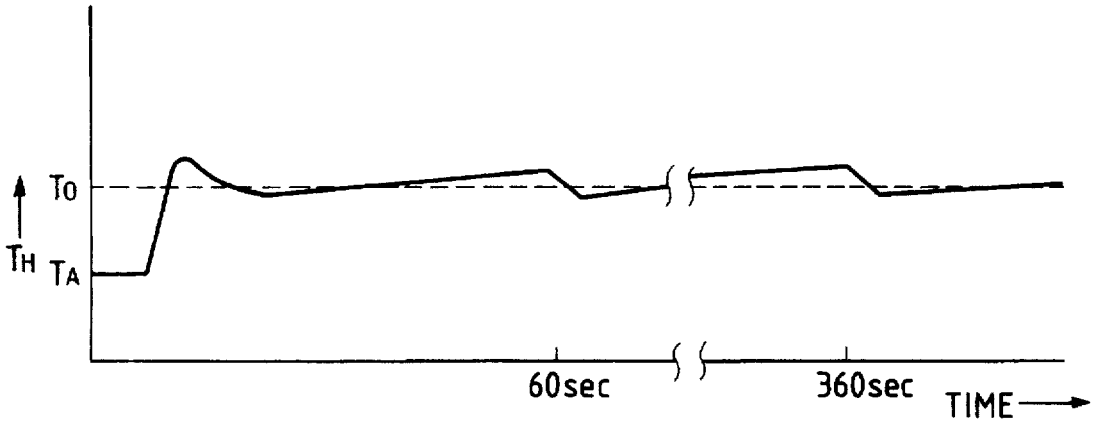
FIG. 14 is a graph showing a change in temperature of the recording head obtained when a print operation is performed according to the first embodiment.

FIG. 14 shows a change in temperature of the recording head when printing is performed with the temperature control operations before and during printing.

The temperature ($T_H$) of the recording head is switched at positions of 60 sec and 360 sec since the data in the temperature control data table during printing shown in Table 2 (temperature control parameter) is changed.

A thermal equilibrated temperature ($T_E$) shown in FIGS. 11 and 12 means a temperature which can be naturally reached by only a temperature control energy on the basis of a heat capacity of the head, and is determined by data shown in Tables 1 and 2. The thermal equilibrated temperature is set to be slightly lower than the target temperature, so that the sum of the thermal equilibrated temperature and a temperature increase (self temperature increase) caused by self heating of the recording head shown in FIG. 13 corresponds to the target temperature.

The temperature control according to the first embodiment of the present invention will be described below with reference to the flow chart shown in FIG. 15. Note that a change in temperature of the recording head caused by this temperature control corresponds to FIG. 14.

When the power switch is turned on, a wait time counter and a print time counter are reset to zero to initialize the control parameters in step S101. In step S102, the control waits until a print signal is input.

When the print signal is input, an ambient temperature is read from the temperature sensor 8 on the printed circuit board 7 of the main body in step S103. In step S104, a wait time of the wait time counter is read. However, the wait time counter is reset to "0" as described above immediately after power-on. In step S105, the temperature control data table before printing (Table 1) is referred to on the basis of the ambient temperature and the wait time of the wait time counter. Immediately after power-on, since there is no temperature increase due to printing, the temperature of the recording head is equal to the room temperature. For this reason, a table output becomes one of 0% to 100% according to the ambient temperature, and is larger than those obtained in correspondence with other wait times. In step S106, the temperature control heater 10 shown in FIG. 8 is heated on the basis of this output data to increase the temperature of the nozzle portion 9 and the common ink chamber 12. In this embodiment, as the ambient temperature is lower, the table output is increased to increase a temperature increase amount.

Upon completion of energization, the start of printing may be waited for about 1 sec to disperse an abrupt temperature distribution formed in the recording head. At that time, the wait time counter is reset (step S107).

In step S108, the print time counter is started to print the first line (step S109).

Thereafter, in step S110, the print time of the print time counter is read. In step S111, the temperature control data table during printing (Table 2) is referred to on the basis of the read print time and the ambient temperature. The count value of the print time counter is not so incremented immediately after the start of printing, either. For this reason, the table output becomes one of 0% to 100% according to the ambient temperature, and is larger than those obtained in correspondence with other count values.

Temperature control conditions of the data are corrected according to the content of the print signal. When a line feed (LF) signal is input, correction is performed (steps S112 and S113). Since the line feed operation has no temperature increase due to printing itself, if the LF signals are successively input, the temperature of the recording head is immediately decreased if no temperature control is performed. Since a time required for the line feed operation is very short, an energy supply amount per unit time becomes too large unless the output data is corrected.

For this reason, according to this embodiment, a program for correcting a parameter to supply an energy 1/10 original output data to the recording head per one-line feed operation is employed.

The temperature control conditions are then corrected on the basis of a length of one main scanning line (steps S114 and S115). In this embodiment, the temperature control heater 10 is energized during carriage acceleration periods on two sides outside a print range. For this reason, when a carriage moving amount is small, an energy supply amount per unit time becomes too large. When the carriage mounting amount does not correspond to a full width, a problem for multiplying a correction coefficient proportional to an actual moving amount corresponding to the full width with the parameter is employed.

The temperature control heater 10 is energized on the basis of these corrected data to perform temperature control during printing (step S116), and another line is then printed (step S117). When the print operation further continues (step S118), the value of the print time counter is repetitively read. As described above, as the print time is increased, the output data from the table is decreased. Thus, the energy supply amount is decreased.

When the print operation is completed, the print time counter is reset (step S119), and the wait time counter is started (step S120) to measure a time until the next print signal is input.

When the next print signal is input, the contents of the wait time counter and the ambient temperature are read (steps S102 to S104), and an energy level output from the temperature control data table before printing is determined again on the basis of the read wait time and the ambient temperature. Thereafter, the same control operations as described above are repeated. In this embodiment, the wait time counter counts up to 120 sec, and when it exceeds 120 sec, the counter is reset to 0 under the assumption that the temperature is returned to the ambient temperature.

In this embodiment, the disposable cartridge type recording head is used. The present invention is not limited to the disposable cartridge type, but may be effective when it is applied to a permanent type head which does not require exchange of heads.

In this embodiment, both the print time counter and the wait (non-print) time counter are used to perform both the temperature control operations during and before printing. However, as for a printer having a small print amount such as a printer for an electronic calculator, or a printer for outputting only characters, in which a temperature increase caused by the print operation itself is smaller than that caused by a graphic printer, only the wait (non-print) time counter may be employed depending on an output quality level of the recording apparatus to perform only the temperature control before printing. As for a printer exclusively used for cut sheets or a recording apparatus having a long non-print time, only the print time counter may be employed to perform only the temperature control during printing.

In order to determine an output energy level in temperature control, a hysteresis of output data obtained before printing may be used in addition to output data obtained by referring to the data table on the basis of the count values (wait time and print time) upon printing. When a correction coefficient of output data is to be calculated on the basis of a carriage moving amount, not only a moving amount of the present line but also moving amounts of the next and subsequent lines may be taken into consideration.

As a means for heating the recording head, a known means may be used. In place of measuring the print time, the number of print lines or the number of print characters may be counted.

As described above, according to the first embodiment, if conventional closed-loop temperature control by the temperature sensor incorporated in the recording head is not performed, a means for measuring an ambient temperature is arranged in a recording apparatus main body such as a printer, and a control software program utilizing heating/cooling thermal characteristics uniquely determined by a heat capacity of the recording head itself is employed, so that the temperature of the recording head can be controlled to a desired temperature.

In particular, when the disposable cartridge type recording head is used, a signal current from the temperature sensor of the recording head need not be detected. Thus, a variation in print performance among heads, as a major drawback of temperature control posed when the disposable type is employed, can be eliminated. Thus, a variation in print performance among heads can be eliminated, and uniform print quality can be obtained. Furthermore, since the temperature sensor can be omitted from the cartridge of the recording head as an expendable supply, a temperature sensor selection process, or a temperature sensor adjustment process so far can be omitted to greatly reduce cost. In addition, since the temperature sensor itself can be omitted, a manufacturing yield can be greatly increased to further reduce cost.

In view of an electrical circuit, a small signal current from the head need not be detected, and a countermeasure against exposure of contacts upon attachment/detachment of the disposable cartridge from the recording apparatus main body, and an electrostatic countermeasure for patterns of a flexible wiring and a printed circuit board between the recording apparatus main body and the recording head can be simplified.

The above features are particularly effective for a compact or portable recording apparatus which cannot take a sufficient countermeasure such as a shield on the casing or an electrical circuit. In addition, this also leads to a considerable cost-down effect.

The second embodiment of the present invention will be described below with reference to FIGS. 17 to 21 and Tables 3 and 4.

In the second embodiment, sufficient temperature control attained by developing open-loop control of the first embodiment can be performed even in a recording method such as a bubble-jet method in which heat generation or radiation occurs upon printing.

In the first embodiment, an energy level to be applied to the recording head for attaining a temperature increase is determined with reference to control data tables on the basis of an ambient temperature and a print time and a non-print time of the recording head before the present print operation is started, so that temperature control can be realized by open-loop control by using only an adjusted temperature sensor of a main body.

In a printer for mainly printing characters, since a print rate of a character itself is low, an average print rate is about several % to 30%. Therefore, a temperature can be sufficiently anticipated by open-loop temperature control on the basis of data anticipated by the main body according to operation control parameters such as a print time and a non-print time which can be easily measured by the printer like in the first embodiment, and a temperature control energy supply amount can be adjusted.

Figure 16:
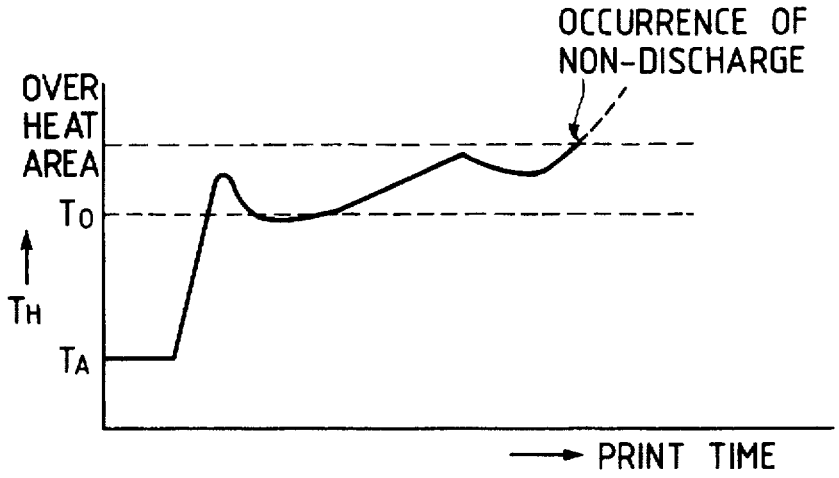
FIG. 16 is a graph showing an over heat state of the recording head.

However, in a printer for mainly printing graphic data at high speed, since an average print rate is largely changed between several % to 100%, an over heat state tends to occur, as shown in FIG. 16, by only operation control parameters such as a print time and a non-print time when a temperature control energy and a heat generation energy caused by a discharge operation at a high print rate overlap each other. For this reason, irregular discharge problems such as a non-discharge state, splash, a fixing error caused by an excessive discharge amount, density nonuniformity, and the like are posed, and a graphic printer which is required to have high print quality becomes unsatisfactory.

In order to prevent an overheat state caused by a high print rate, a thermal equilibrated temperature may be set to be lower than that of a character printer under an assumption of a high average print rate. At this time, when a print pattern having a low print rate is to be printed, since a self temperature increase is small in the above-mentioned open-loop temperature control during printing, the actual temperature of the recording head is shifted to a lower temperature, and low density or density nonuniformity occurs. Thus, only an unsatisfactory print result is obtained by a high-speed graphic printer.

During a print operation of a graphic pattern having a high print rate, when a temperature at the end of the first page becomes very high, and in particular, when the print operation of the page is completed immediately before the temperature reaches an over heat temperature, a cooling operation requires more time than that at an assumed average print rate. For this reason, in the open-loop temperature control before printing, a temperature increase energy excessively larger than that required for the next print operation may be undesirably supplied.

Open-loop temperature control according to the second embodiment will be briefly described below.

In this embodiment, temperature control operations before and during printing are performed like in the first embodiment. At this time, according to a characteristic feature of this embodiment, a temperature of the recording head is anticipated upon completion of the previous print operation, and a temperature control power before printing is corrected on the basis of the anticipated temperature. Furthermore, according to another characteristic feature of this embodiment, a print rate is obtained every second, and a temperature control power during printing is corrected on the basis of an average print rate. When the above-mentioned power correction operations are performed, open-loop temperature control can be appropriately performed in a graphic printer which must print a pattern having a high print rate.

Tables 3 to 5 respectively show temperature control data tables before and during printing, and a print rate correction control parameter data table. Tables 3 and 4 correspond to Tables 1 and 2 of the first embodiment, respectively.

TABLE 3

Temperature Control Data Table Before Printing

| | Ambient Temperature | | | | |
|---|---|---|---|---|---|
| Wait Time Timer | 25° C. or higher | 25 to 21° C. | 21 to 17° C. | 17 to 13° C. | 13° C. or higher |
| 0 or 120 sec or more | 0% | 40% | 60% | 80% | 100% |
| 60 to 120 sec | 0% | 10% | 40% | 60% | 80% |
| 30 to 60 sec | 0% | 0% | 20% | 40% | 60% |
| 15 to 30 sec | 0% | 0% | 0% | 20% | 40% |
| 15 sec or less | 0% | 0% | 0% | 0% | 20% |

TABLE 4

Temperature Control Data Table During Printing

| | Ambient Temperature | | | | |
|---|---|---|---|---|---|
| | 25° C. or higher | 25 to 21° C. | 21 to 17° C. | 17 to 13° C. | 13° C. or higher |
| Initial Operation Amount $P_{LINEO}$ of Temperature Control During Printing | 0% | 60% | 80% | 90% | 100% |

TABLE 5

Duty Correction Data Table

| Duty | 0% or more | 6.25% or more | 12.5% or more | 25% or more | 50% or more |
|---|---|---|---|---|---|
| Correction Coefficient | 100% | 87.5% | 75% | 50% | 0% |

Figure 17:
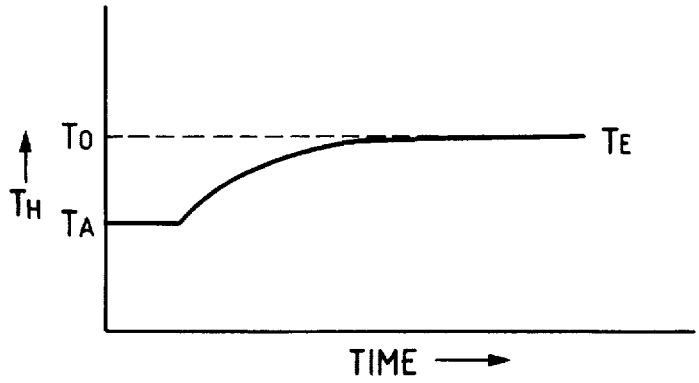
Figure 18:
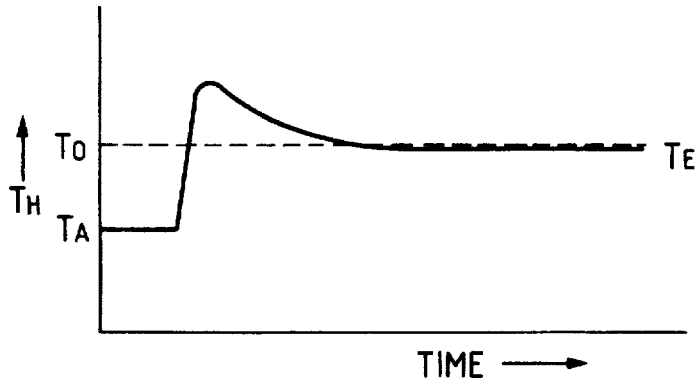

FIG. 17 shows a change in actual temperature of the recording head with respect to an ambient temperature and a target temperature when only temperature control during printing (without correction) is performed. Note that a change in temperature of the recording head obtained when only the temperature control before printing (without correction) is performed is the same as that shown in FIG. 10, and is omitted. FIG. 18 similarly shows a change in temperature of the recording head when both the temperature control operations before and during printing (without correction) are performed.

Figures 19A, 19B, 19C:
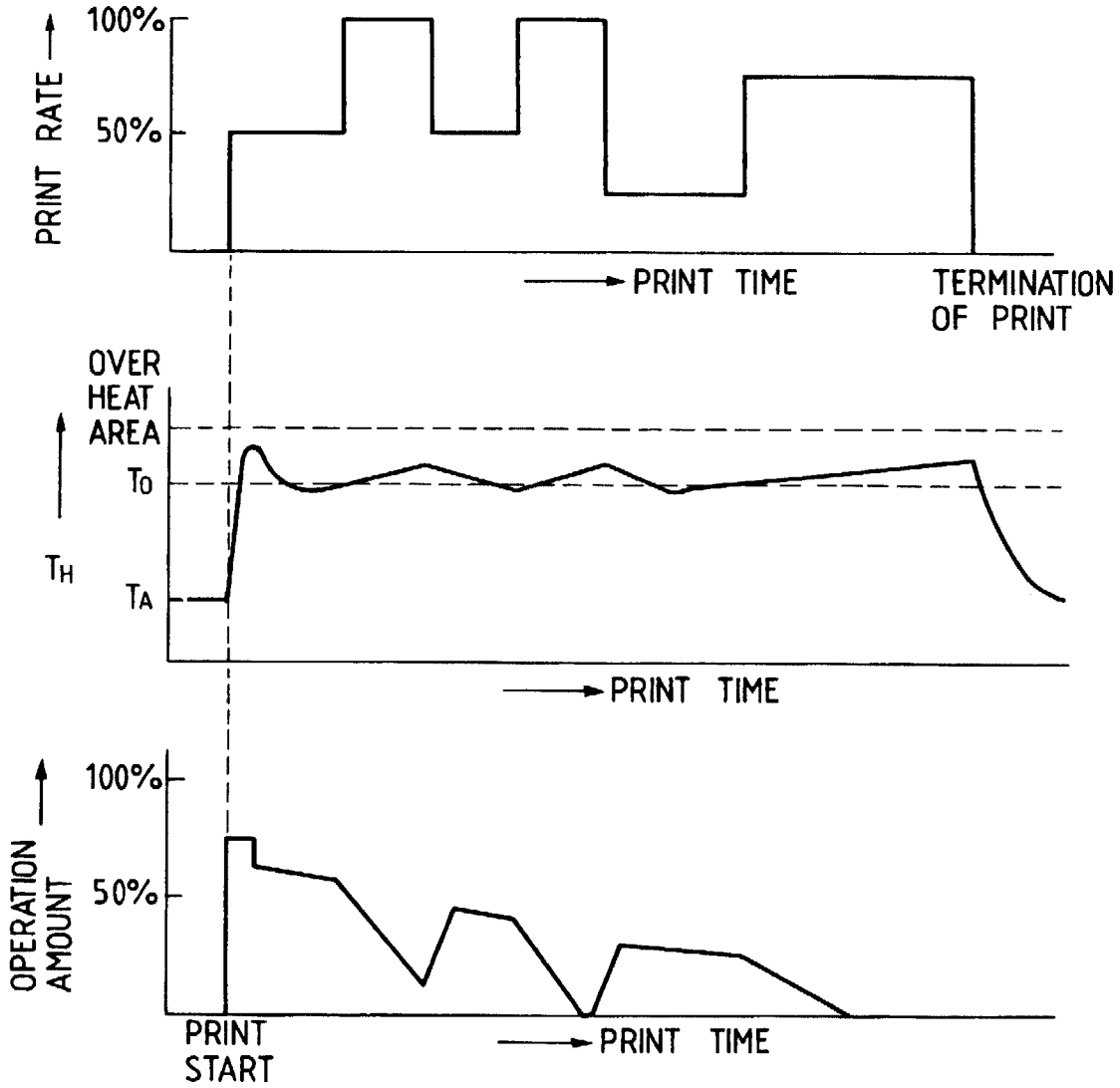
FIGS. 19A to 19C are graphs showing a change in temperature of the recording head obtained when printing is performed according to the second embodiment of the present invention.

FIG. 19A shows a change in print rate, FIG. 19B shows a change in temperature of the recording head in correspondence with a change in print rate shown in FIG. 19A when the temperature control operations before and during printing according to the second embodiment of the present invention are performed, and FIG. 19C shows a change in operation amount of a temperature control energy.

A thermal equilibrated temperature shown in FIGS. 17 and 18 is set to be higher than those shown in FIGS. 11 and 12. The first embodiment takes self heating of the recording head into consideration when the thermal equilibrated temperature is set. In this embodiment, however, since a self heating portion is corrected in the temperature control during printing, the self heating portion need not be taken into consideration when the thermal equilibrated temperature is set.

For this reason, an energy supply amount of the temperature control during printing according to this embodiment is slightly larger than that in the first embodiment.

Temperature control according to the second embodiment of the present invention will be described below with reference to the flow chart shown in FIG. 20. Note that a change in temperature of the recording head by this temperature control corresponds to FIG. 19.

When the power switch is turned on, a wait time counter, a print time counter, a print pulse counter, a correction coefficient memory, and the like are reset to "0" (step S201) to initialize control parameters. The control then waits until a print signal is input (step S202).

When the print signal is input, an ambient temperature T obtained by the temperature sensor 8 on the printed circuit board 7 of the main body is read (step S203). An anticipated temperature $T_{FINI}$ upon completion of the previous print operation (to be described in detail later) is then read (step S204). A wait time tw is then read from the wait time (step S205). At this time, the counter is reset to "0" as described above. The temperature control data tables before and during printing (Tables 3 and 4) are referred to on the basis of the wait time tw and the ambient temperature (step S206). At this time, since there is no temperature increase caused by the print operation and an ambient temperature is the same as the room temperature, output data as a determination value of the temperature control power $P_{preo}$ table before printing becomes one of 0 to 100% according to the ambient temperature, and has a larger value than those obtained in correspondence with other wait times (step S206).

On the basis of this output data, a temperature control operation amount $P_{pre}$ before printing=$P_{preo} \times f(TFINI)$ is calculated (step S207). The function f has a negative correlation with the anticipated temperature $T_{FINI}$ upon completion of the previous print operation. The temperature control heater 10 shown in FIG. 9 is heated on the basis of the calculated operation amount $P_{pre}$, and the temperatures of the nozzle portion 9 and the common ink chamber 12 of the recording head 2 are increased (step S208). In this embodiment, an energization time is prolonged as a temperature becomes lower. After completion of energization, a print start timing is waited for about 1 sec to disperse an abrupt temperature distribution formed in the recording head. At that time, the wait time counter is reset (step S209), and the print time counter is started (step S210).

Temperature control conditions of the initial operation amount $P_{LINEO}$ during printing obtained in step S206 are then corrected according to the content of the print signal. The temperature control conditions are corrected according to the length of one sub-scanning line. Like in steps S114 and S115 (FIG. 15) in the first embodiment, a power correction coefficient L for multiplying a correction coefficient proportional to a ratio of an actual moving amount to the full width of the carriage is calculated (step S211).

Discharge pulses for one second (number of print dots) of the next print content to be printed are counted to calculate an average print rate (print duty) (step S212).

Power correction coefficients $P_1$ and $P_2$ are calculated on the basis of the average print rate for every second (step S213). In this case, the power correction coefficient $P_1$ is a low-response correction coefficient, and is based on an average of average print rates for every second during the previous 100 seconds. The power correction coefficient $P_2$ is a high-response correction coefficient, and is based on an average of average print rates for every second during the previous 10 seconds. These correction coefficients $P_1$ and $P_2$ can be obtained by referring to the data table (Table 5) on the basis of the average print rate.

A temperature control operation amount $P_{LINE}$ during printing is calculated on the basis of the obtained data.

In this embodiment, $P_{LINE}=P_{LINEO} \times P_1 \times P_2 \times L$ (step S214).

As described above, $P_{LINEO}$ represents the temperature control initial operation amount during printing, and the correction coefficient L is one based on the carriage moving amount. The correction coefficient is normalized to a range between 0 to 1 (0% to 100%). As can be apparent from the above equation, when the low- or high-response average print rate is high, and its correction coefficient $P_1$ or $P_2$ is small, the temperature control operation amount $P_{LINE}$ during printing becomes small. Therefore, an over heat state by the temperature control during printing can be prevented.

For this reason, a program for correcting a parameter to supply an energy 1/10 the original operation amount $P_{LINE}$ during printing to the recording head 2 per one-line feed operation is employed (step S216).

The temperature control heater 10 is energized on the basis of these corrected data (step S217) to print one line (step S218). The wait time counter is then started (step S219), and the anticipated temperature $T_{FINI}$ upon completion of printing is stored (step S220). The anticipated temperature $T_{FINI}$ upon completion of printing is calculated by the following equation based on a parameter of the power correction coefficient $P_1$ (low response):

$T_{FINI}$=Target Temperature$\times k(0.3+P_1)$ (where k is an appropriate coefficient)

When $(0.3+P_1)<1$, $T_{FINI}$=target temperature is set. As a result, when the low-response power correction coefficient exceeds 0.7, this means that a print operation at a high print rate continues for a long period of time, and there is a high possibility that the head temperature exceeds the target temperature. For this reason, an error of the temperature control power $P_{preo}$ before printing calculated based on the wait time at the beginning of the next print operation can be prevented.

Figures 20, 20A:
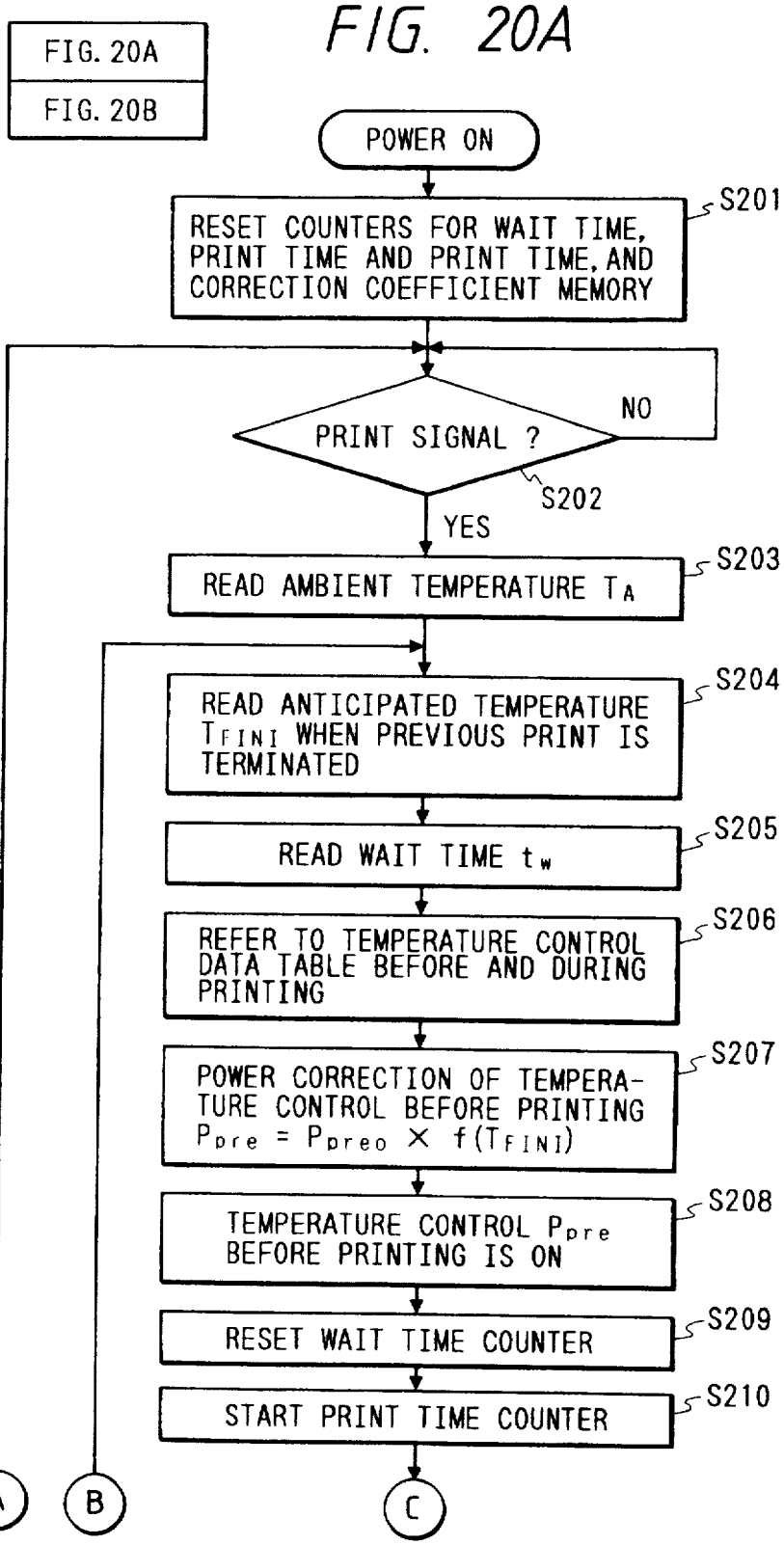
FIGS. 20, 20A and 20B are flow charts showing temperature control according to the second embodiment of the present invention.
Figure 20B:
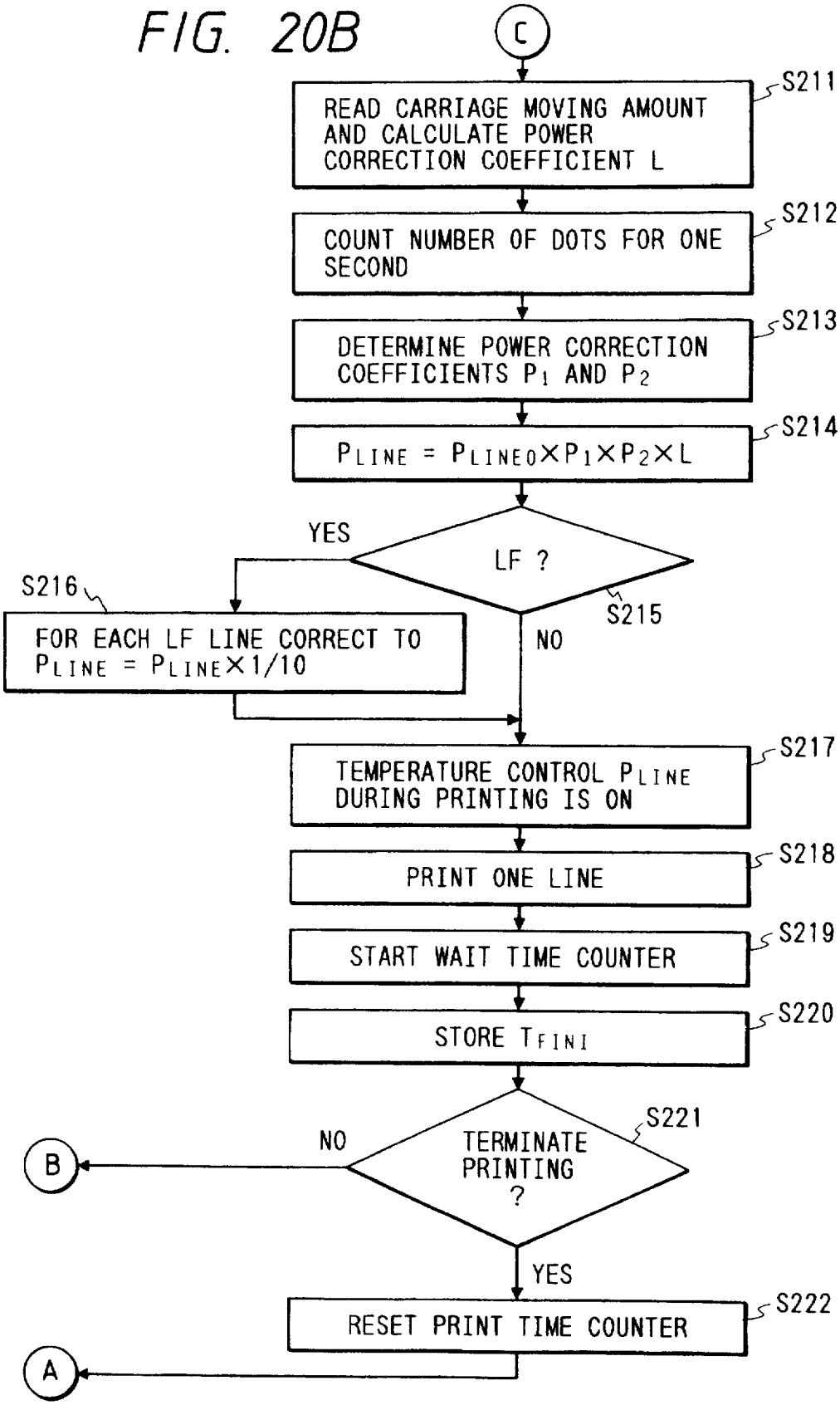

When the print operation continues, the control operations shown in FIG. 20 are repeated. In this case, since the value of the wait time counter is not so incremented, an output of 0% is obtained at any ambient temperature, and temperature control before printing can be prevented from being performed for each line. When the print operation is completed (step S221), the print time counter is reset (step S222), and the control operations shown in FIG. 20 are repeated when the next print signal is input.

In this embodiment, the wait time counter also counts up to 120 sec, and when it exceeds 120 sec, the counter is reset to 0 under the assumption that the temperature is returned to the ambient temperature.

Figure 21:
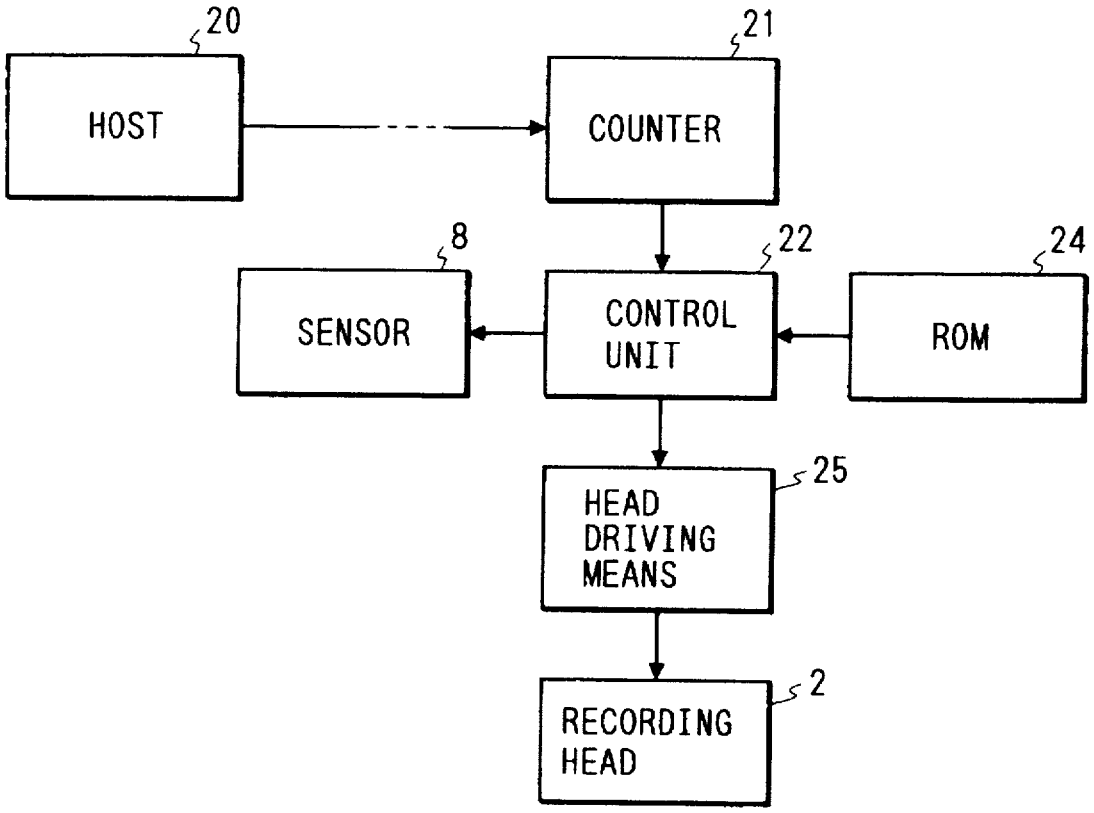
FIG. 21 is a block diagram showing a control arrangement suitable for the present invention.

FIG. 21 is a block diagram showing a control arrangement for executing temperature control according to the second embodiment. This arrangement can be applied to the first embodiment.

In FIG. 20, a host 21 such as a computer generates a command signal, a print signal, and the like. A counter 21 serves as a counting means consisting of the wait time counter, the print time counter, the print pulse counter, and the like. A sensor 8 serves as a temperature measurement means for measuring an ambient temperature. A head driving means 25 drives the recording head 2, and heats the head to increase its temperature. A control unit 22 as a temperature control means controls the print operation of a normal ink-jet recording apparatus according to a program stored in the ROM (read-only memory) 24. The control unit 22 adjusts a temperature control energy for attaining a temperature increase applied to the recording head 2 by the head driving means 25 on the basis of the measurement results of the sensor 23 and the counter 21.

In this embodiment, both the temperature control operations during and before printing are performed using both the print time counter and the wait (non-print) time counter. However, as for a printer exclusively used for cut sheets or a recording apparatus having a long non-print time, only the print time counter may be employed to execute only the temperature control during printing.

In place of measuring the print time, the number of print lines or the number of print-characters may be counted. An average print rate per second may be calculated as one for each line. The average rate may be calculated by other averaging methods, e.g., weighting.

A low-response print rate may be calculated as an average of average print rates for every 10 seconds during previous 100 seconds. In this embodiment, a common correction data table (Table 5) is used for low-and high-response data, but different tables may be prepared.

The temperature control operation amount $P_{pre}$ before printing may be corrected using the correction coefficients $P_1$ and $P_2$ in place of using the function $f(T_{FINE})$.

According to the second embodiment as described above, since a temperature control power is controlled according to a print rate, high-precision temperature control can be attained in a graphic printer having a large change in print rate in addition to the effects of the first embodiment.

Since a temperature control power is controlled on the basis of low- and high-response print rates, the control can cope with both slow and abrupt changes in print rate.

In the second embodiment, the temperature control power is controlled on the basis of the low- and high-response print rates, but may be controlled one of these parameters. Furthermore, a middle-response print rate may be calculated to control the temperature control power on the basis of the low-, middle-, and high-response print rates.

The third embodiment of the present invention will be described below with reference to FIGS. 22 to 26 and Table 6.

In the third embodiment, high-precision temperature control can be performed even when a position of a recording head is physically separated from a position of a temperature sensor for measuring an ambient temperature.

In the first embodiment of the present invention described previously, the temperature sensor for measuring an ambient temperature is arranged not on a recording head unit but on an apparatus main body on which the recording head unit is mounted, and an anticipated control method is adopted wherein a temperature of the recording head is anticipated on the basis of a thermal time constant determined based on a heat capacity of the recording head, a print time, and a non-print time to control a temperature control amount.

According to this method, since the recording head does not have a temperature sensor, cost of the recording head as an expendable supply can be greatly reduced, and this can provide a considerably large merit in, especially, a disposable cartridge in which the recording head and an ink tank are integrated.

In the first embodiment, however, since the position of the recording head is physically separated from the position of the temperature sensor for measuring an ambient temperature, a temperature detected by the temperature sensor cannot often indicate a correct temperature at the position of the recording head. When a power supply circuit is incorporated in the apparatus, a temperature in the machine is increased due to heat generated by the power supply circuit. In this case, an increase in temperature in the machine varies depending on positions in the machine. Since the temperature sensor and the recording head have quite different orders of thermal time constant, even if the ambient temperature sensor and the recording head have the same temperature in the machine, a small error occurs between the temperature at the position of the recording head and the ambient temperature of the ambient temperature sensor before a lapse of a given time after power-on although these temperatures are finally equal to each other after the lapse of the given time. For this reason, in the first embodiment, a temperature control parameter for anticipated control is often determined on the basis of the temperature data including an error. Even if the identical apparatus and the identical recording head are used, a print density of prints may often be varied.

Open-loop temperature control according to the third embodiment will be described below. In this control, a temperature control parameter determined by parameters such as an ambient temperature, a print time, a non-print time, and the like is corrected according to an energization time of the apparatus main body or components in the machine which generate heat, so that a local difference in temperature increase in the machine, or an error in an anticipated temperature of the recording head caused by a time difference due to a difference in thermal time constant are corrected, thus attaining precise temperature control.

Figure 22:
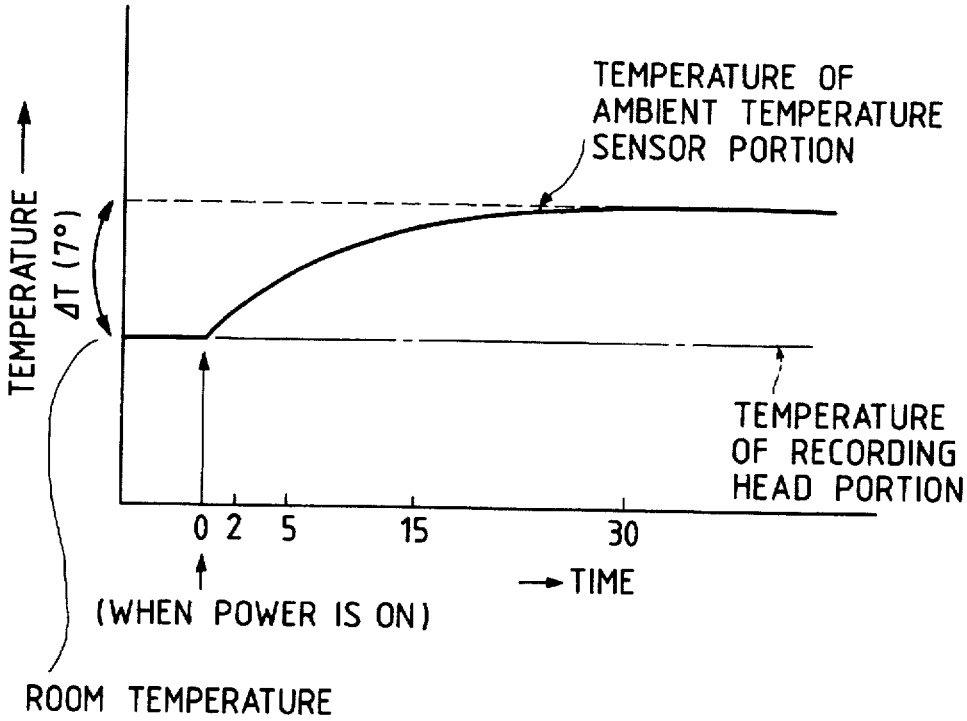
FIGS. 22, 23, and 25 are graphs showing a change in temperature in the machine near a temperature sensor, and a change in temperature of the recording head.

FIG. 22 shows a temperature increase in the machine near the temperature sensor for measuring an ambient temperature, and an actual temperature of the recording head at that time. FIG. 22 exemplifies data when a heat generation portion is separated from the recording head unit, and the recording head unit does not suffer from a temperature increase in the machine.

Figure 23:
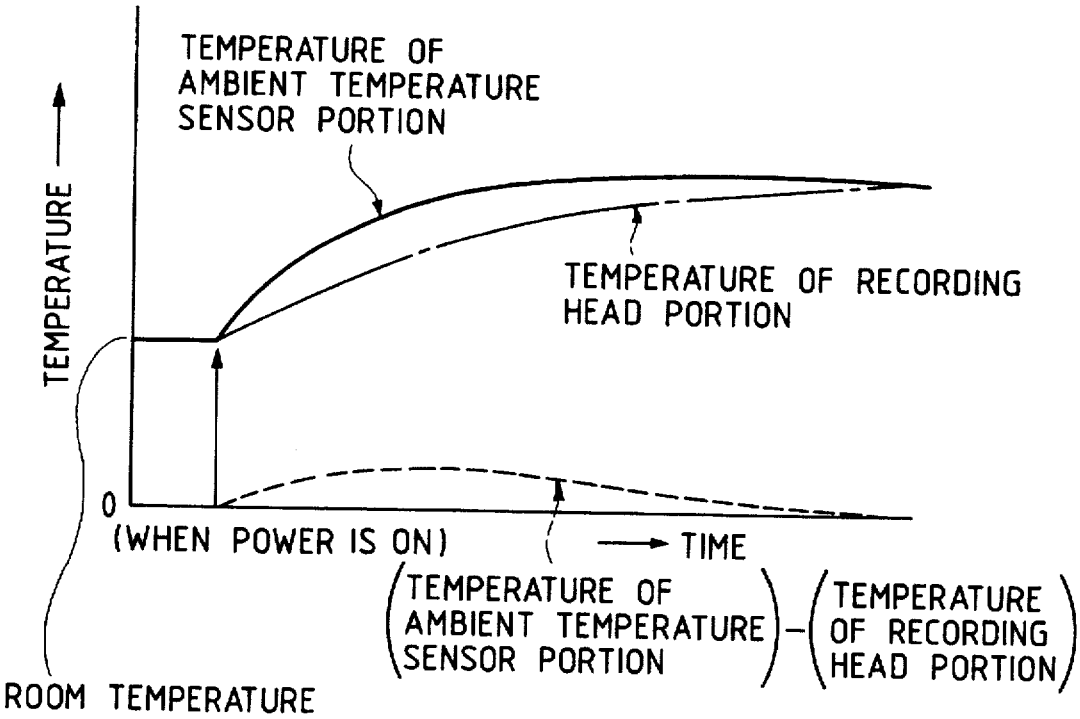

FIG. 23 shows an ambient temperature near the temperature sensor for measuring the ambient temperature, and an actual temperature of the recording heat at that time. FIG. 23 exemplifies data when the recording head unit suffers from a temperature increase in the machine.

Note that basic data of a change in actual temperature of the recording head with respect to the ambient temperature and the target temperature obtained when only the temperature control before printing is performed in a state wherein there is no temperature increase in the machine near the recording head is the same as that shown in FIG. 10, basic data similarly obtained when only the temperature control during printing is performed is the same as that shown in FIG. 11, and basic data obtained when the temperature control operations before and during printing are performed is the same as that shown in FIG. 12. In addition, a change in temperature of the recording head obtained when only printing is performed without temperature control is the same as that shown in FIG. 13.

Table 6 shows a correction table of a temperature increase in the machine in correspondence with FIG. 22. Note that above Tables 3 and 2 are used as temperature control data tables before and during printing.

TABLE 6

Correction Data Table for Temperature Increase in Machine

| Correction Timer for Temperature Increase in Machine | 0 to 2 min | 2 to 5 min | 5 to 15 min | 15 to 30 min | 30 min or more |
|---|---|---|---|---|---|
| Correction Value | 0° C. | −2° C. | −4° C. | −6° C. | −7° C. |

Temperature control according to the third embodiment of the present invention will be described below with reference to the flow chart shown in FIG. 24. Note that a change in temperature of the recording head caused by this temperature control is the same as that shown in FIG. 14.

When the power switch is turned on, a wait time counter, and a print time counter are reset to "0", and a correction timer for a temperature increase in the machine is started (step S301). In step S302, the control waits until a print signal is input.

When the print signal is input, the print time counter is started (step S303), and an ambient temperature is read from the temperature sensor 8 on the printed circuit 7 of the main body in step S304. In step S305, the value of the correction timer is read, and in step S306, the value of the ambient temperature read in step S304 is corrected on the basis of the value of the correction timer. The correction value is determined by the correction table for a temperature increase in the machine shown in Table 6.

The correction table as Table 6 corresponds to FIG. 22. In the case of FIG. 23, data obtained by subtracting the temperature of the recording head unit from the temperature of the ambient temperature sensor unit may be input to the correction table.

In step S307, a wait time of the wait time counter is read. The wait time counter is reset to "0", as described above, immediately after power-on. In step S308, the temperature control data table (Table 3) is referred to on the basis of the corrected ambient temperature and the wait time of the wait time counter. In step S309, the temperature control heater 10 shown in FIG. 8 is heated on the basis of this output data to increase the temperatures of the nozzle portion 9 and the common ink chamber 12 of the recording head. Upon completion of energization, the wait time counter is reset (step S310).

In step S311, a print time of the print time counter is read. The count value of the print time counter is not so incremented just after the start of the print operation. In step S312, reference output data is determined with reference to the temperature control data table during printing (Table 2).

Temperature conditions of this data are corrected according to the content of the print signal (steps S313 to S316). These steps are the same as steps S112 to S115 in FIG. 15, and a detailed description thereof will be omitted.

The temperature control heater 10 is energized using these corrected data to perform temperature control during printing (step S317), and one line is then printed (step S318).

The wait time counter is started (step S319). When the print operation further continues, the print time counter is repetitively read in step S311 via step S320, and as the print time is increased, an energy supply amount is deceased on the basis of the data on the temperature control data table during printing (Table 2). When the print operation continues, since the value of the wait time counter is not almost incremented, an output of 0% is obtained at any ambient temperature, as shown in Table 3, temperature control before printing can be prevented from being performed for each line.

Once the print operation is completed, the print time counter is reset (step S321), and the wait time counter measures a time until the next print signal is input.

When the next print signal is input, the values of the wait time counter, the ambient temperature, and the correction table for a temperature increase in the machine are read (step S304 to S307), an output energy level is similarly determined again on the basis of the temperature control data table before printing (step S308), thus repeating the same control operations.

In the third embodiment, a program having a table for correcting a temperature of the sensor unit by a difference in temperature between the ambient temperature sensor unit and the recording head unit is adopted. A temperature keeping current for correcting a temperature difference may be supplied to the recording head unit under the control of the correction table to attain the same temperature increase as that of the ambient temperature sensor unit. With this arrangement, the same effect as described above can be obtained.

Alternatively, when a temperature keeping current is not corrected based on the correction table, a small temperature keeping current may be supplied to the recording head unit during an ON period of a power supply, so that the recording head unit can have substantially the same temperature increase as that of the ambient temperature sensor unit. In this case, a current which is determined in correspondence with a thermal time constant of temperature increase characteristics of the recording head depending on a time from power-on regardless of a software program is supplied to the recording head. This control is equivalent to temperature correction in correspondence with a power-ON time. It is difficult more or less to correct the temperature of the recording head to be quite the same as the temperature increase of the ambient temperature sensor since the temperature increase of the ambient temperature sensor is attained by complex factors such as convection of air, heat transmitted from the circuit board, heat generated by the recording head itself, and the like. However, this control is satisfactory to correct a temperature increase in the machine.

In the above embodiment, heat generation according to a power-ON time is taken into consideration. Furthermore, heat generation according to an energization time of a discharge control driver such as a transistor or IC for printing may be taken into consideration. In this case, a read value of a temperature detected by the sensor unit is corrected on the basis of a sum of correction data for a temperature increase in the machine according to an energization time of the power supply unit and correction data for a temperature increase in the machine according to an energization time of, e.g., a transistor for printing. According to this arrangement, correction can Re more reliably performed.

Of printers which are operated by an AC power supply, when an AC plug is connected, a main power supply unit is energized to initialize a control unit, and the like, and an actual print operation is performed after a power switch (software power switch) is turned on to energize the respective units of the main body. In a printer of this type, if an energization time of the main power supply unit is referred to as a hardware power-on time and an energization time in which the respective units are energized by actually turning on the software power switch is referred to as a software power-on time, if these times cause different heat generation amounts, the hardware and software power-on times are independently measured, and a sum of correction values from the corresponding correction tables may be subtracted according to their lapses of time.

Figure 26:
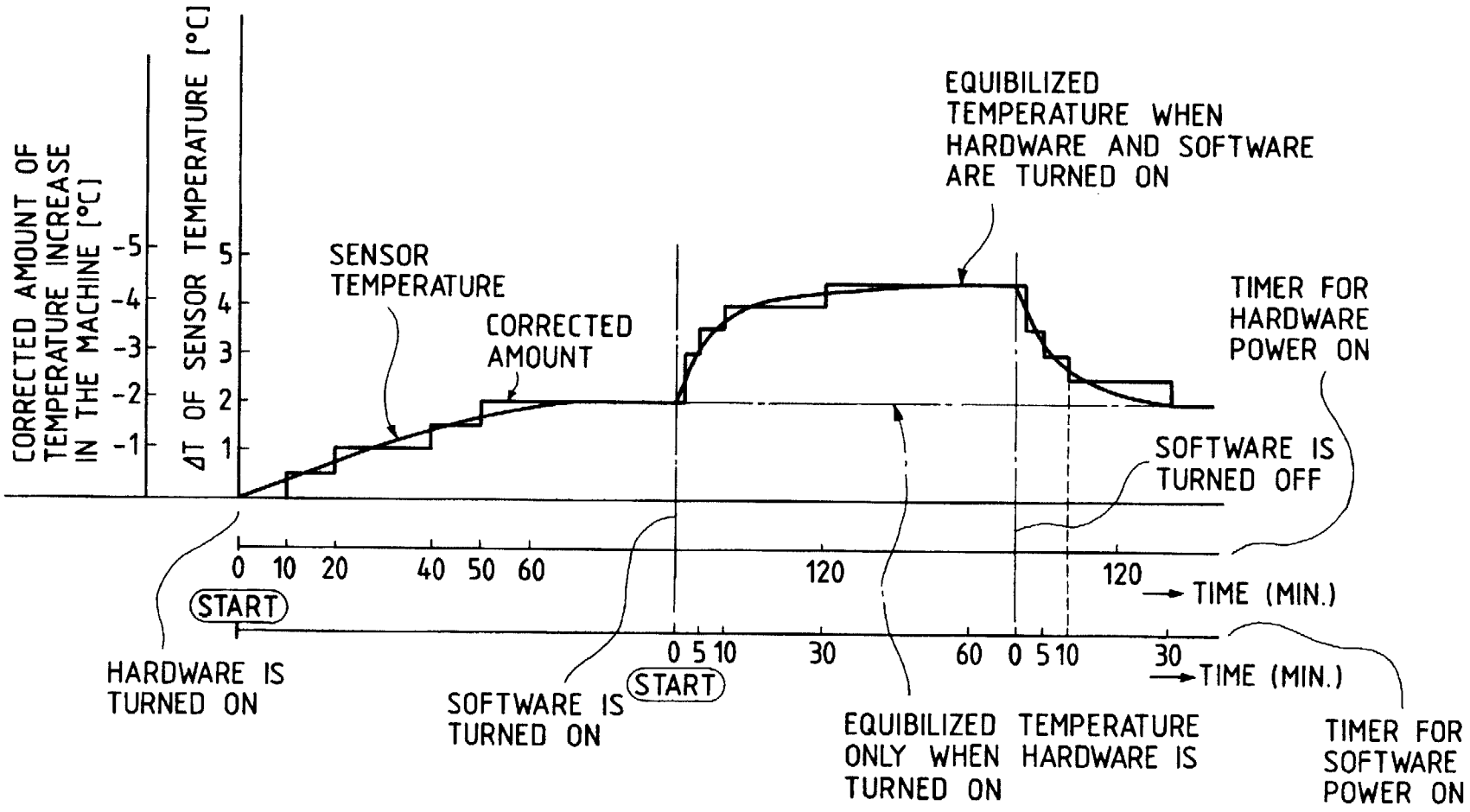
FIG. 26 is a graph showing a change in temperature in the machine near a temperature sensor and a change in correction temperature.

FIG. 26 is a view for explaining a temperature increase in the printer, and its correction operation. Tables 7 and 8 show temperature correction tables according to hardware and software power-on times. As can be seen from FIG. 26, correction temperatures shown in Tables 7 and 8 are set in correspondence with a temperature increase in the machine (T of the sensor temperature), and temperature increase correction can be precisely performed. The software and hardware power on times are measured up to a maximum of 60 minutes, and when they exceed 60 minutes, values at 60 minutes are held.

TABLE 7

| Hardware Power-ON Time | 0 min or more | 10 min or more | 20 min or more | 40 min or more | 50 min or more |
|---|---|---|---|---|---|
| Correction Temperature | 0° C. | −0.5° C. | −1° C. | −1.5° C. | −2.0° C. |

TABLE 8

| Software Power-ON Time | 0 min or more | 2 min or more | 5 min or more | 10 min or more | 30 min or more |
|---|---|---|---|---|---|
| Correction Temperature | 0° C. | −1.0° C. | −1.5° C. | −2.0° C. | −2.5° C. |

Note that correction according to energization times of the transistors and motors may be performed in addition to the above-mentioned temperature increase correction.

When software is turned off or a print operation is completed, a temperature may be subtracted on the basis of the software power-ON time or a print time.

For example, when the software is turned off in FIG. 26, a timer for software power-ON (a timer for software power-OFF may be added) is incremented from 0 to measure a software power-OFF time until the software is turned on again. A value obtained by subtracting a correction temperature obtained with reference to Table 8 on the basis of the software power-OFF time from the correction temperature when the software is turned off is set as a final correction temperature. For example, in FIG. 26, since a correction temperature when the software is turned off is −2.5° C., if the software is turned on 10 minutes later, the correction temperature of −2.0° C. is subtracted from the correction temperature of −2.5° C. and a difference of −0.5° C. is determined as a final correction temperature.

As described above, according to the third embodiment, if conventional closed-loop temperature control by a temperature sensor incorporated in the recording head is not performed, a means for measuring an ambient temperature is arranged in a recording apparatus main body such as a printer, and a means for measuring an energization time of a heat generation element of the apparatus main body is arranged to correct a value measured by the means for measuring the ambient temperature, so that a temperature of the recording head can be more precisely controlled to a desired temperature by open-loop control than in a conventional system.

Thermal problems in apparatus design such as the relative positional relationship among the temperature sensor, the printed circuit board, and the recording head, ventilations, and the like can be solved, thus greatly improving a degree of freedom in apparatus design.

Furthermore, an ambient temperature is corrected according to energization times of the apparatus main body and components in the machine which generate heat, so that a local difference in temperature increase in the machine, or an error in an anticipated temperature of the recording head caused by a time difference due to a difference in thermal time constant are corrected, thus attaining precise temperature control.

According to the present invention, a detection limit of a temperature sensor to be used is finely set, e.g., in units of 1 degree or 0.5 degree or less, and a temperature is corrected according to an energization time, thus attaining a more stable recording state.

Figure 27:
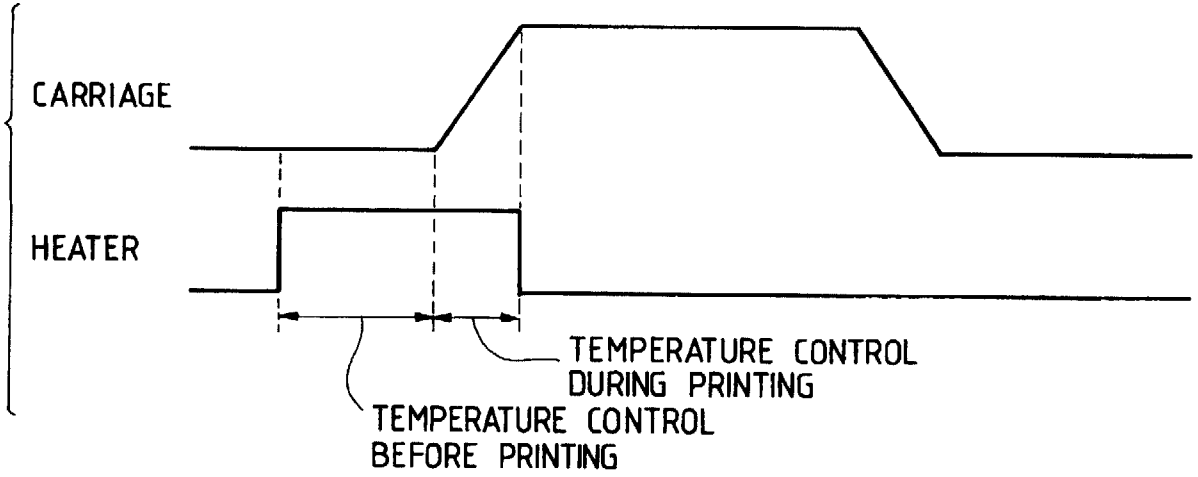
FIG. 27 is a timing chart showing timings for performing temperature control.

The fourth embodiment of the present invention will be described with reference to FIGS. 27 to 29 and Table 9.

In this embodiment, another correction operation different from correction (steps S114, S115, S211, S315, and S316) using a carriage moving amount and performed in the first to third embodiments in a temperature increase during printing will be described below. In either embodiment, an energization timing of a temperature control heater 10 falls within the acceleration (line-up) intervals at both sides of a printable range shown in FIG. 27. When the temperature control time (heater energization time) exceeds the above acceleration intervals in temperature control before printing, the heater 10 is energized prior to the acceleration time. For this reason, an output interval of temperature control pulses for driving the temperature control heater 10 in temperature control during printing corresponds to a carriage moving amount.

A correction coefficient is obtained on the basis of a pulse interval of the temperature control pulses, and carriage movement correction (pulse interval correction) in temperature control during printing is performed. Table 9 shows a data table used for pulse interval correction. These data are obtained as correction coefficients as the percentage with respect to a reference interval (100%) when a period (1.2 seconds in this embodiment) required for moving the carriage throughout the width is defined as the reference interval.

TABLE 9

| Pulse Interval | 0% or more | 25% or more | 50% or more | 75% or more |
|---|---|---|---|---|
| Correction Coefficient | 25% | 50% | 95% | 100% |

Figure 28:
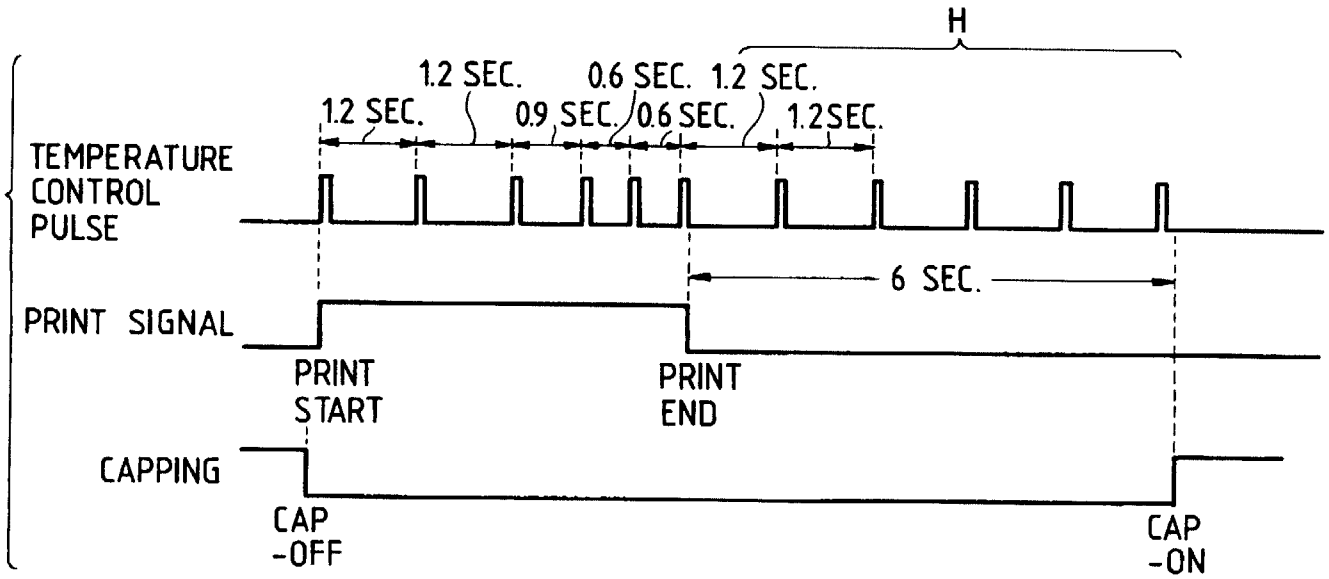
FIG. 28 is a timing chart showing output timings of temperature control pulses.
Figure 29:
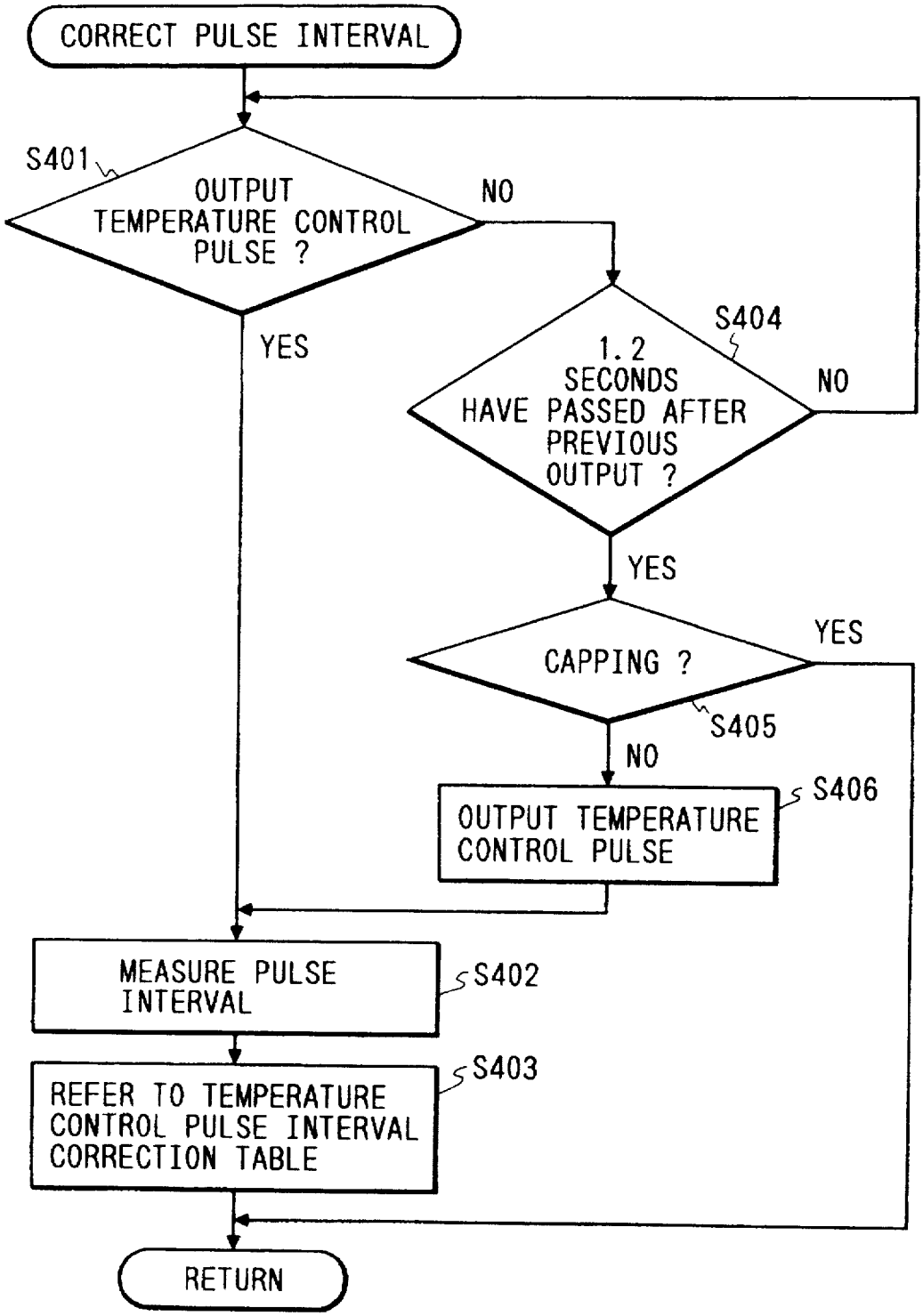
FIG. 29 is a flow chart showing temperature control according to the fourth embodiment of the present invention.

Pulse interval correction will be described with reference to FIG. 28 showing output timings of the temperature control pulses and FIG. 29 showing a flow chart of pulse interval correction.

When a temperature control pulse is output in step S401, an interval between the previous temperature control pulse and the current temperature control pulse is measured. In step S403, a temperature control pulse interval correction table is referred to on the basis of the measured pulse interval, thereby obtaining a correction coefficient. A temperature control operation amount during printing is corrected on the basis of the obtained correction coefficient.

On the other hand, when it is determined in step S401 that the temperature control pulse is not output, it is determined in step S404 whether 1.2 seconds have passed after the previous output. If NO in step S404, the flow returns to step S401. In a normal printing operation, since the temperature control pulse has a maximum of 1.2-second interval, the flow returns to step S401.

However, when the next print signal is waited, 1.2 seconds have often passed. In this case, the flow advances to step S405. It is determined in step S405 whether a capping state is set. If YES in step S405, no operation is performed, and the flow is ended. However, if YES in step S405, capping (FIG. 28) is performed in this embodiment when six seconds have passed upon completion of printing although capping is performed by a known means. In this case, the six seconds have passed to prevent a decrease in throughput occurring when capping is performed upon completion of printing because capping and uncapping require much time.

If NO in step S405, a temperature control pulse H is automatically output in step S406 to maintain the head temperature to the same temperature as in a carriage stop state. Since capping is performed when six seconds have passed upon completion of printing, a maximum of five temperature control pulses H are output. The flow then advances to steps S402.

In this embodiment, the same correction as in carriage moving amount correction is performed by measuring the temperature control pulse interval. Since the temperature control pulses H are output to maintain the head temperature constant until capping is performed even upon completion of printing, temperature control having higher precision than that in a printing restart mode can be performed.

The fifth embodiment of the present invention will be described with reference to FIGS. 30 to 33 and Tables 10 to 12.

This embodiment exemplifies an operation for protecting the recording head from an over heat state although the recording head itself generates heat.

In the second embodiment described above, the over heat which tends to occur at a high print rate is prevented by correcting a temperature control power in accordance with a print rate. For example, when a print rate is 50% or more, as shown in Table 5, the correction coefficient is set to be 0%, and temperature control is not performed.

However, when a high print rate exceeding 50% is continued for a long period of time, an over heat state occurs by heat generated by the recording head itself. As is apparent from Tables 1 to 4, in order to prevent over heat, temperature control is not performed. However, in this case, an over heat state occurs due to heat generated by the recording head itself.

In this embodiment, the self temperature increase in the recording head is anticipated on the basis of a print rate. When an over heat state is determined by the anticipated temperature increase and an ambient temperature, printing in both directions is changed to printing in one direction, thereby preventing over heat.

TABLE 10

| | Sum Data Table | | | | | |
|---|---|---|---|---|---|---|
| Low-response Duty | 0% or more | 12.5% or more | 25% or more | 40% or more | 60% or more | 80% or more |
| Sum | 0 | 1 | 20 | 100 | 240 | 500 |
| Max Value | – | 180 | 2500 | 3400 | 11300 | 13000 |

TABLE 11

| | Difference Data Table | | | | |
|---|---|---|---|---|---|
| Protect Value | 0 or more | 150 or more | 1300 or more | 5300 or more | 11000 or more |
| Difference | 1 | 20 | 100 | 240 | 500 |

| | Limit Data Table | | | | | |
|---|---|---|---|---|---|---|
| Ambient Temperature | 35° C. or more | 30° C. or less | 25° C.% or less | 20° C. or less | 15° C. or less | 15° C. or less |
| Limit Value | 100 | 100 | 400 | 2600 | 8000 | 16000 |

Tables 10 and 11 are data tables of self temperature increase control anticipation parameters, and Table 12 is a data table of self temperature increase determination control parameters.

Figure 30:
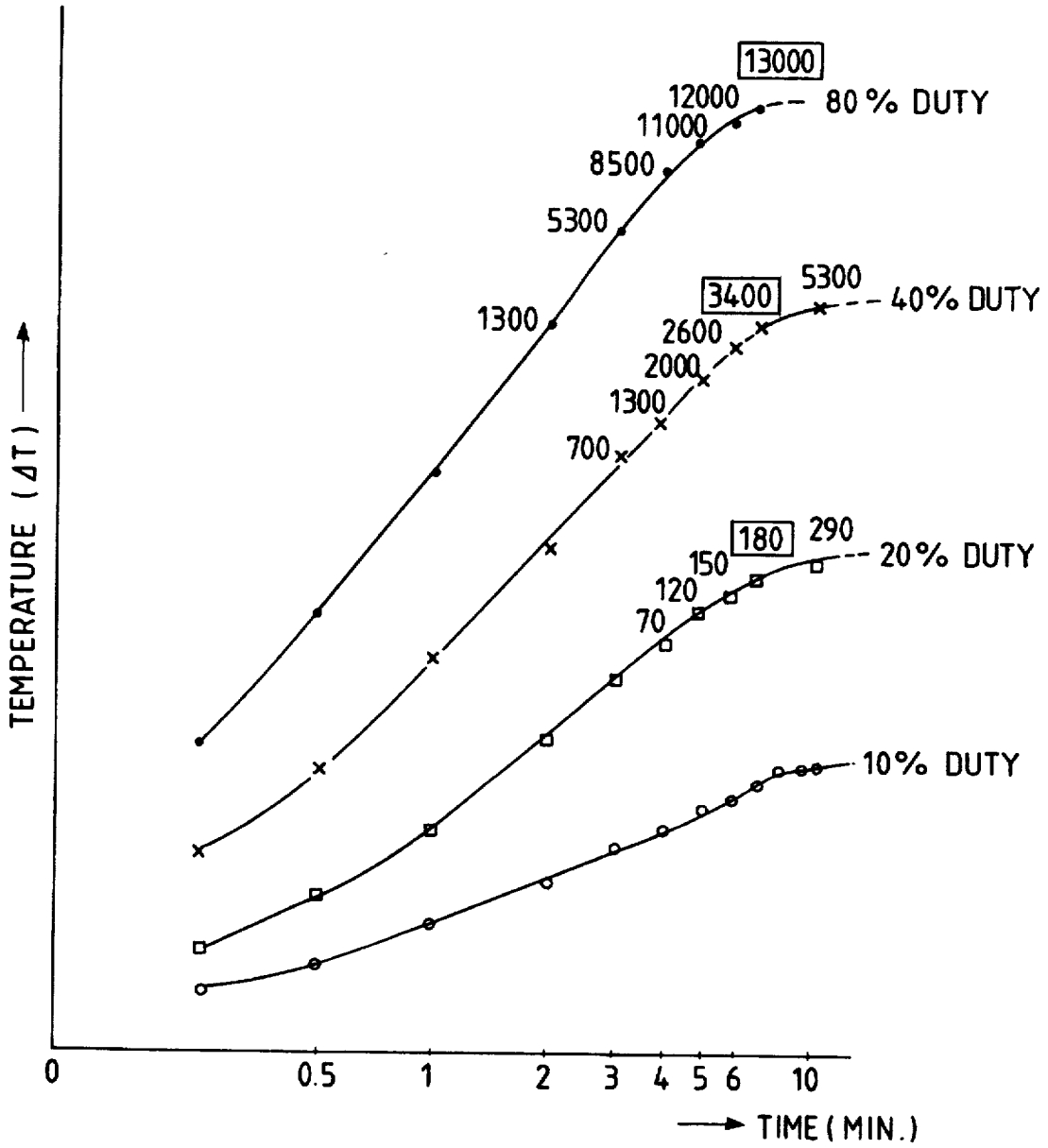
FIG. 30 is a graph showing an equilibrated temperature of a recording head according to a print rate.

A protect value is calculated to anticipate a self temperature increase in the recording head during printing. The protect value is obtained by adding a sum (Table 10) weighted with a low-response print rate every one-line printing. However, when the protect value exceeds the MAX value corresponding to the low-response print rate, the addition is not performed. As shown in FIG. 30, since a practical recording head has an equilibrated temperature corresponding to a print duty, a protect value has an upper limit corresponding to the print rate. FIG. 30 shows a relationship between the temperature increase in the recording head and the corresponding protect value when printing is performed at a predetermined print rate.

Figure 31:
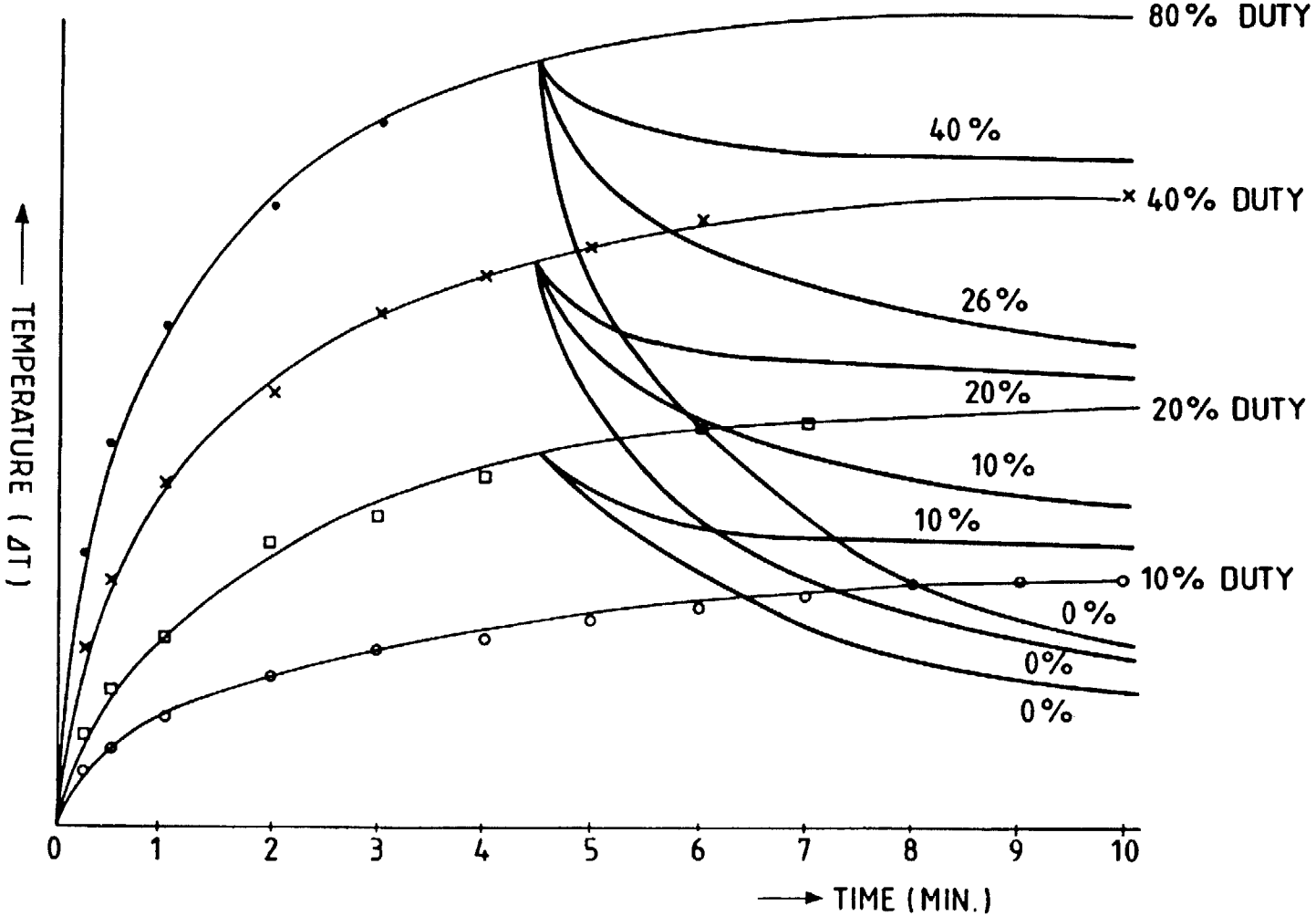
FIG. 31 is a graph showing an increase and a decrease in temperature of the recording head according to the print rate.

When the low-response print rate is smaller than the previous print rate, a difference (Table 11) weighted by the protect value is subtracted every printing of one line. If the difference is smaller than zero, no subtraction is performed because the discharge amount of the recording head is determined not by the print rate but by the increased temperature (protect value), as shown in FIG. 31. FIG. 31 shows a temperature increase/decrease in the printing head when printing is started at the predetermined print rate and the print rate is decreased during printing. The differences in Table 11 correspond to operations performed when the print rate is decreased to 0%. When the duty ratio is decreased to any value except for zero, the corresponding sum is added in correspondence with the given print rate. Therefore, the differences in Table 11 correspond to those in FIG. 31.

When the calculated protect value exceeds the corresponding limit value (Table 12), over heat protection is performed. This protection operation is performed by changing printing in both directions to printing in one direction. When printing in one direction is set, the print rate is reduced to ½ that in printing in both directions, thereby preventing over heat.

The low-response print rate is used to calculate the protect value because the low-response print rate corresponds to a temperature increase for a long period of time, i.e., heat storage, and a high-response print rate corresponds to a local, instantaneous temperature increase.

Figures 32, 32A:
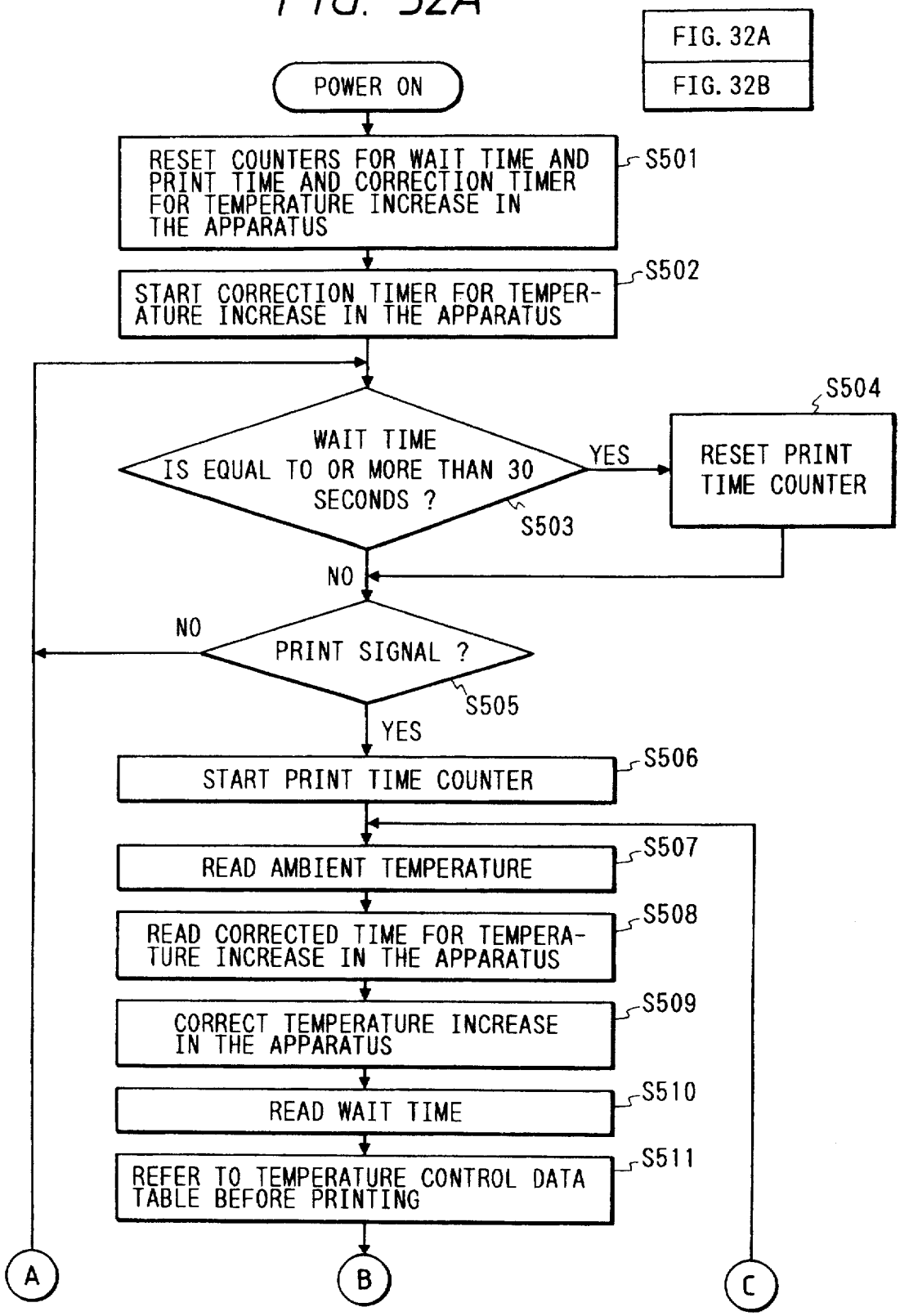
FIGS. 32, 32A, 32B and 33, 33A and 33B are flow charts showing temperature control according to the fifth embodiment of the present invention.
Figure 32B:
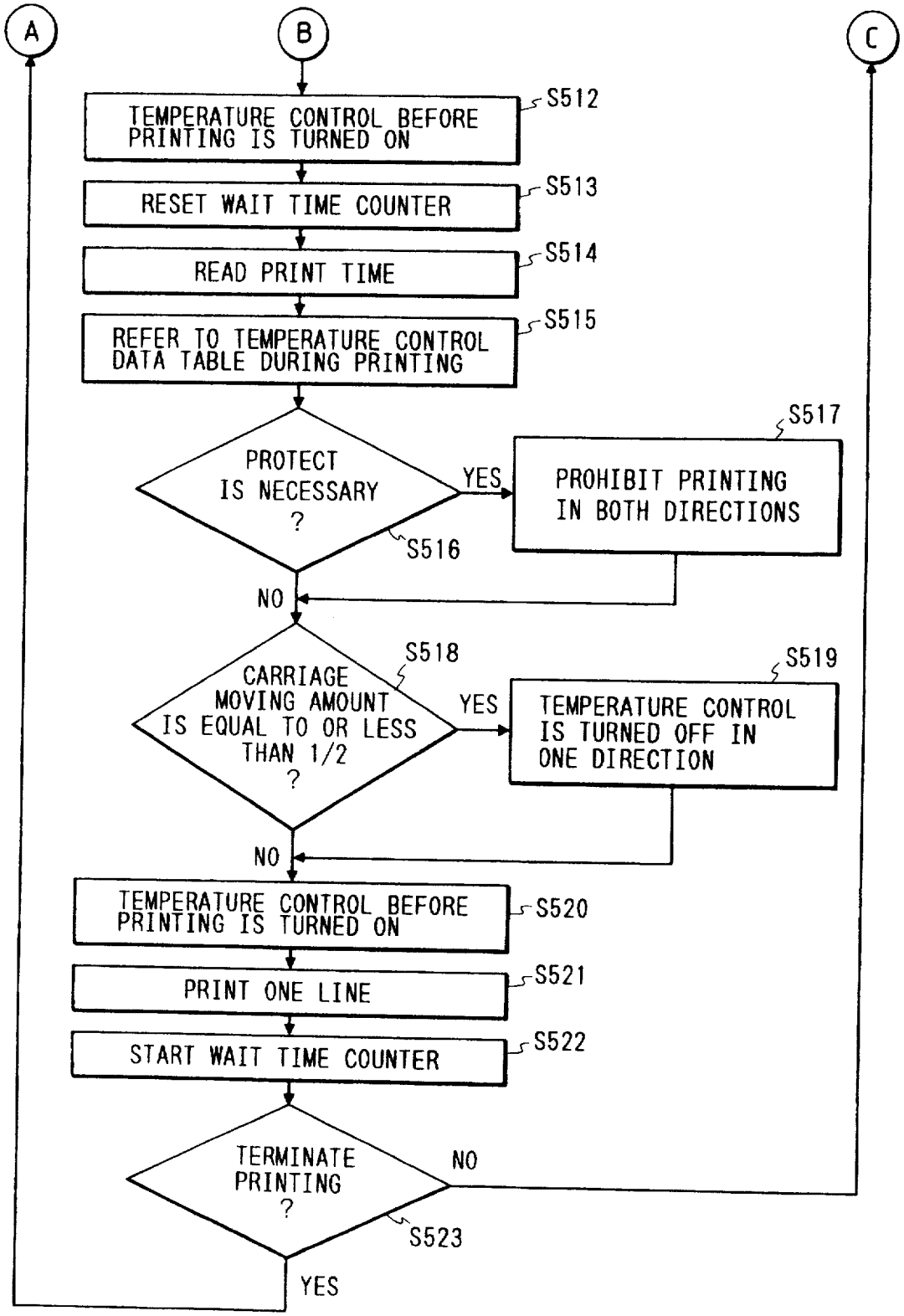
Figures 33, 33A:
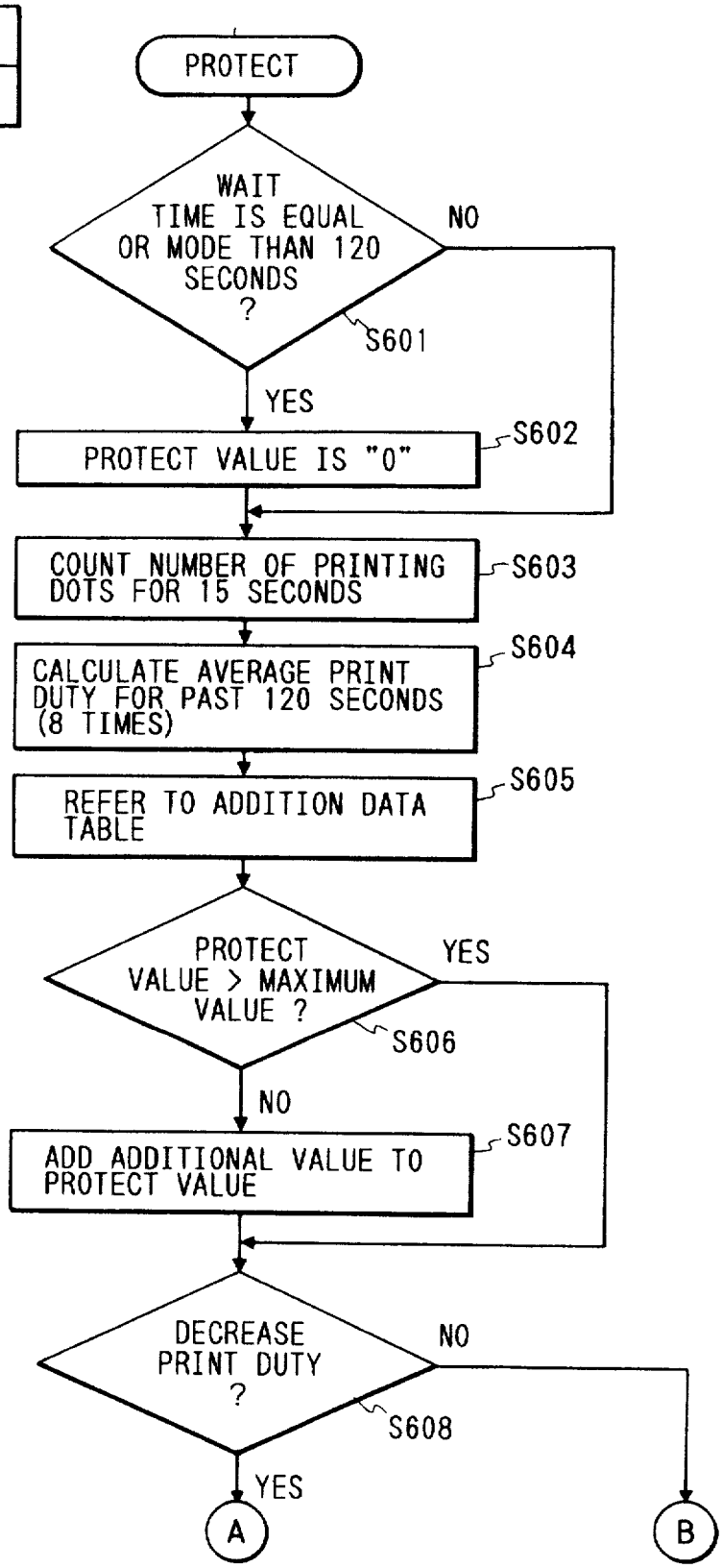
Figure 33B:
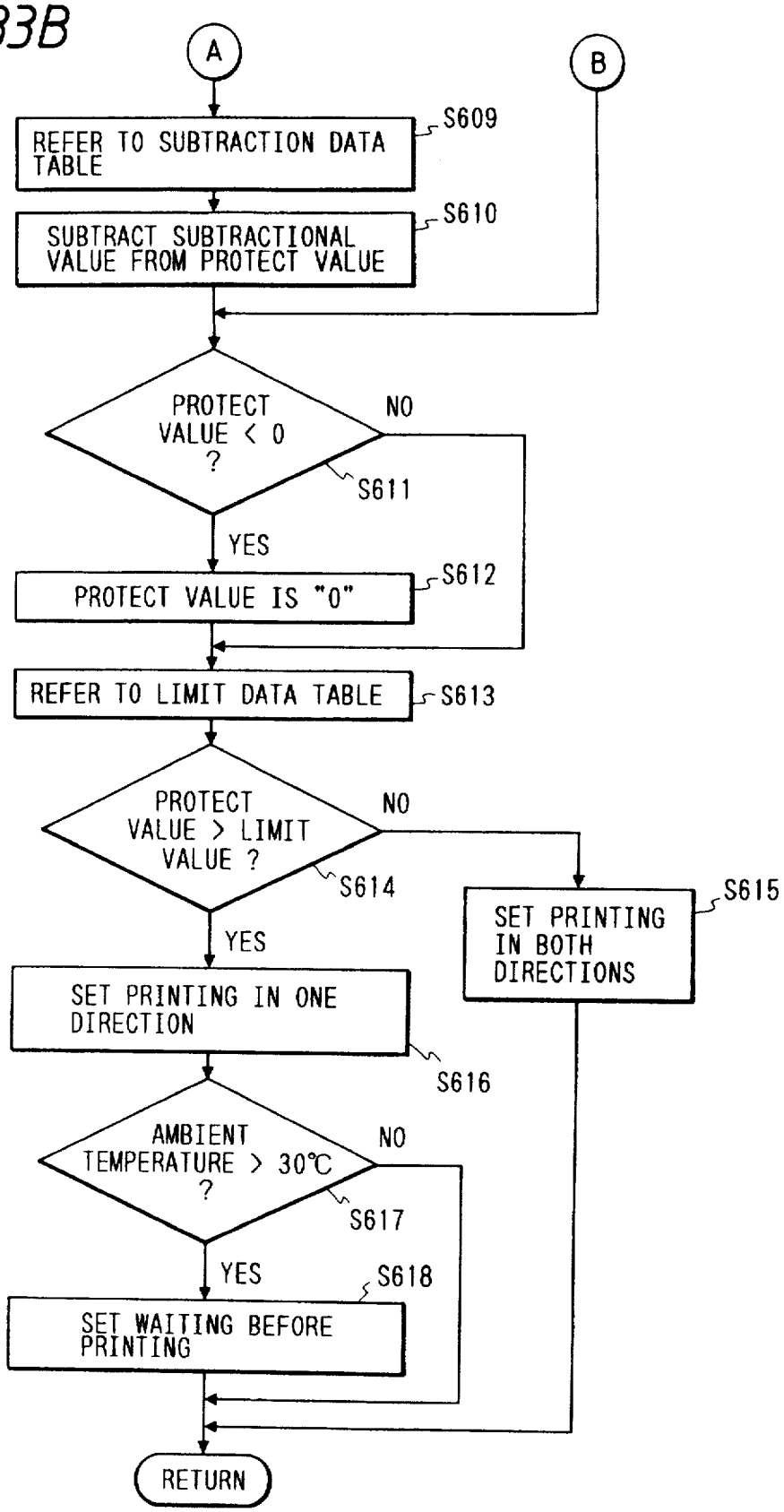

An over heat protection operation of this embodiment will be described with reference to flow charts in FIGS. 32 and 33.

A wait time counter, a print time counter, and a temperature increase correction timer are set (step S501) upon power-on operation. The correction timer is then started (step S502). In step S503, a wait time is read. When the count of the wait time counter represents 30 seconds or more, the print time counter is reset in step S504 due to a reason to be described later.

Figures 24, 24A:
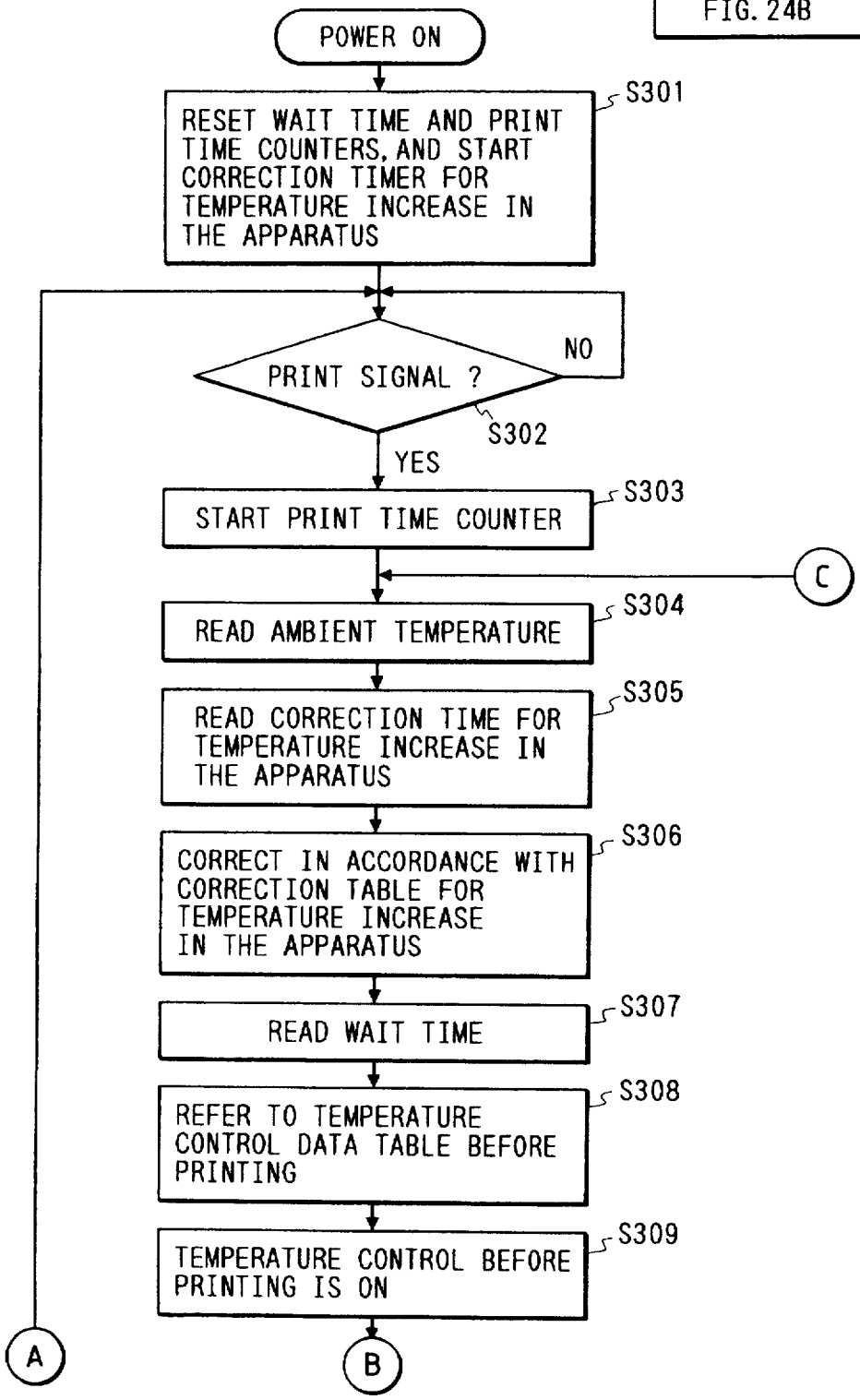
FIGS. 24, 24A and 24B are flow charts showing temperature control according to the third embodiment of the present invention.
Figure 24B:
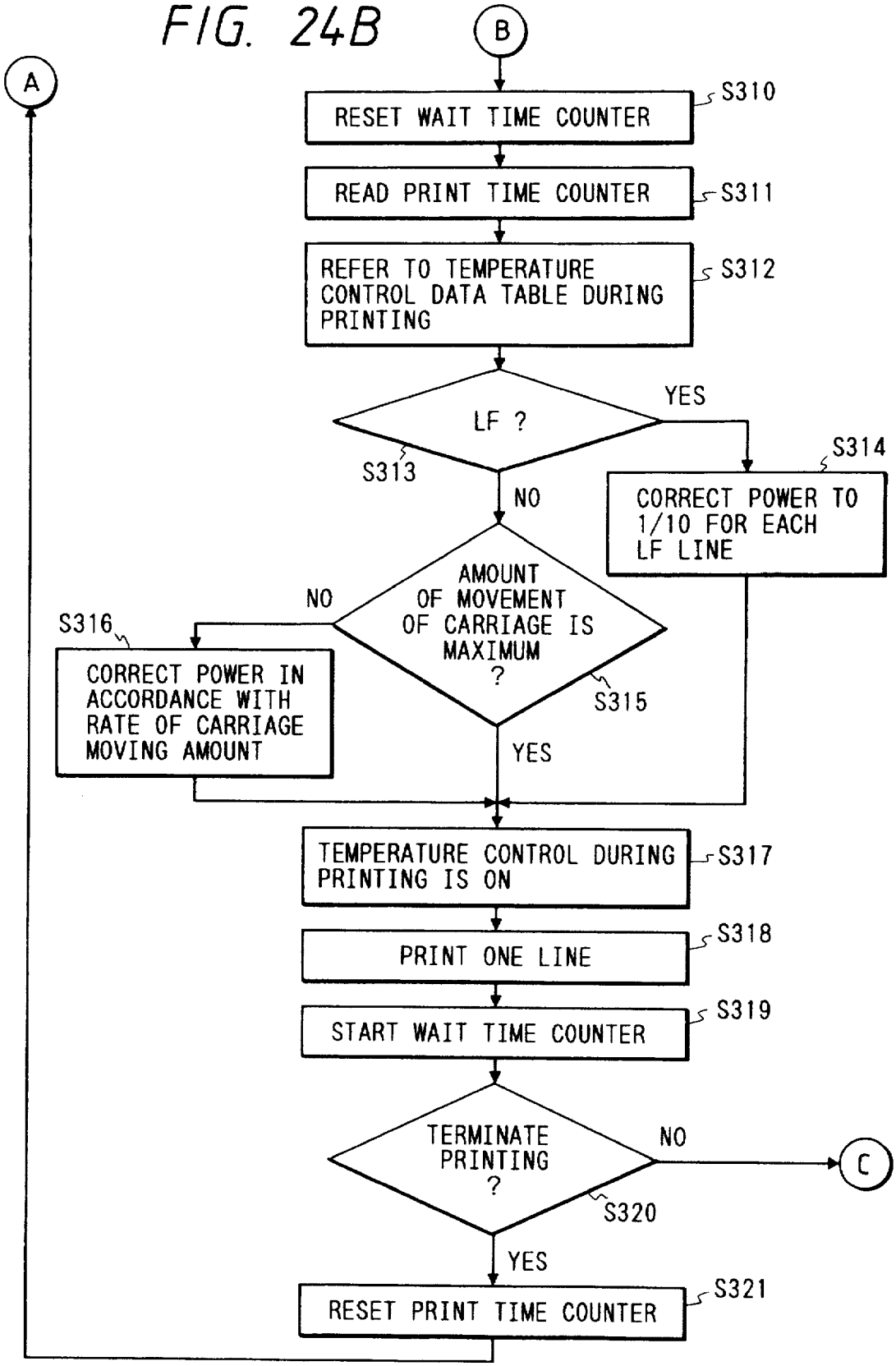
Figure 25:
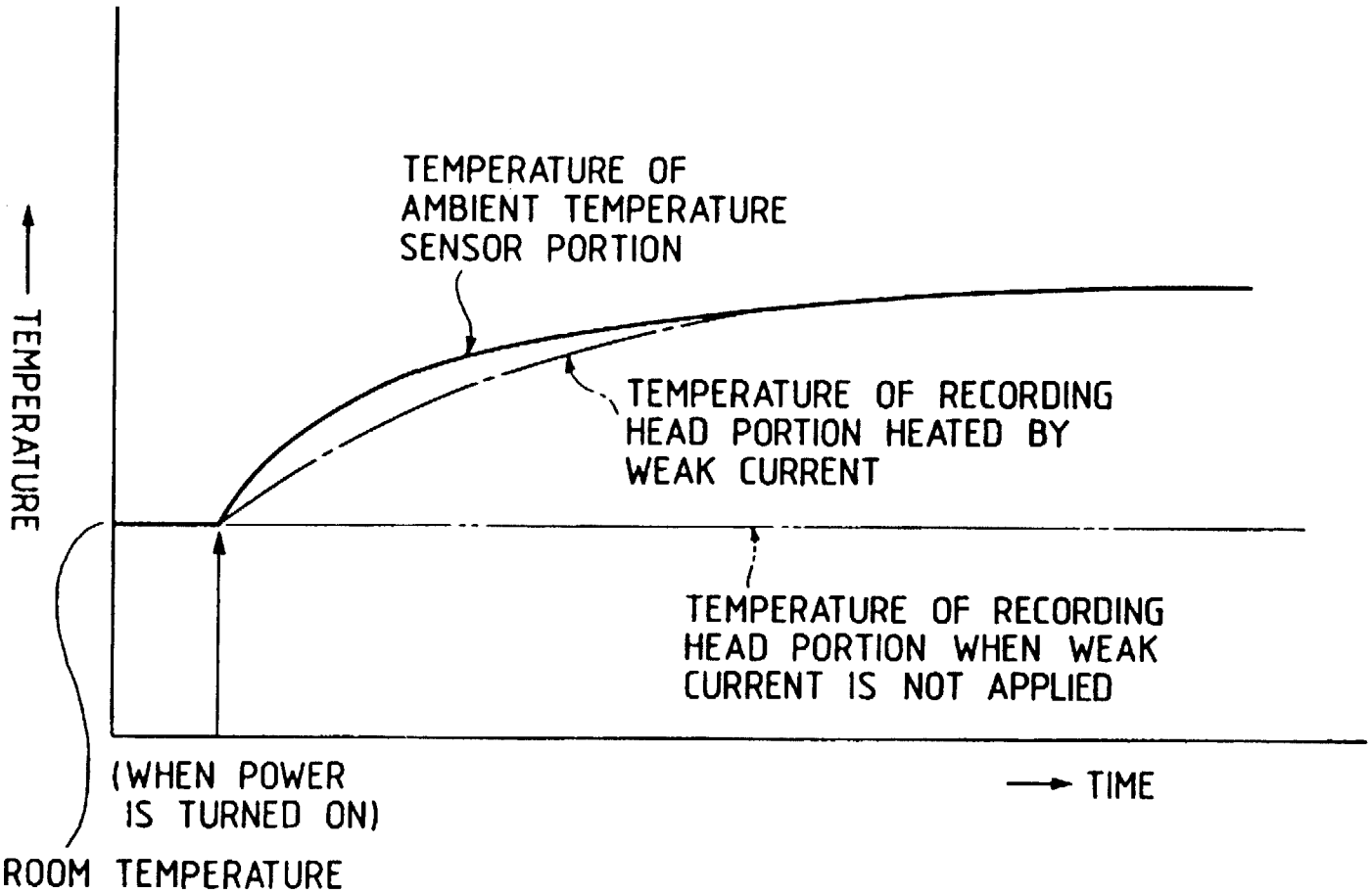

Operations in steps S505 to S515 are the same as those (temperature increase correction in the machine and temperature control before printing) in steps S302 to S312 in FIG. 24, and a detailed description thereof will be omitted.

It is determined in step S516 on the basis of a protect value whether a protect mode is required. If YES in step S516, printing in both directions is inhibited in step S517. If a carriage moving amount is ½ or less of the overall width in step S518, the mode is set in step S519 so that temperature control is not performed in printing in one direction. The operations in steps S518 and S519 are another series of correction operations corresponding to correction operations performed by the carriage moving amount in the first to fourth embodiments.

After the temperature control heater 10 is energized to perform temperature control during printing in step S520, printing of one line is performed in step S521. The wait time counter is started (step S523). When printing is completed (step S523), the flow returns to step S503.

In the third embodiment shown in FIG. 24, when printing is completed, the print time counter is always reset (steps S320 and S321). However, in this embodiment, the wait time timer is reset (steps S523, S503, and S504) when the wait time exceeds 30 seconds. When the wait time falls within 30 seconds, printing is assumed to be continued. Therefore, the temperature control power in temperature control during printing is set to be low.

The details of steps S516 and S517 will be described below with reference to FIG. 33.

It is determined in step S601 whether a wait time is equal to or more than 120 seconds. If YES in step S601, the protect value is reset to "0" in step S602. When printing is not performed for a period of 120 seconds or more, the temperature of the recording head is assumed to be decreased near the ambient temperature, thereby releasing the protect mode.

In step S603, the number of printing dots for 15 seconds is counted. In step S604, an average low-response print duty for past 120 seconds (8 times) is calculated of the number of printing dots counted in step S603. In step S605, the sum data table (Table 10) is referred to on the basis of the low-response print duty to obtain a sum. This sum is compared with the MAX value and if the protect value does not exceed the MAX value, the sum is added to the protect value (steps S606 and S607).

In step S608, when the low-response print duty is smaller than the previous low-response print duty obtained in step S604, discharge is taken into consideration. That is, in step S609, the difference data table (Table 11) is referred to on the basis of the protect value to obtain a difference. In step S610, the difference is subtracted from the protect value. In this case, when the protect value is smaller than zero, it is set to be zero (steps S611 and S612).

A limit value is obtained with reference to the limit data table on the basis of the ambient temperature (step S613). If the protect value does not exceed this limit value, printing in both directions is set (steps S614 and S615). Therefore, this state is canceled in printing in one direction (to be described later).

If the protect value exceeds the limit value, over heat is determined. In step S616, printing in one direction is set. In this state, the print duty is set to ½ that in printing in both directions, over heat can be prevented. Furthermore, when the ambient temperature exceeds 30° C. the wait time is set so that a period of 1.2 seconds is inserted before printing (steps S617 and S618). The print duty is decreased to ⅓ that in printing in both directions. Even if the ambient temperature is high, the temperature of the recording head can be quickly decreased.

According to the fifth embodiment, as described above, the increase in temperature of the recording head is anticipated on the basis of the print rate, and over heat of the recording head is detected. When over heat of the recording head is determined, printing is changed from printing in both directions to printing in one direction to reduce a print speed. An energy applied to the recording head in unit time can be reduced to prevent over heat.

In addition, the equilibrated temperature corresponding to the print rate and a discharge amount caused by a decrease in print rate is taken into consideration, thereby anticipating a temperature increase in the recording head. Therefore, high-precision protection against a temperature increase can be achieved.

When the temperature increase state is canceled by temperature increase protection, the mode is restored to printing in both directions to increase a recording speed.

In this embodiment, over heat of the recording head is protected by changing the mode from printing in both directions to printing in one direction. However, any method may be employed if an energy applied to the recording head in unit time can be reduced. For example, a predetermined wait time may be provided prior to printing of the next line, and the pulse width of the discharge heater may be shortened.

In the first to fifth embodiments described above, print time data, wait time data, the energization time data, and the like are preferably stored or timer operations are preferably continued during the power-off state due to the following reason. When data is lost upon a power-off operation, the previous temperature of the recording head is unknown when the power switch is turned on again. As a result, proper temperature control cannot be performed.

The sixth embodiment of the present invention will be described with reference to the accompanying drawings.

Figure 34:
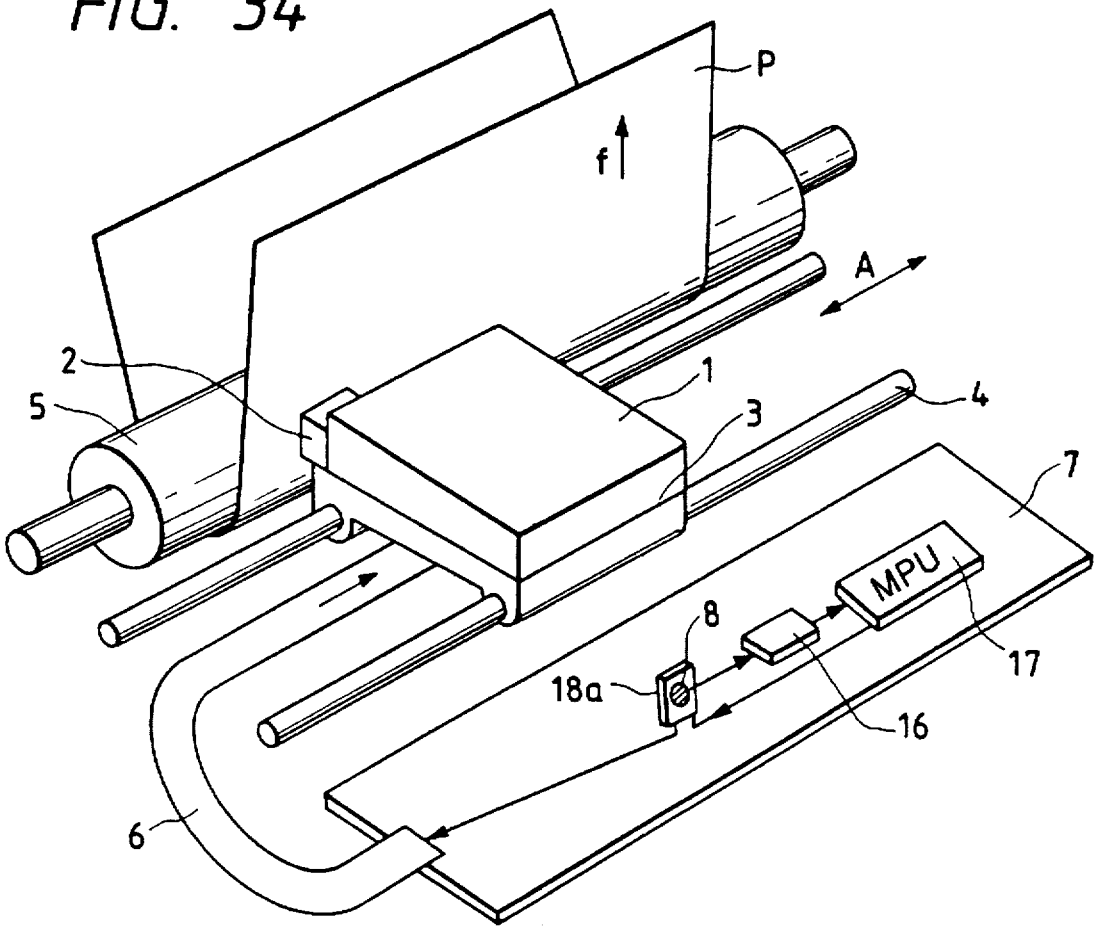
FIG. 34 is a perspective view showing an ink-jet recording apparatus suitable for carrying out temperature control according to the sixth embodiment of the present invention.

FIG. 34 is a perspective view illustrating an ink-jet recording apparatus which can suitably employ a temperature control method of the present invention.

The ink-jet recording apparatus is of a serial scan type in which a head cartridge integrally including a recording head and an ink tank is mounted on a carriage moved along a recording medium P such as a paper sheet or a plastic thin sheet.

This ink-jet recording apparatus includes an ink tank 1 and a recording head 2.

The recording head 2 is an ink-jet recording head which discharges an ink by utilizing heat energy. The recording head 2 comprises an electrothermal conversion element array.

The ink-jet recording head 2 discharges an ink from a discharge port upon growth of bubbles by film boiling generated by heat energy applied by the electrothermal conversion element, thereby recording information.

The ink tank 1 and the recording head 2 are integrally arranged to constitute a disposable (exchangeable) head cartridge as a whole.

The head cartridge is mounted on a carriage 3, and the carriage 3 is reciprocated in directions indicated by a double-headed arrow A along guide rails 4 so as to move along the recording medium P. The recording medium P is brought into tight contact with a platen roller 5 constituting a recording surface and is fed in a direction indicated by an arrow f upon driving of the platen roller 5. A flexible cable 6 comprises signal lines for supplying ink discharge signal pulse currents and recording head temperature adjustment currents to the recording head 2 through the carriage 3. A printed circuit board 7 comprises an electrical circuit for controlling the recording apparatus.

In the illustrated arrangement, a temperature sensor 8, a head drive constant voltage source power transistor **18*a*, an A/D converter 16, a microprocessing unit (MPU) 17, and the like are mounted on the printed circuit board 7. The power transistor 18*a* is one of the components constituting the electrical circuit on the printed circuit board 7. The power transistor 18*a* controls an ink discharge signal current to the recording head 2. The temperature sensor 8 comprises a temperature sensor consisting of a thermistor for measuring a temperature. The temperature sensor 8 is mounted in contact with the power transistor 18*a*. The A/D converter 16 converts an analog signal from the temperature sensor 9 to a digital signal. The microprocessing unit (MPU) 17** controls the respective components in the recording apparatus and performs a processing sequence such as temperature control.

Figure 35:
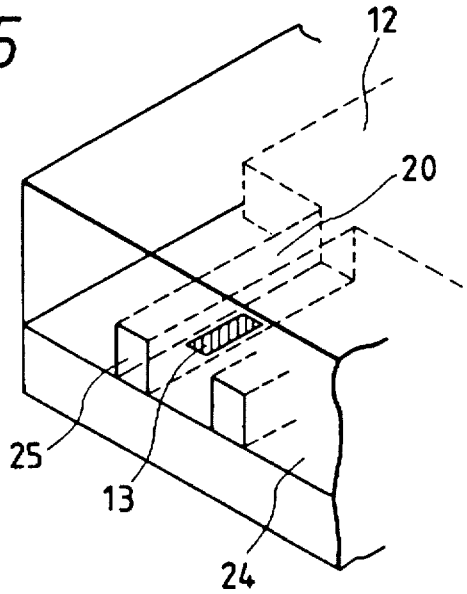
FIG. 35 is a partial perspective view showing a structure of a recording head shown in FIG. 34.

FIG. 35 is a partial perspective view showing a detailed structure of the recording head 2. Referring to FIG. 35, an ink path 20 which communicates with each discharge port 25 and a common ink chamber 12 for supplying an ink to each ink path 20 are formed in a base plate 24. A discharge heater 13 serving as a discharge energy generating element for applying discharge heat energy to an ink in each ink path 20 is arranged in each ink path 20.

When recording is to be performed, an ink is filled from the ink tank 1 in the common ink chamber 12 and each ink path 20 through ink supply pipes (not shown).

An electrical signal (e.g., an image signal) is applied from the printed circuit board 7 to each discharge heater 13 through the flexible cable 6. Each discharge heater 13 is heated to instantaneously generate bubbles in part of the ink. Flying ink droplets are discharged from each discharge port 25 located at the downstream of the corresponding discharge heater 13. Each ink droplet is attached to the recording medium P to perform recording.

Figure 36:
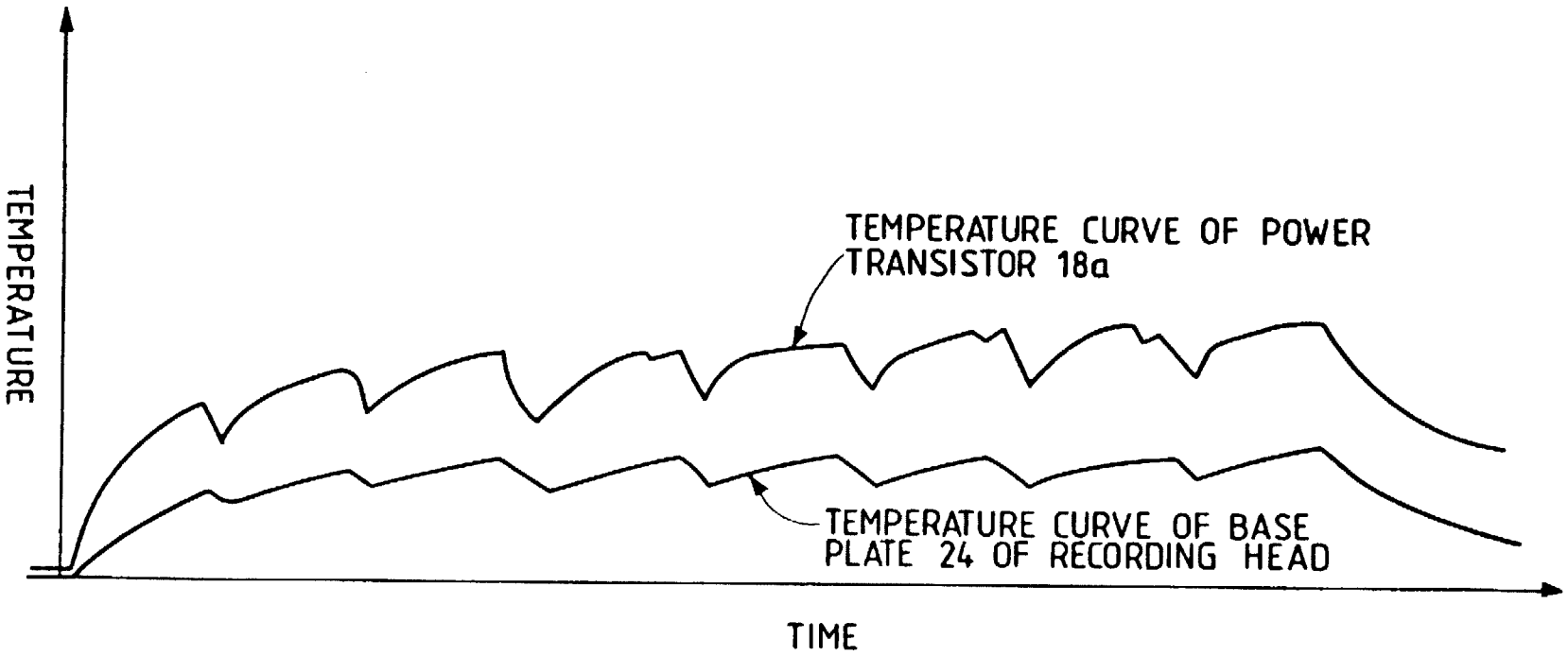
FIG. 36 is a graph showing the relationship between a temperature of the recording head shown in FIG. 34 and a temperature of a power transistor for driving a discharge heater.

FIG. 36 is a graph showing results obtained by simultaneously measuring temperatures of the base plate 24 of the recording head 2 and the temperatures of the power transistor 18*a* when a predetermined pattern is continuously recorded on eight recording media by the ink-jet recording apparatus described above.

As shown in FIG. 36, the temperature of the power transistor 18*a* is increased with an increase in temperature of the recording head 2. The temperature of the power transistor 18*a* as this electronic driving element is read by the temperature sensor 9, and the temperature of the recording head 2 can be measured.

Figure 37:
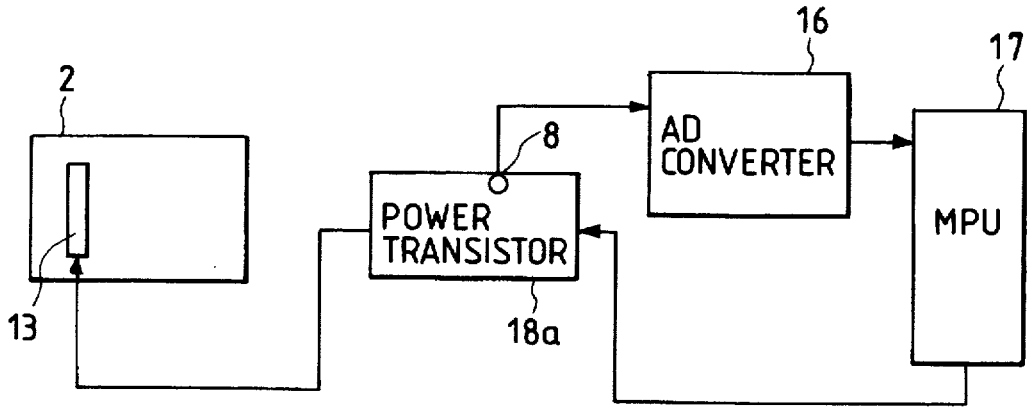
FIG. 37 is a block diagram showing a temperature control system of the recording head shown in FIG. 34.

FIG. 37 is a block diagram of a control system for suitably practicing the temperature control method of the sixth embodiment.

As described above, a certain correlation is present between the temperatures of the recording head 2 and the temperatures of the power transistor 18*a*. However, different temperature curves are obtained due to differences between the heat capacities of the recording head 2 and the power transistor 18*a*.

For this reason, a power transistor is selected so that the heat capacity of the power transistor 18*a* becomes equal to that of the recording head 2, or a heat sink is coupled to the power transistor. Alternatively, an arithmetic operation is performed to correct a temperature of the power transistor 18*a* by the MPU 17 so as to uniquely determine the temperature of the recording head 2 from the temperature of the power transistor 18*a*. When the current temperature is lower then a predetermined temperature, a short pulse which does not cause formation of bubbles and discharge of an ink is applied to the discharge heater 13 in a non-recording mode to heat the recording head 2. When the current temperature exceeds the predetermined temperature, supply of the short pulse to the discharge heater in the non-recording mode is stopped to adjust over heat of the recording head 2.

Figure 38:
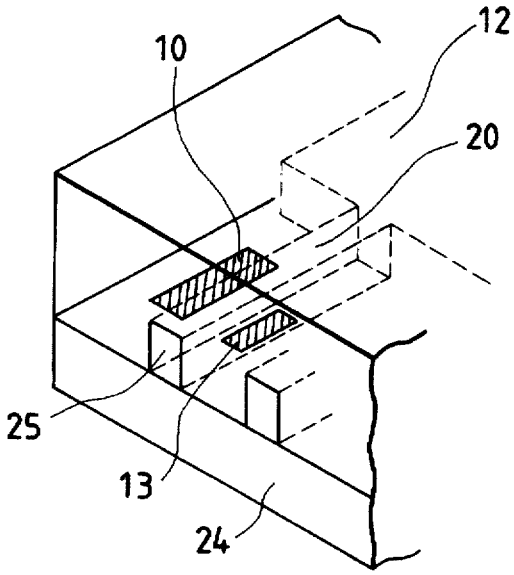
FIG. 38 is a partial perspective view showing a structure of a recording head for performing temperature control according to the seventh embodiment of the present invention.

FIG. 38 is a partial perspective view showing a recording head 2 used for performing temperature control according to the seventh embodiment of the present invention. Referring to FIG. 38, a temperature control heater 10 is arranged to heat the recording head 2 near the ink path 20 of the recording head 2 in addition to a discharge heater 13 of each ink path 20.

Figure 39:
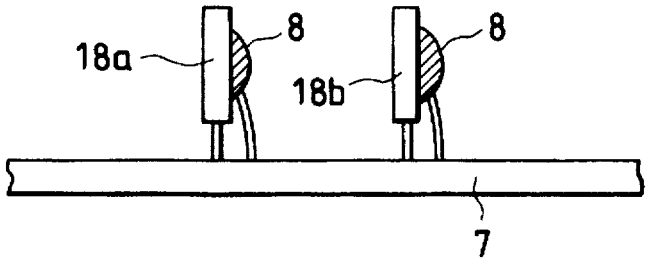
FIG. 39 is a sectional view of a printed circuit board according to the seventh embodiment of the present invention.

FIG. 39 is a sectional view showing part of a printed circuit board 7 of this embodiment. Referring to FIG. 39, a constant voltage source power transistor 18*b* for driving the temperature control heater 10 is arranged on the printed circuit board 7 in addition to a recording head driving power transistor 18*a*. Temperature sensors 8 are arranged in contact with the power transistors 18*a* and 18*b*, respectively.

Figure 40:
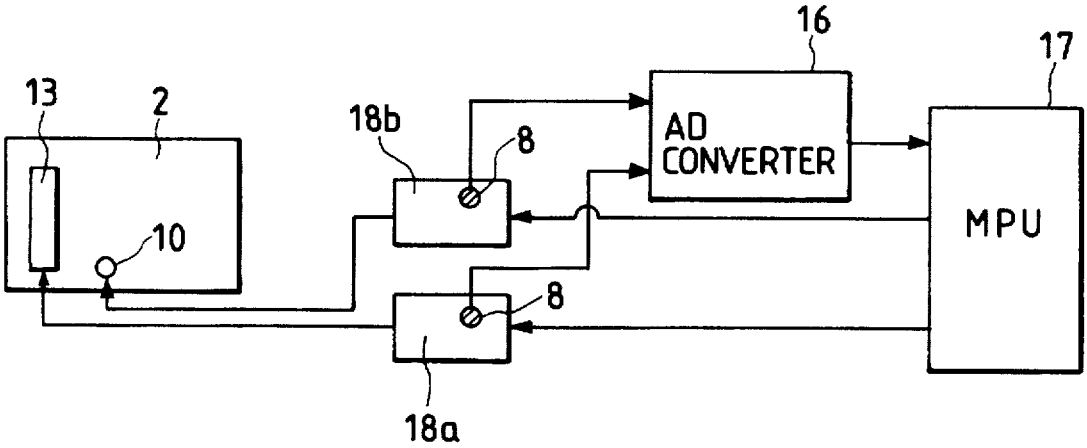
FIG. 40 is a block diagram of a temperature control system according to the seventh embodiment of the present invention.

FIG. 40 is a block diagram of a control system suitably employing a temperature control method of this embodiment.

Referring to FIG. 40, power transistors are selected so that each of the heat capacities of the discharge heater drive power transistor 18*a* and the temperature control driving power transistor 18*b* is set to be ½ the heat capacity of the recording head 2. Alternatively, a heat sink is coupled to each power transistor to set so that a temperature increase in each power transistor 18*a* or 18*b* is doubled from the temperature increase in the recording head 2.

The temperatures of the power transistors 18*a* and 18*b* are measured by temperature sensors 8, and temperature signals from the sensors 8 are converted into digital signals by A/D converters 16. The digital signals are multiplied with each other in the MPU 17, and the product is additionally multiplied with a correction coefficient, thereby uniquely determining the temperature of the recording head from the temperatures of the power transistors 18*a* and 18*b*.

An ambient temperature (room temperature) sensor may be arranged and combined with the two temperature sensors 8 attached to the power transistors 18*a* and 18*b*, thereby correcting the measuring temperatures.

When the measured temperatures of the two power transistors 18*a* and 18*b* are lower than a predetermined temperature, the temperature control heater 10 is turned on, and a short pulse which does not cause formation of bubbles of the ink is applied to it, thereby heating the recording head 2.

When the measured temperatures of the two power transistors 18*a* and 18*b* exceed the predetermined temperature, at least one of the temperature control heater 10 is turned off, and supply of a short pulse to the discharge heater 13 is stopped is performed to prevent over heat of the recording head 2.

Figure 41A:
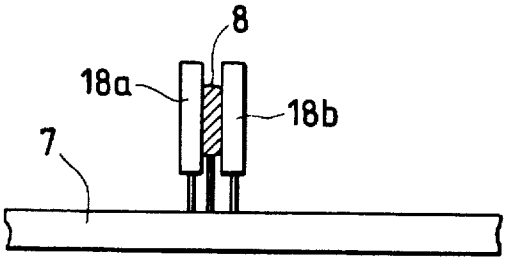
FIGS. 41A and 41B are sectional views of a printed circuit board used in the eighth embodiment of the present invention.
Figure 41B:
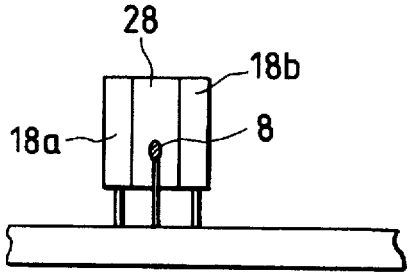

FIGS. 41A and 41B are partial sectional views of printed circuit boards 7 for performing temperature control according to the eighth embodiment of the present invention.

Referring to FIG. 41A, a discharge heater driving power transistor 18*a* and a temperature control heater driving power transistor 18*b* are in contact with one temperature sensor 9.

Referring to FIG. 41B, a discharge heater driving power transistor 18*a* and a temperature control heater driving power transistor 18*b* are in contact with a heat sink 28. In addition, a temperature sensor 8 is thermally coupled to the heat sink 28.

The temperature control method of this embodiment can be practiced using the same arrangement as the control system shown in FIG. 40.

In the arrangement of FIG. 41A, a total heat capacity of the two power transistors 18*a* and 18*b* is set to be equal to that of the recording head 2, or an analog signal from the temperature sensor 8 is converted into a digital signal by an A/D converter, and the digital signal is subjected to correction processing in an MPU 17. Therefore, the temperature of the recording head 2 can be uniquely determined from the temperatures measured by the temperature sensor 8. When the measured temperature is the predetermined temperature or less, at least one of the temperature control heater 10 and the discharge heater 13 is used to heat the recording head 2. When the measured temperature exceeds the predetermined temperature, heating of the recording head by at least one of the temperature control heater 10 and the discharge heater 13 is stopped, thereby performing temperature control of the recording head 2.

In the arrangement of FIG. 41B, a total heat capacity of the two power transistors 18*a* and 18*b* and the heat sink 28 is selected to be equal to that of the recording head 2. Alternatively, the analog signals from the temperature sensor 8 are converted into digital signals by the A/D converters 16, and the digital signals are subjected to correction processing in the MPU 17. Therefore, the temperature of the recording head 2 is uniquely determined in accordance with the temperatures measured by the temperature sensor 8. In the same manner as described above, when the measured temperatures are the predetermined temperature or less, the recording head 2 is heated by at least one of the temperature control heater 10 and 10 the discharge heater 13. However, when the measured temperatures exceed the predetermined temperature, heating of the recording head 2 by at least one of the temperature control heater 10 and the discharge heater 13 is stopped, thereby controlling the temperature of the recording head 2.

Figure 42:
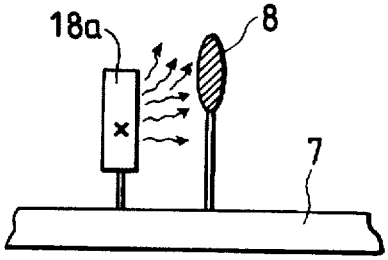
FIG. 42 is a sectional view of a printed circuit board used in the ninth embodiment of the present invention.
Figure 43:
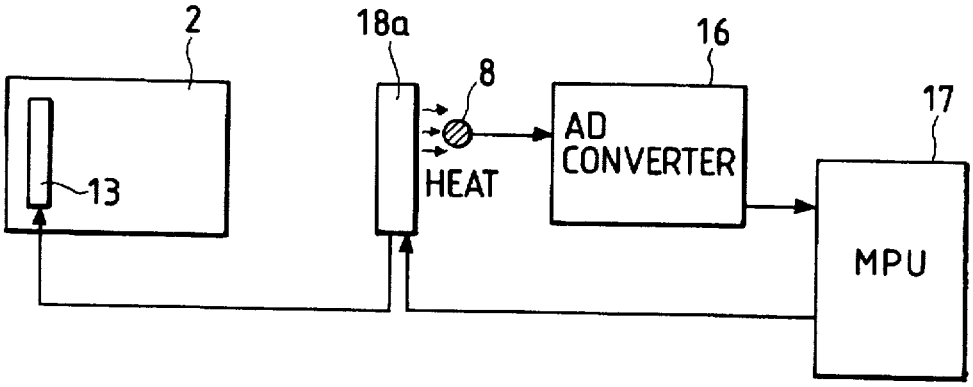
FIG. 43 is a block diagram of a control system according to the ninth embodiment of the present invention.

FIG. 42 is a partial sectional view of a printed circuit board for performing temperature control according to the ninth embodiment of the present invention. FIG. 43 is a block diagram of a control system suitably performing the temperature control of this embodiment.

Referring to FIG. 42, a temperature sensor 8 is located near a discharge heater driving power transistor 18*a*. In this case, in order to cause the temperature sensor 8 to effectively sense radiation heat or convection heat from the discharge heater driving power transistor 18*a*, the temperature sensor 8 is preferably located at a level higher than a heating source of the discharge heater driving power transistor 18*a* since heat is accumulated in the upper portion.

Referring to FIG. 43, in the control system of this embodiment, radiation heat and reflection heat from the power transistor 18*a* for the discharge heater 13 are measured by the temperature sensor 8, and an analog signal from the temperature sensor 8 is converted into a digital signal by the A/D converter 16. Thereafter, the digital signal is subjected to correction processing, thereby anticipating the temperature of the recording head 2.

The temperature of the recording head 2 can be stably controlled to a predetermined temperature by the above control system.

According to the sixth to ninth embodiments as described above, closed-loop temperature control by the temperature sensor incorporated in a conventional recording head need not be performed. By using the temperature sensor 8 arranged in the recording apparatus, the temperature of the heat-generating power transistor (driving element) for applying a heat energy to the recording head 2 is measured. The temperature of the recording head is indirectly measured, and the temperature of the recording head 2 can be controlled to a desired temperature.

An expensive recording head temperature sensor can be eliminated, variations in temperature measurement values of the recording head can be eliminated, the manufacturing cost can be greatly reduced, and the product yield can be greatly increased.

Each embodiment described above exemplifies a disposable cartridge type recording head. However, the temperature control method of the present invention is not limited to this. The present invention is equally applicable to use of a recording head of a type which does not substantially require replacement, thereby obtaining the same effect as described above.

In each embodiment, the power transistor is used as a driving element for applying a heat energy to the recording head 2. However, the drive element is not limited to the power transistor.

Each embodiment described above exemplifies a serial scan type ink-jet recording apparatus using a serial scan type ink-jet recording head (head cartridge) mounted on the carriage 3. However, the present invention is also applicable to a line type ink-jet recording apparatus using a line type ink-jet recording head which covers a recording area in the widthwise direction of the recording medium, and ink-jet recording apparatuses employing other recording schemes to obtain the same effect as described above.

The present invention is used in a variety of applications regardless of the number of recording heads.

The present invention has excellent effects in a bubble-jet type recording head and its recording apparatus in the ink-jet recording schemes.

As its typical arrangement and principle, the basic principles disclosed in, e.g., U.S. Pat. Nos. 4,723,129 and 4,740,796 are preferable. This scheme can be applied to any one of an on-demand type scheme and a continuous type scheme. In particular, when the above principle is applied to the on-demand type scheme, at least one driving signal corresponding to recording information is applied to an electrothermal conversion element located in correspondence with a sheet having a liquid (ink) layer or an ink path so as to obtain an abrupt temperature increase, thereby causing the electrothermal conversion element to generate a heat energy. Film boiling is caused on the heat application surface of the recording head, and a bubble can be effectively formed in a liquid (ink) in a one-to-one correspondence with this driving signal. The liquid (ink) is discharged through the corresponding discharge opening upon growth and contraction of this bubble, thereby forming at least one droplet. When this driving signal is a pulse signal, the bubble is instantaneously grown and contracts, high-speed liquid (ink) discharge can be more preferably performed. Preferable pulse shapes are disclosed in U.S. Pat. Nos. 4,463,359 and 4,345,262. When conditions associated with a temperature increase rate of the heat application surface, as disclosed in U.S. Pat. No. 4,313,124 is employed, better recording can be performed.

A recording head arrangement with heat application portions arranged in bent passages, as disclosed in U.S. Pat. Nos. 4,558,333 and 4,459,600, is also incorporated in the present invention in addition to a combination (linear ink path or a right-angled flow path) of a discharge port, an ink path, and an electrothermal conversion element, as disclosed in each specification of the prior art. In addition, the present invention is effective with an arrangement having a common slit as a discharge portion of the electrothermal conversion elements, disclosed in Japanese Laid-Open Patent Application No. 59-123670 and to an arrangement having a correspondence between an opening for absorbing an energy pressure wave and a discharge port, as disclosed in Japanese Laid-Open Japanese Application No. 59-138461.

As a full-line type recording head having a length corresponding to the width of the maximum recording medium used in the recording apparatus, a plurality of recording heads disclosed in the above specifications may be combined to cover the entire recording length, or a single recording head may be used. The present invention can further enhance the effect as described above.

In addition, the present invention is also effective when an exchangeable chip type recording head capable of being electrically connected to the apparatus main body and supplying ink from the apparatus main body, or a cartridge type recording head integrally formed with the recording head is mounted in the apparatus main body.

A recording head recovery means and a supplementary assisting means are preferably arranged as constituting components of the recording apparatus of the present invention to further enhance stability of the effect of the present invention. Examples are a recording head capping means, a recording head cleaning means, a recording head pressing means, a recording head suction means, an electrothermal conversion element, another heating element, a combination of the electrothermal conversion element and this heating element, and an arrangement for setting a preliminary discharge mode for discharging independently of recording so as to perform stable recording.

A recording mode of the recording apparatus is not limited to a recording mode for only a major color such as black. An integral full-color recording head or a plurality of single-color recording heads may be used. The present invention is also effective with an apparatus having at least one of a plurality of different colors or a color mixing full-color mode.

In each embodiment described above, a liquid ink is used. However, an ink which is solidified at room temperature or less, an ink which is softened or melted even at room temperature, or the like may be used. Alternatively, an ink which is solidified or melted in the general temperature control range of 30° C. to 70° C. may be used in ink-jet printing. That is, any ink may be used when it is melted when a print signal is applied to the recording head. A temperature increase by a heat energy may be positively prevented by using a phase transition from the solid phase to the liquid phase, or an ink which is solidified in an exposed state to aim at prevention of evaporation of the ink may be used. In either case, an ink which is melted upon reception of the print signal of the heat energy may be used. In this case, the melted ink is discharged. In addition, an ink which is solidified at the time of its arrival on the recording medium, or an ink which is melted upon reception of heat energy may be applied to the present invention. In this case, as described in Japanese Laid-Open Patent Application No. 54-56847 or 60-71260, ink may oppose the corresponding electrothermal conversion element while the ink is held in a recess portion of a porous sheet or held as a liquid or solid body in a through hole. According to the present invention, a film boiling scheme is most effective for these inks.

In addition, as the form of an ink-jet recording apparatus, the apparatus may be used as an image output terminal for a data processing unit such as a computer, a copying machine as a combination with a reader or the like, and a facsimile apparatus having a transmission/reception function.

According to the present invention, as has been described above, correction associated with the temperature of the control circuit area is performed for a control object member (the ink-Jet recording apparatus recording means in each embodiment) to eliminate a control error as in a technique for detecting the state of the recording means while a direct temperature measurement is performed. Since detection or anticipation precision is better than temperature control by the conventional temperature sensor and the detection error range of the temperature sensor itself, execution modes based on various temperatures can be accurately performed.

In addition to the ink-jet recording head utilizing a heat energy, the present invention is applicable to heating elements driven individually or in units of predetermined groups, such as a thermal head for applying a heat energy to an ink ribbon or a porous ink convey unit. In this case, any temperature sensor need not be arranged directly on or near the heating element. Disconnections of the sensor and sensor wiring lines can be eliminated, and the measurement is free from sensor variations. In particular, in a recording heating element array, each heating portion is locally heated to slightly change the response of the temperature sensor, thereby disabling accurate determination. The present invention can solve this.

In particular, the present invention provides marvelous effects in a control object member (e.g., an ink-jet recording head using an ink (solid or liquid)) having various thermal parameters such as an ink heat capacity, a head structure, and heating of the above member. These parameters cause variations in position for accurately determining the temperature due to a use or drive state. Therefore, it is difficult to determine a timing at which accurate determination is performed. However, the present invention can solve this drawback.

In a bubble-jet machine utilizing an ink-jet boiling film, proposed by Canon INC., the film temperature locally exceeds 300° C. due to heat-insulating expansion of bubbles. Even if the parameters having large variations are included, or a local heating portion such as a driving switching diode is included, variation factors can be systematically determined to perform temperature control, thus proving superiority of the present invention over the prior arts.

In the scanning type recording apparatus for scanning a recording head to perform recording, an operation error of the temperature detection sensor occurs due to a scanning speed and a difference between speeds during scanning and the stop state. The present invention can solve this problem.

In the embodiments described above, technical arrangements based on the description of the respective components, and their modifications may be incorporated in the present invention in a combination without departing from the spirit and scope of the invention.

What is claimed is:

1. An ink-jet recording apparatus for discharging ink droplets from a recording head to perform recording, said apparatus comprising:

heat means for heating said recording head to control a temperature of ink;

temperature measurement means for measuring an ambient temperature of said recording head;

timer means for measuring a time period during a previous recording operation; and control means for subsequently controlling an energy to be supplied to said heat means on a basis of the time period measured by said timer means with respect to the ambient temperature measured by said temperature measurement means, wherein said timer means measures a record time and a non-record time of said recording head, the record time being a time period during which said recording head is conveyed and performs recording, the non-record time being a time period during which said recording head does not perform recording, and said control means controls the energy supplied to said heat means during the recording operation on a basis of the ambient temperature and the record time, and controls the energy supplied to said heat means prior to the recording operation on a basis of the ambient temperature and the non-record time.

2. An apparatus according to claim 1, wherein said recording head has a plurality of discharge ports for discharging the ink with the energy.

3. An apparatus according to claim 1, wherein said recording head comprises a plurality of discharge ports for discharging the ink, and heat energy generation means, arranged in units of discharge ports, for causing a state change in the ink by heat, discharging the ink from said discharge ports on the basis of the state change, and forming flying droplets.

4. An apparatus according to claim 1, wherein said recording head comprises a disposable recording head detachably formed in said apparatus.

5. An apparatus according to claim 1, wherein said recording head comprises a full-line recording head having a plurality of discharge ports spanning in an entire recording width of a recording medium.

6. An apparatus according to claim 1, wherein said apparatus is applied to a facsimile apparatus for recording a recording signal received through a communication line.

7. An apparatus according to claim 1, wherein said control means controls the supply energy on the basis of a pulse width of a drive pulse supplied to said heat means.

8. An ink-jet recording apparatus for discharging ink droplets from a recording head to perform recording, said apparatus comprising:

heat means for heating said recording head to control a temperature of ink;

temperature measurement means for measuring an ambient temperature of said recording head;

timer means for measuring a time period during a previous recording operation; and control means for subsequently controlling an energy to be supplied to said heat means on a basis of the time period measured by said timer means with respect to the ambient temperature measured by said temperature measurement means, wherein said control means controls the energy to be supplied to said heat means for every line of recording and said control means modifies the energy to be supplied in accordance with an amount a recording medium is conveyed between lines of recording.

9. An ink-Yet recording apparatus for discharging ink droplets from a recording head to perform recording, said apparatus comprising:

heat means for heating said recording head to control a temperature of ink;

temperature measurement means for measuring an ambient temperature of said recording head;

timer means for measuring a time .period during a previous recording operation;

control means for subsequently controlling an energy to be supplied to said heat means on a basis of the time period measured by said timer means with respect to the ambient temperature measured by said temperature measurement means; and moving means for moving the recording head relative to a recording medium, wherein said control means controls energy to be supplied to said heat means for every line of recording and said control means modifies the energy to be supplied to said heat means in accordance with an amount said moving means moves the recording head for one line of recording.

* * * * *

UNITED STATES PATENT AND TRADEMARK OFFICE

CERTIFICATE OF CORRECTION

PATENT NO. : 5,485,179 Page 1 of 5

DATED : January 16, 1996

INVENTOR(S) : Naoji OTSUKA, et al.

It is certified that error appears in the above-indentified patent and that said Letters Patent is hereby corrected as shown below:

DRAWING SHEET 13 OF 33:

Figure 20A, at Step S201, "PRINT TIME" (second occurrence) should read --PRINT PULSE--.

DRAWING SHEET 20 OF 33:

Figure 26, "EQUIBILIZED" (both occurrences) should read --EQUILIBRATED--.

COLUMN 2:

Line 58, "a-desired" should read --a desired--.

COLUMN 7:

Line 26, "an" should be deleted.

COLUMN 8:

Line 37, "forman" should read --form an--.

UNITED STATES PATENT AND TRADEMARK OFFICE

CERTIFICATE OF CORRECTION

DATED : January 16, 1996

INVENTOR(S) : Naoji OTSUKA, et al.

It is certified that error appears in the above-indentified patent and that said Letters Patent is hereby corrected as shown below:

COLUMN 10:

Line 10, "supplymember" should read --supply member--.

COLUMN 12:

Line 3, "apply" should read --apply to--.

COLUMN 13:

Table 2, "3%" should read --35%--;
Line 22, "used" should read --when--.

COLUMN 19:

Line 6, "(step" should read --counter (step--;
Line 18, "printing=$P_{preox\ f(TFINI)}$" should read --printing = $P_{preo}$ x $f(T_{FINI})$--.

UNITED STATES PATENT AND TRADEMARK OFFICE

CERTIFICATE OF CORRECTION

PATENT NO. : 5,485,179

DATED : January 16, 1996

INVENTOR(S) : Naoji OTSUKA, et al.

It is certified that error appears in the above-indentified patent and that said Letters Patent is hereby corrected as shown below:

COLUMN 20:

Line 41, "FIG. 20, a host 21" should read --FIG. 21, a host 20--;

Line 64, "print-characters" should read --print characters--.

COLUMN 21:

Line 8, "f($T_{FINE}$)." should read --f($T_{FINI}$).--.

COLUMN 22:

Line 21, "heat" should read --head--.

COLUMN 24:

Line 28, "Re" should read --be--.

UNITED STATES PATENT AND TRADEMARK OFFICE

CERTIFICATE OF CORRECTION

PATENT NO. : 5,485,179 Page 4 of 5

DATED : January 16, 1996

INVENTOR(S) : Naoji OTSUKA, et al.

It is certified that error appears in the above-indentified patent and that said Letters Patent is hereby corrected as shown below:

COLUMN 27:

Line 45, insert --TABLE 12--;

Line 48, "15°C. or less" (second occurrence) should read --10°C. or less--.

COLUMN 33:

Line 2, "10" (second occurrence) should be deleted.

COLUMN 35:

Line 41, "ink-Jet" should read --ink-jet--.

COLUMN 36:

Line 66, "in" should be deleted.

UNITED STATES PATENT AND TRADEMARK OFFICE

CERTIFICATE OF CORRECTION

PATENT NO. : 5,485,179 Page 5 of 5

DATED : January 16, 1996

INVENTOR(S) : Naoji OTSUKA, et al.

It is certified that error appears in the above-indentified patent and that said Letters Patent is hereby corrected as shown below:

COLUMN 38:

Line 1, "ink-Yet" should read --ink-jet--;
Line 9, ".period" should read --period--.

Signed and Sealed this

Third Day of September, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,485,179

DATED : January 16, 1996

INVENTOR(S) : Naoji OTSUKA, et al.

It is certified that error appears in the above-indentified patent and that said Letters Patent is hereby corrected as shown below:

ON THE COVER PAGE:

At [30] - Foreign Application Priority Data:

The following should be inserted:

--Sep. 11, 1990 [JP] Japan.....2-240481--.

Signed and Sealed this

Fifteenth Day of July, 1997

*Attest:*

*Attesting Officer*

BRUCE LEHMAN

*Commissioner of Patents and Trademarks*